US008232746B2

(12) United States Patent
Yufuku et al.

(10) Patent No.: US 8,232,746 B2
(45) Date of Patent: Jul. 31, 2012

(54) HIGH PRESSURE DISCHARGE LAMP LIGHTING DEVICE AND LIGHTING FIXTURE USING THE SAME

(75) Inventors: Akira Yufuku, Himeji (JP); Hiroyasu Eriguchi, Neyagawa (JP); Takeshi Goriki, Yawata (JP); Takeshi Kamoi, Kyoto (JP); Jun Kumagai, Suita (JP); Naoki Komatsu, Kobe (JP); Nobutoshi Matsuzaki, Neyagawa (JP); Satoru Nagata, Kobe (JP); Daisuke Yamahara, Shijonawate (JP)

(73) Assignee: Panasonic Corporation, Osaka (JP)

( * ) Notice: Subject to any disclaimer, the term of this patent is extended or adjusted under 35 U.S.C. 154(b) by 182 days.

(21) Appl. No.: 12/864,929

(22) PCT Filed: Jan. 28, 2009

(86) PCT No.: PCT/JP2009/051334

§ 371 (c)(1),
(2), (4) Date: Jul. 28, 2010

(87) PCT Pub. No.: WO2009/096417

PCT Pub. Date: Aug. 6, 2009

(65) Prior Publication Data

US 2010/0327776 A1 Dec. 30, 2010

(30) Foreign Application Priority Data

Jan. 28, 2008 (JP) ..... 2008-015772
Jan. 28, 2008 (JP) ..... 2008-015773
Jan. 28, 2008 (JP) ..... 2008-015777
Jan. 28, 2008 (JP) ..... 2008-015778

(51) Int. Cl.
*H01J 11/04* (2011.01)
*H01J 13/48* (2006.01)
*H01J 15/04* (2006.01)
*H01J 17/36* (2006.01)

(52) U.S. Cl. .... 315/326; 315/299; 315/302; 315/DIG. 7

(58) Field of Classification Search ..... None
See application file for complete search history.

(56) References Cited

U.S. PATENT DOCUMENTS 7,462,992 B2 * 12/2008 Arbinger et al. ..... 315/289
2008/0203937 A1 * 8/2008 Hooijer et al. ..... 315/276

FOREIGN PATENT DOCUMENTS

EP 1 916 882 A1 4/2008
JP 7-65984 A 3/1995
JP 2002-352971 A 12/2002
JP 2007-52977 A 3/2007

* cited by examiner

OTHER PUBLICATIONS

International Search Report for the Application No. PCT/JP2009/051334 mailed Apr. 21, 2009.

*Primary Examiner* — Anh Tran
(74) *Attorney, Agent, or Firm* — Cheng Law Group, PLLC

(57) ABSTRACT

A high pressure discharge lamp lighting device in this invention comprises a converter, an inverter, an igniter, a controller, and a pulse voltage detection circuit. The converter outputs the direct current voltage. The inverter converts the direct current voltage into the lighting voltage which is alternating current voltage, and applies the lighting voltage to the high pressure discharge lamp through an output terminal. The igniter is configured to output the pulse voltage superimposed on the lighting voltage, whereby the starting voltage is applied to the high pressure discharge lamp. The controller is configured to control the igniter to allow the igniter to superimpose the pulse voltage on the lighting voltage. The pulse voltage detection circuit detects the starting voltage to output the detection signal. The starting voltage regulation circuit regulates the starting voltage to the desired voltage value of the voltage on the basis of the detection signal.

18 Claims, 43 Drawing Sheets

FIG. 25a high pressure pulse voltage

FIG. 25b output of the control circuit at the starting of of the step down chopper (output target value)

FIG. 25c output of the control circuit at the starting of of the step up chopper (output target value)

FIG. 25d output voltage from the step up chopper

FIG. 25e output voltage from the step down chopper

FIG. 25f output voltage from the inverter

FIG. 25g voltage applied to the high pressure discharge lamp

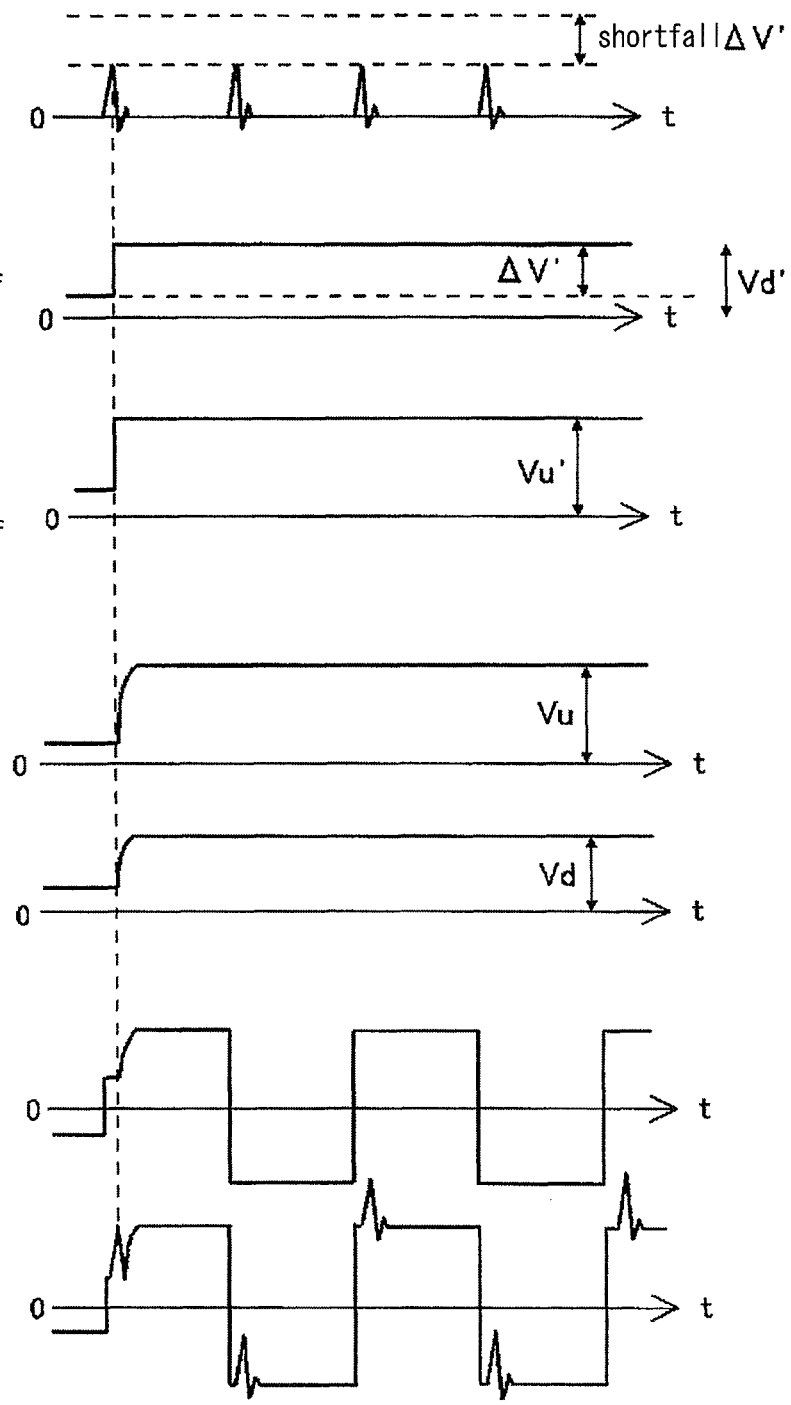

high pressure pulse voltage when the wiring is shortest high pressure pulse voltage the output of the peak value detection section output of the pulse variation detection section setting value of the reference output voltage of the step down chopper output target value setting unit FIG. 30a
output voltage from the step down chopper
FIG. 30b
high pressure pulse voltage
FIG. 30c
output of the pulse voltage detection circuit
FIG. 30d
output of the variation detection circuit
FIG. 30e
output of the start pulse control circuit
FIG. 30f
voltage applied to the high pressure discharge lamp
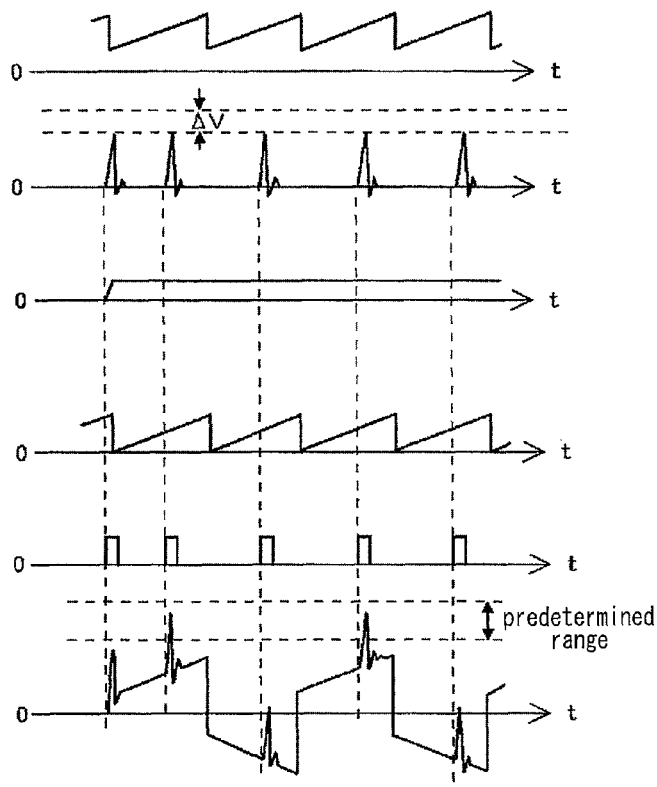
FIG. 31
output voltage from the inverter
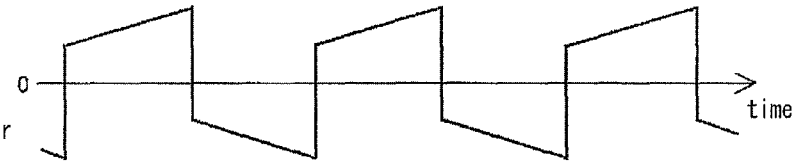
FIG. 32
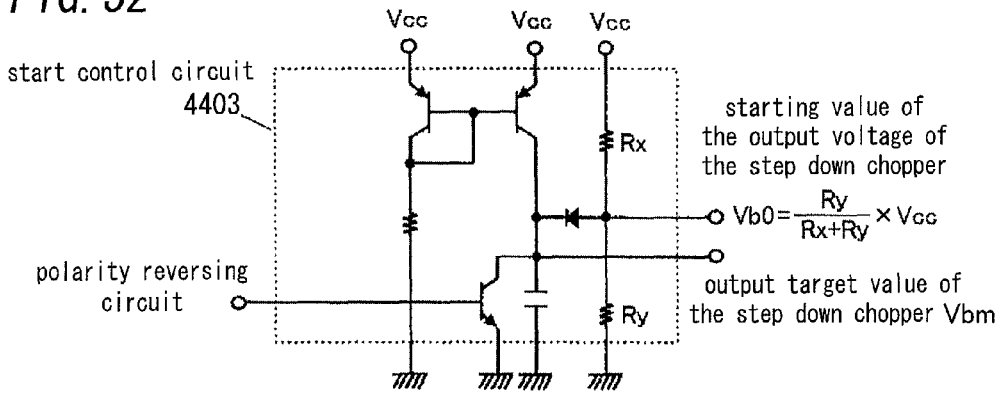

FIG. 36a output of the pulse variation detection section

FIG. 36b output target value of the step down chopper Vbm

FIG. 36c starting value of the output voltage of the step down chopper Vb0

FIG. 36d variation value of the output of the step down chopper Vbm−Vb0

FIG. 36e output of the FET gate voltage control circuit

FIG. 36f output voltage from the inverter

FIG. 36g voltage applied to the high pressure discharge lamp

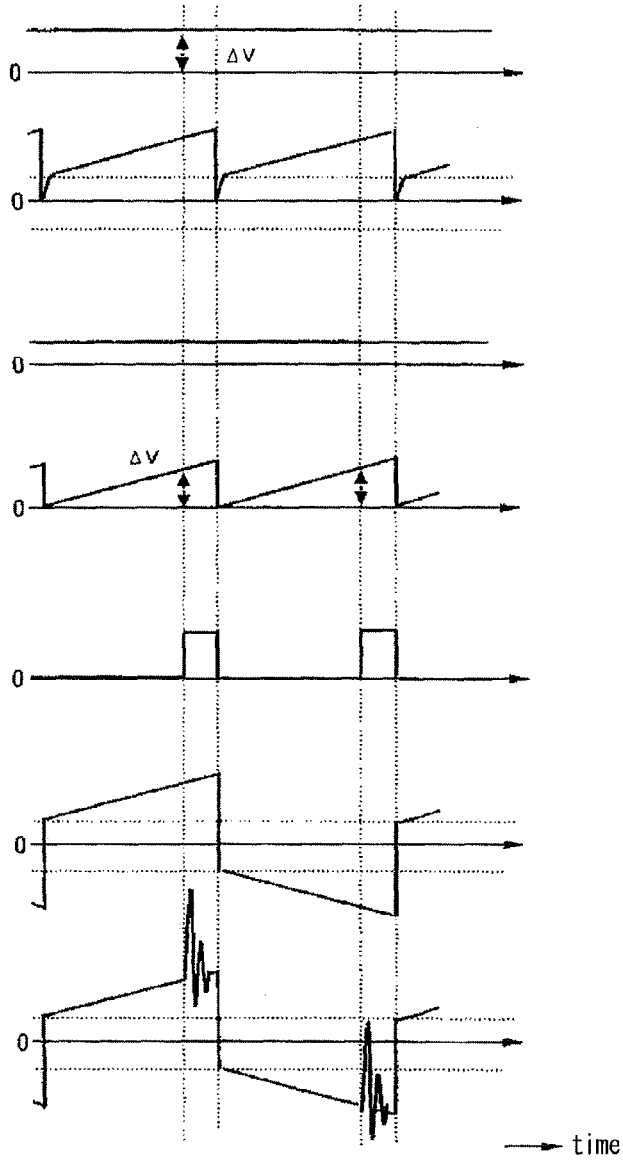

FIG. 37 output voltage from the inverter

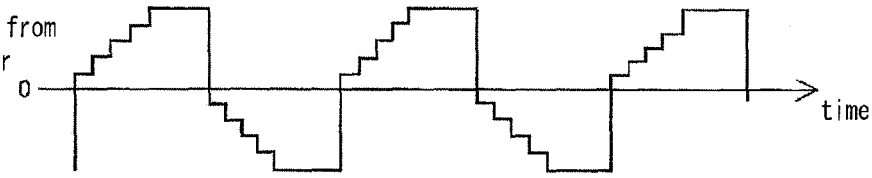

polarity reversion signal
0
t output of the start pulse control circuit
0
t output voltage from the step down chopper
0
t output voltage from the inverter
0
t voltage applied to the high pressure discharge lamp
0
t polarity reversion signal output of the start pulse control circuit high pressure pulse voltage output voltage from the step down chopper voltage applied to the high pressure discharge lamp pulse voltage detection circuit
1204
N3
8
N1a
Q7a
N2
N1b
Q7b
7004
T1
C2
L1
C1
6004
6014
polarity selection circuit
95
90
Q5
Q6
Q3
Q4
polarity reversion control circuit
judging circuit
5104
5004
C4
L3
D2
Q2
4
output detection unit
4104
output control unit
4204
4004
E
C3
D1
Q1
3
output detection unit
3104
output control unit
3204
3004
L2
Ci
DB
2
1
control circuit S

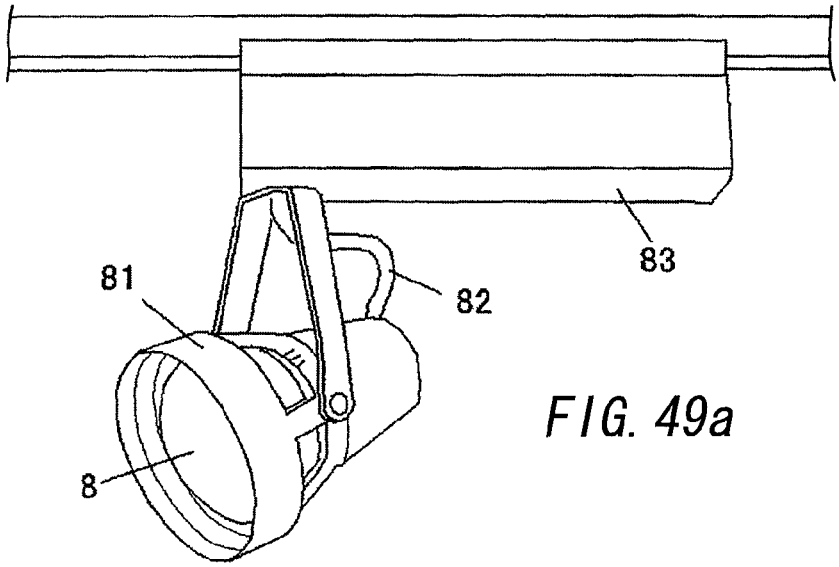
FIG. 49a
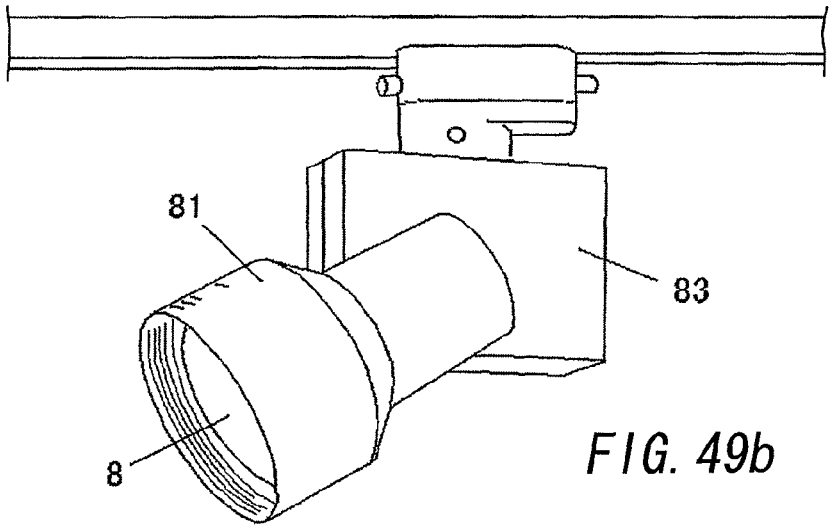
FIG. 49b
FIG. 49c
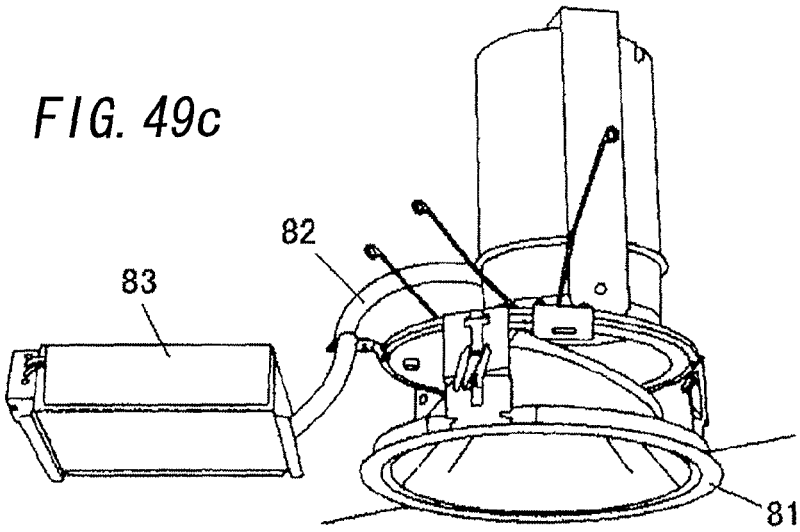

HIGH PRESSURE DISCHARGE LAMP LIGHTING DEVICE AND LIGHTING FIXTURE USING THE SAME

TECHNICAL FIELD

This invention relates to a high pressure discharge lamp lighting device being configured to regulate a peak value of the starting pulse voltage in order to turn on a high pressure discharge lamp. This invention also relates to a lighting fixture using the high pressure discharge lamp lighting device.

BACKGROUND ART

Japanese patent application publication No. 2007-52977 discloses a prior high pressure discharge lamp. The prior high pressure discharge lamp is configured to receive the electric power from a commercial power source. The high pressure discharge lamp comprises a control power source circuit, a controller, a rectification circuit, a step up chopper, a step down chopper, an inverter, and an igniter. The control power source circuit is configured to receive the electric power from the commercial power source. The controller is configured to send a control signal to the step up chopper, the step down chopper, the inverter, and the igniter. The step up chopper is cooperative with the step down chopper to act as a converter. The converter receives the voltage which is supplied from the rectification circuit, and steps up the voltage supplied from the rectification circuit to output a predetermined output voltage which is direct current. The inverter converts the output voltage into a lighting voltage which has a predetermined frequency and which has an alternating rectangular wave. The lighting voltage is applied to the high pressure discharge lamp through the output terminals. The igniter is configured to superimpose the pulse voltage on the lighting voltage when the high pressure discharge lamp is started. In this manner, the igniter is cooperative with the inverter to generate a lighting pulse voltage which includes the pulse voltage which is superimposed on the lighting voltage, and to apply the lighting pulse voltage to the high pressure discharge lamp.

However, the prior high pressure discharge lamp is disposed in various locations. In this case, a wiring which connects the high pressure discharge lamp lighting device with the high pressure discharge lamp has a various length. In a case where the length of the wiring between the high pressure discharge lamp and the high pressure discharge lamp lighting device is long, the voltage value of the starting voltage applied to the high pressure discharge lamp from the high pressure discharge lamp lighting device is decreased. In contrast, in a case where the length of the wiring between the high pressure discharge lamp and the high pressure discharge lamp lighting device is short, the voltage value of the starting voltage applied to the high pressure discharge lamp from the high pressure discharge lamp lighting device is increased. Therefore, the high pressure discharge lamp lighting device being configured to output a uniform starting voltage is not capable of starting the high pressure discharge lamp steadily.

DISCLOSURE OF THE INVENTION

Problems to be Resolved by the Invention

This invention is achieved to solve the above problem. An object of this invention is to produce the high pressure discharge lamp lighting device being configured to apply the starting voltage for starting the high pressure discharge lamp to the high pressure discharge lamp regardless of the wiring length between the high pressure discharge lamp lighting device to the high pressure discharge lamp.

Means of Solving the Problem

In order to solve the above problem, the high pressure discharge lamp lighting device in this invention comprises a converter, n inverter, an igniter, a controller, and a pulse voltage detection circuit. The converter is configured to output a direct current voltage. The inverter is configured to convert the direct current voltage into a lighting voltage. The lighting voltage is an alternate current voltage. The inverter is configured to apply the lighting voltage to the high pressure discharge lamp through an output terminal. The igniter is configured to output a pulse voltage. The igniter comprises is configured to superimpose the pulse voltage on the lighting voltage to apply a starting voltage to the high pressure discharge lamp. The igniter comprises a capacitor, a switching means, and a transformer. The capacitor is configured to be charged by a voltage source. The transformer comprises a primary winding and a secondary winding. The primary winding is connected across said capacitor. The primary winding being connected in series with said switching means. The secondary winding being connected across said inverter. The secondary winding is connected in series with the high pressure discharge lamp. The controller is configured to turn on and turn off the switching means. The controller is configured to turn on said switching means in order to discharge the capacitor, whereby the controller applies a discharge current to said primary winding in order to develop the pulse voltage in the secondary winding. The pulse voltage is superimposed on the lighting voltage. The pulse voltage detection circuit is configured to detect the starting voltage which is applied to the high pressure discharge lamp. The pulse voltage detection circuit is configured to output a detection signal indicative of a voltage level which corresponds to the starting voltage. The high pressure discharge lamp lighting device further comprises a starting voltage regulation circuit. The starting voltage regulation circuit is configured to regulate the voltage value of the starting voltage to a desired voltage value on the basis of the detection signal.

It is preferred that the transformer further comprises a third winding. The third winding is configured to develop a detection voltage which corresponds to the pulse voltage when the pulse voltage is developed in the secondary winding. The pulse voltage detection circuit is configured to detect the starting voltage on the basis of the detection voltage which is developed in the third winding.

In this case, it is possible to obtain the high pressure discharge lamp lighting device being configured to apply the starting voltage to the high pressure discharge lamp regardless of the wiring length from the high pressure discharge lamp lighting device to the high pressure discharge lamp.

Furthermore, it is preferred to regulate the voltage value of the starting voltage to a desired voltage value by means of regulating the pulse voltage (generated by the igniter) superimposed on the lighting voltage Therefore, it is preferred that the starting voltage regulation circuit is configured to vary an amount of an electrical charge of said capacitor at a moment when the capacitor is discharged. The amount of the electrical charge is determined on the basis of the detection signal.

It is preferred that the high pressure discharge lamp lighting device further comprises an impedance. The impedance is placed between the voltage source and the capacitor. The impedance is cooperative with the capacitor to form a charging circuit. The starting voltage regulation circuit comprises a charge start detection circuit, a timer, and a capacitor voltage regulation circuit. The charge start detection circuit is configured to output a charge start signal when said charge start detection circuit detects a start of a charging of said capacitor by the voltage source. The timer is configured to output a charge completion signal after an elapse of a predetermined period of a charging time from when the timer receives the charge start signal. The capacitor voltage regulation circuit is configured to vary an amount of charge of the capacitor at a moment when said capacitor discharges. The controller is configured to turn on said switching means when said controller receives the charge completion signal. The capacitor voltage regulation circuit is configured to vary the impedance value of the impedance on the basis of the detection signal, whereby the capacitor voltage regulation circuit varies a charging speed of charging the capacitor to vary the amount of the electrical charge of said capacitor.

It is also preferred that the starting voltage regulation circuit comprises a charge start detection circuit and a timer. The charge start detection circuit is configured to detect the start of charging of said capacitor in order to output the charge start signal. The timer is configured to output a charge completion signal when a predetermined charging period of time is passed from when the timer receives the charge start signal. The controller is configured to turn on said switching means when said controller receives the charge completion signal. The timer is configured to vary a charging time for charging said capacitor on the basis of the detection signal, whereby the timer varies the amount of the electrical charge of the capacitor when said timer outputs the charge completion signal.

It is preferred for the high pressure discharge lamp lighting device to regulate the starting voltage to the desired value by regulating the pulse voltage (which is generated by the igniter) which is superimposed on the lighting voltage. In this case, the starting voltage regulation circuit is configured to regulate the discharge current which flows to the primary winding. The discharge current is regulated on the basis of the detection signal.

It is preferred that the capacitor is cooperative with the switching means and said primary winding of said transformer to form a discharge circuit for flowing the discharge current from the capacitor. The starting voltage regulation circuit is configured to vary the impedance value of the discharge circuit on the basis of the detection signal.

It is preferred that the switching means has an internal impedance value. The impedance value is varied according to an input voltage or an input current which is applied to the switching means. The starting voltage regulation circuit is configured to vary the input voltage or the input current on the basis of the detection signal.

In this case, it is possible to regulate the discharge current which is applied to the discharge circuit by varying the internal impedance of the switching means.

It is preferred that the switching means comprises a first switching element and a second switching element. The first switching element is connected in parallel with said second switching element. The first switching element has a first internal impedance when said first switching element is turned on. The second switching element has a second internal impedance when said second switching element is turned on. The first internal impedance is different from the second internal impedance. The starting voltage regulation circuit is configured to output a selection signal for allowing said controller to selectively turn on said first switching element or said second switching element. Said selection signal is determined on the basis of the detection signal.

In this case, it is possible to regulate the discharge current which is applied to the discharge circuit by selectively using the switching elements which have the internal impedances which is different from each other.

It is preferred that the primary winding comprises a tap. The switching means comprises a first switching element and a second switching element. The second switching element is connected in parallel with the first switching element through the tap. The starting voltage regulation circuit is configured to output a selection signal for allowing said controller to selectively turn on the first switching element or the second switching element. The selection signal is determined on the basis of the detection signal.

In this case, "the impedance of the primary winding when the first switching element is turned on" is different from "the impedance of the primary winding when the second switching element is turned on". In addition, "a transformer ratio when the first switching element is turned on" is different from "a transformer ratio when the second switching element is turned on". Therefore, it is possible to obtain the igniter being configured to regulate the discharge current which is applied to the discharge circuit, and being configured to vary the transformer ratio. Consequently, it is possible to obtain the high pressure discharge lamp lighting device being configured to vary the starting voltage.

It is preferred for the high pressure discharge lamp lighting device to include the starting voltage regulation circuit being configured to vary the lighting voltage on the basis of the detection signal.

It is preferred that the starting voltage regulation circuit is configured to vary said lighting voltage on the basis of said detection signal.

It is preferred that the starting voltage regulation circuit is configured to temporarily increase, on the basis of the detection signal, a voltage value of the lighting voltage which is output from the inverter in synchronization with a timing of turning on said switching means on the basis of said detection signal.

In addition, it is preferred that the starting voltage regulation circuit is configured to determine "a timing when the starting voltage becomes a desired value" on the basis of the detection signal. The starting voltage regulation circuit allows the controller to turn on the switching element at the timing.

It is preferred that the starting voltage regulation circuit is configured to control the converter to vary a voltage value of the direct current voltage linearly within a half-cycle of the lighting voltage.

It is preferred that the starting voltage regulation circuit is configured to control the converter to vary a voltage value of the direct current voltage in a stepwise fashion within a half cycle of the lighting voltage.

In this case, it is possible to obtain the high pressure discharge lamp lighting device being configured to apply the desired starting voltage to the high pressure discharge lamp by regulation of the lighting voltage.

It is preferred that the starting voltage regulation circuit is configured to select a timing whether the pulse voltage is developed in the positive voltage of the lighting voltage or in the negative voltage of the lighting voltage on the basis of the detection signal. The starting voltage regulation circuit is configured to control said controller to turn on the switching element at the timing.

It is preferred that the starting voltage regulation circuit is configured to detect whether the voltage value of the pulse voltage has a first condition or a second condition on the basis of the detection signal. The voltage value of the pulse voltage in the first condition is higher than a reference value. The voltage value of the pulse voltage in the second condition is lower than the reference value. The starting voltage regulation circuit is configured to generate the pulse voltage when the lighting voltage has a polarity which is opposite to a polarity of the pulse voltage in a case where the voltage value of the pulse voltage has the first condition. The starting voltage regulation circuit is configured to generate the pulse voltage when the lighting voltage has a polarity which is same to a polarity of the pulse voltage in a case where the voltage value of the pulse voltage has the second condition.

It is preferred that the primary winding is composed of a first primary winding and a second primary winding. The switching means comprises a first switching element and a second switching element. The capacitor is cooperative with said first primary winding and said first switching element to form a first discharging path. The capacitor is cooperative with the second primary winding and the second switching element to form a second discharging path. The second discharging path is connected in parallel with the first discharging path. The first primary winding is configured to develop a first pulse voltage in said secondary winding. The second primary winding is configured to develop a second pulse voltage in said secondary winding. The first pulse voltage has a polarity which is opposite to a polarity of the second pulse voltage. The starting voltage regulation circuit is configured to detect whether a voltage value of the pulse voltage has a first condition or a second condition on the basis of the detection signal. The voltage value of the pulse voltage in the first condition is higher than a reference voltage value. The voltage value of the pulse voltage in the second condition is higher than a reference voltage value. The starting voltage regulation circuit is configured to send an on-signal to the controller to allow the controller to turn on the first switching element or said second switching element when the voltage value of the pulse voltage has the first condition and when said lighting voltage has a polarity which is opposite to a polarity of the pulse voltage. The starting voltage regulation circuit is configured to send the on-signal to said controller to allow said controller to turn on the first switching element or the second switching element when the voltage value of the pulse voltage has the second condition and when the lighting voltage has a polarity which is same to a polarity of the pulse voltage.

In this case, it is possible to obtain the high pressure discharge lamp lighting device being configured to apply the starting voltage required for starting the high pressure discharge lamp to the high pressure discharge lamp by regulation of the timing for generation of the pulse voltage.

In addition, it is preferred that the lighting fixture comprises the high pressure discharge lamp lighting device of above mentioned.

These and still other objects and advantages will become apparent from the following and attached drawings.

BRIEF EXPLANATION OF THE DRAWINGS

FIGS. 25*a* to 25*g* show output waveforms of the third embodiment in a case where the output wiring is longest.

FIG. 30*a* to FIG. 30*f* show waveforms of the first modification of the third embodiment.

FIG. 31 shows a waveform showing a variation of the output of the first modification of the third embodiment in a case where the inverter has no load.

FIG. 32 shows a circuit diagram showing a start operation control circuit of the step down chopper of the first modification of the third embodiment.

FIG. 36*a* to FIG. 36*g* show operation waveforms of the first modification of the third embodiment.

FIG. 37 shows a waveform showing a variation of the output from the inverter of the first modification of the third embodiment in a case where inverter has no load.

FIG. 49*a* to FIG. 49*c* show exteriors of a lighting fixtures incorporating the high pressure discharge lamp in the first to fourth embodiments.

BEST MODE FOR CARRYING OUT THE INVENTION (First Embodiment)

Figure 1:
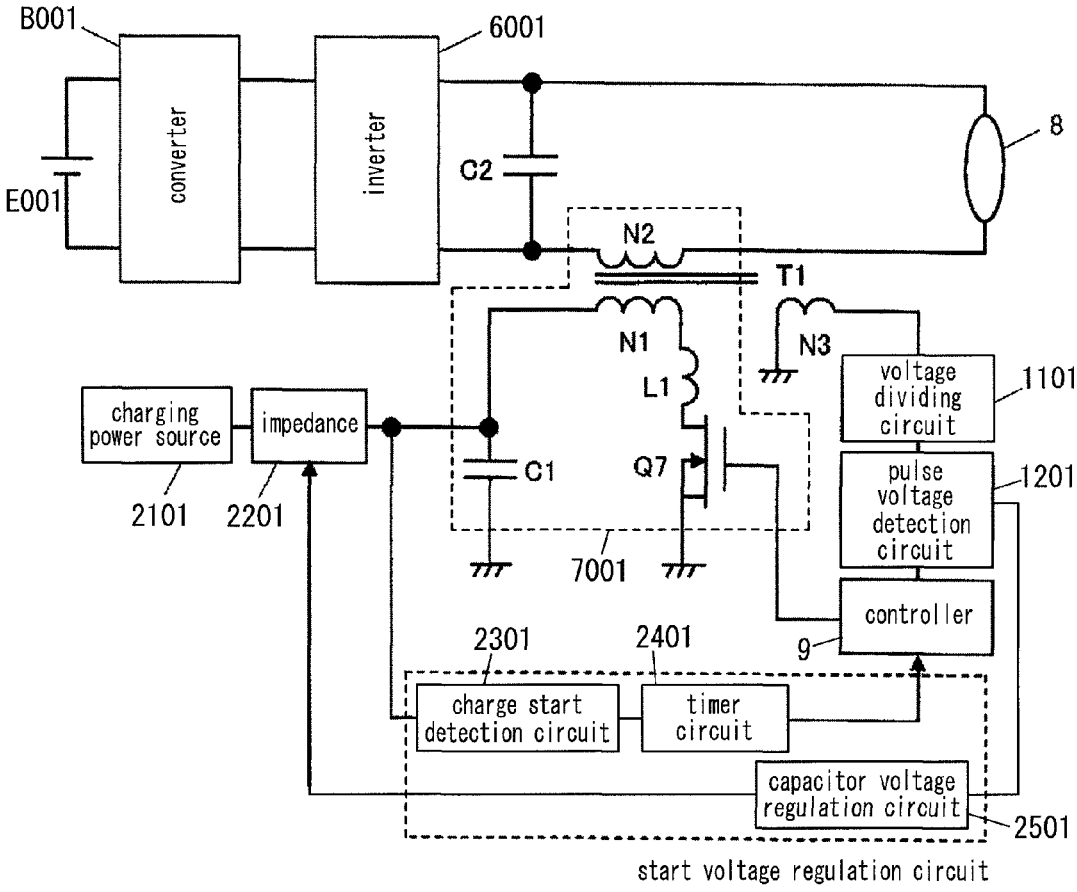
FIG. 1 shows a circuit diagram of a first embodiment.

FIG. 1 shows a circuit diagram in the first embodiment. A direct current power source E001 is exemplified by a direct current voltage source. The direct current voltage source is realized by a commercial alternating current power source which is configured to output an alternating current voltage which is rectified and also smoothed. A converter B001 is exemplified by a step down chopper. The converter B001 is configured to step up and step down the direct current voltage such that the converter B001 outputs the direct current voltage. The inverter 6001 is configured to invert the direct current voltage into a rectangular alternating current voltage by a low frequency, whereby the inverter 6001 outputs the rectangular alternating current voltage from output terminals. An igniter is configured to output a pulse voltage. The igniter is configured to superimpose the pulse voltage on the rectangular alternating current voltage. Consequently, the staring voltage is supplied to the high pressure discharge lamp.

The inverter 6001 is connected in parallel with a capacitor C2. The igniter 7001 comprises a capacitor C1, a transformer T1, an inductor L1, and a switching element Q7. The capacitor C1 is configured to be charged by a charging power source 2101. The transformer T1 comprises a primary winding N1, a secondary winding N2, and a third winding N3. A primary winding N1 is connected across the capacitor C1. The primary winding N1 is connected in series with the switching element Q7 and the inductor L1. The capacitor C1 is cooperative with the primary winding N1, the inductor L1, and the switching element Q7 to form a discharge circuit for discharging an electrical charge of the capacitor C1. The secondary winding is connected across the inverter 6001. The secondary winding N2 is connected in series with a high pressure discharge lamp. The third winding N3 is connected with the pulse voltage detection circuit 1201 through a voltage dividing circuit 1101. The pulse voltage detection circuit 1201 is connected to a controller 9. The controller 9 is configured to turn on and turn off the switching element Q7. When the controller 9 turns on the switching element Q7, the capacitor C1 discharges the electrical charge which is charged by the charging power source 2101. When the capacitor C1 discharges the electrical charges, the capacitor C1 flow a discharge current to the primary winding N1. The discharge current which flows to the primary winding N1 induces the pulse voltage in the secondary winding N2. The pulse voltage which is induced in the secondary winding N2 is, as mentioned above, superimposed on the lighting voltage. Furthermore, when the pulse voltage and the lighting voltage are applied to the secondary winding N2, the pulse voltage and the lighting voltage induces a detection voltage in the secondary winding N3. The detection voltage has a correlative relationship with respect to the starting voltage.

The high pressure discharge lamp lighting device further comprises an impedance 2201, a charge start detection circuit 2301, a timer circuit 2401, and a capacitor voltage regulation circuit 2501. The charge start detection circuit 2301 is configured to detect a start of the electrical charge of the capacitor C1. The timer circuit 2401 is configured to allow the controller 9 to turn on the switching element Q7 after an elapse of a predetermined time from when the charge start of the capacitor C1 is detected. The impedance 2201 is realized by a variable impedance. The impedance 2201 is placed between the charging power source and a capacitor C1. The impedance is cooperative with the capacitor C1 to form a charging circuit of the capacitor C1. In addition, the controller 9 is configured to turn on the switching element Q7 when the controller 9 receives an output which is output from the timer circuit 2401. The capacitor voltage regulation circuit 2501 is configured to receive a detection signal which is output from the pulse voltage detection circuit 1201, and subsequently varies the impedance value of the impedance 2201. Therefore, the capacitor voltage regulation circuit 2501 is cooperative with the charge start detection circuit 2301 and a timer circuit 2401 to act as the start voltage regulation circuit.

In this embodiment, the pulse voltage detection circuit 12 is configured to receive the detection voltage which is induced in the third wiring N3 of the transformer through the voltage dividing circuit 1101. The detection voltage which is induced in the third winding N3 has a correlative relationship with respect to a pulse voltage which is induced in the secondary winding N2. Therefore, the pulse voltage detection circuit 120 is configured to detect the starting voltage from the detection voltage which is divided by the voltage dividing circuit, and subsequently output the detection signal indicative of the voltage level corresponding to the starting voltage to the capacitor voltage regulation circuit 2501. When the starting voltage is detected as the high voltage, the capacitor voltage regulation circuit 2501 increases the impedance value of the impedance 2201. In contrast, when the starting voltage is detected as a low voltage, the capacitor voltage regulation circuit 2501 decreases the impedance value of the impedance 2201. The impedance value of the impedance 2201 varies a time constant of the charging circuit. Consequently, a speed of the charging of the capacitor C1 is varied. Therefore, the voltage of the capacitor C1 at a moment when the switching element Q7 is turned on is arbitrarily regulated. In other words, an amount of the electrical charge of the capacitor C1 at a moment when the switching element Q7 is turned on is regulated. Therefore, the pulse voltage which is induced in the secondary winding N2 is regulated. Therefore, the starting voltage which is applied to the high pressure discharge lamp is regulated.

Figure 2:
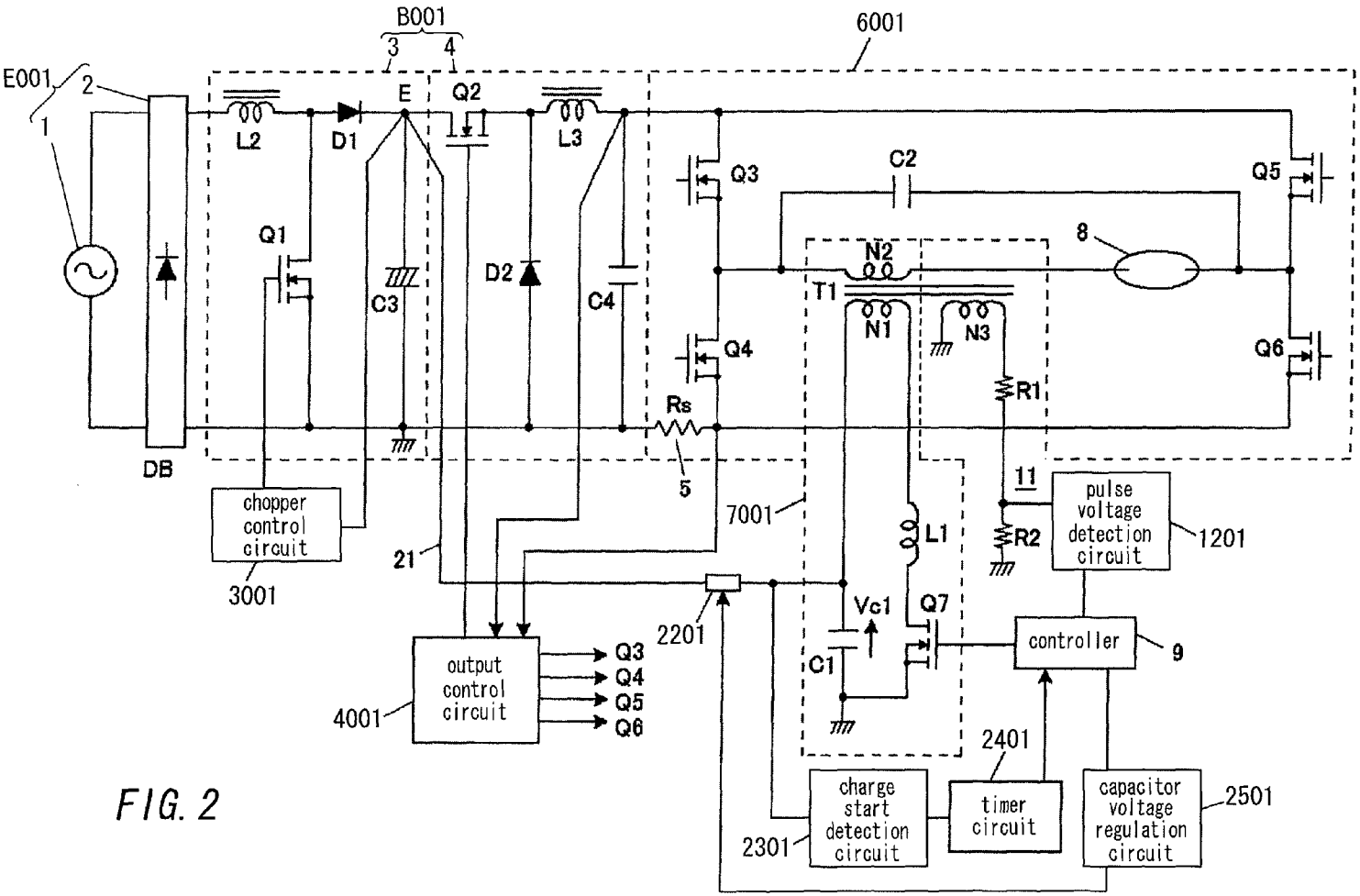
FIG. 2 shows a circuit diagram of a first embodiment.

FIG. 2 shows a circuit diagram of the first embodiment. The specific configurations of the direct current voltage source E001, the converter B001, and the inverter 6001 are explained. The rectification circuit 2 is realized by a diode bridge DB. The diode bridge DB is configured to full-wave rectifies the output which is output from the commercial alternating current power source, whereby the diode bridge DB outputs a pulsating voltage. The diode bridge DB is connected to a series circuit. The series circuit comprises the inductor L2 and the switching element Q1 which is in series with the inductor L2. A smoothing capacitor C3 is connected across the switching element Q1 through the diode D1. The inductor L2 is cooperative with the switching element Q1, the diode D1, and the smoothing capacitor C3 to form a step up chopper 3. The switching element Q1 is turned on and turned off by a step up chopper control circuit 3001. The step up chopper control circuit 3001 is realized by an integrated circuit which is commercially available. The switching element Q1 is turned on and turned off at a frequency which is higher than a frequency of the commercial alternating current voltage source 1. Consequently, the output voltage which is output from the diode bridge DB is stepped up to a predetermined direct current voltage. The capacitor C3 is charged by the predetermined direct current voltage.

The direct current power source E001 which is used in this embodiment is configured to output the direct current voltage which is made from the rectification and the smoothing of the output of the commercial alternating power source 1. However, the direct current voltage source E001 which is used in this embodiment is not limited thereto. That is, an electric battery is capable of employing as the direct current power source E001. In addition, a direct current power source which is commercially available is also capable of employing as the direct current power source E001.

The step up chopper 3 is connected across the step down chopper 4. The step down chopper 4 acts as a ballast for supplying a target electrical power to the high pressure discharge lamp 8 which is a load. The step up chopper 3 is configured to vary an output voltage which is output from the step down chopper 4 so that a suitable electrical power is supplied to the high pressure discharge lamp 8 from when the high pressure discharge lamp is started to when the high pressure discharge lamp is lighted.

The circuit components of the step down chopper 4 are mentioned as follows. The smoothing capacitor C3 (which acts as the direct current power source E001) has a positive terminal which is connected to a positive terminal of the capacitor C4 through the switching element Q2 and the inductor L3. A negative terminal of the capacitor C4 is connected to the negative terminal of the smoothing capacitor C3. A negative terminal of the capacitor C4 is connected to an anode of the diode D2 for flowing a regenerative current. A cathode of the diode D2 is connected with a point between the switching element Q2 and the inductor L3.

Operation of the step down chopper 4 is explained as follows. The switching element Q2 is turned on and turned off at a high frequency by a control signal which is output from the output control circuit 4001. When the switching element Q2 is turned on, the direct power source E001 flows an electrical current. The electrical current flows through the switching element Q2, the inductor L3, and the capacitor C4. When the switching element Q2 is turned off, the regenerative current is flown through the inductor L3, the capacitor C4, and the diode D2. Consequently, the capacitor C4 is charged by the direct current voltage which is made by stepping down the direct current voltage which is output from the direct current power source E001. In addition, the voltage applied to the capacitor C4 is varied by the output control circuit 4001 which is configured to vary the duty cycle of the switching element Q2. The duty cycle means a rate of the on period to one cycle.

The inverter 6001 is connected across the step down chopper 4. The inverter 6001 is realized by a full bridge circuit. The full bridge circuit comprises switching elements Q3 to Q6. A first pair comprises the switching elements Q3 and Q6. A second pair comprises the switching elements Q4 and Q5. The output control circuit 4001 outputs the control signal to turn on and turn off the first pair and the second pair alternately at a low frequency. Consequently, the inverter 6001 converts the output voltage of direct current which is output from the step down chopper 4 into the lighting voltage which is rectangular alternating wave. In addition, the inverter 6001 supplies the lighting voltage to the high pressure discharge lamp 8. The high pressure discharge lamp 8 (which is a load) is exemplified by a high intensity discharge lamp (HID lamp) such as a metal halide lamp and a high pressure mercury lamp.

In this embodiment, the inverter 6001 is exemplified by a full bridge circuit. However, it goes without saying that a half bridge circuit is also employed as the inverter 6001. In this case, the inverter 6001 comprises a series circuit comprising electrolytic capacitors which is connected in series with each other instead of the switching elements Q5 and Q6. The switching element Q3 and the switching element Q4 are alternately turned on and turned off.

In addition, this embodiment discloses that the voltage induced in the third winding is detected as the detection voltage. However, it is also possible to employ the pulse voltage detection circuit which is connected in parallel with the high pressure discharge lamp 8. Consequently, the pulse voltage detection circuit is configured to detect the starting voltage applied to the high pressure discharge lamp 8. Furthermore, it is also possible to connect the pulse voltage detection circuit in parallel with the primary winding N1. Consequently, the pulse voltage detection circuit is configured to detect the pulse voltage which is induced in the primary winding N1.

Figure 3:
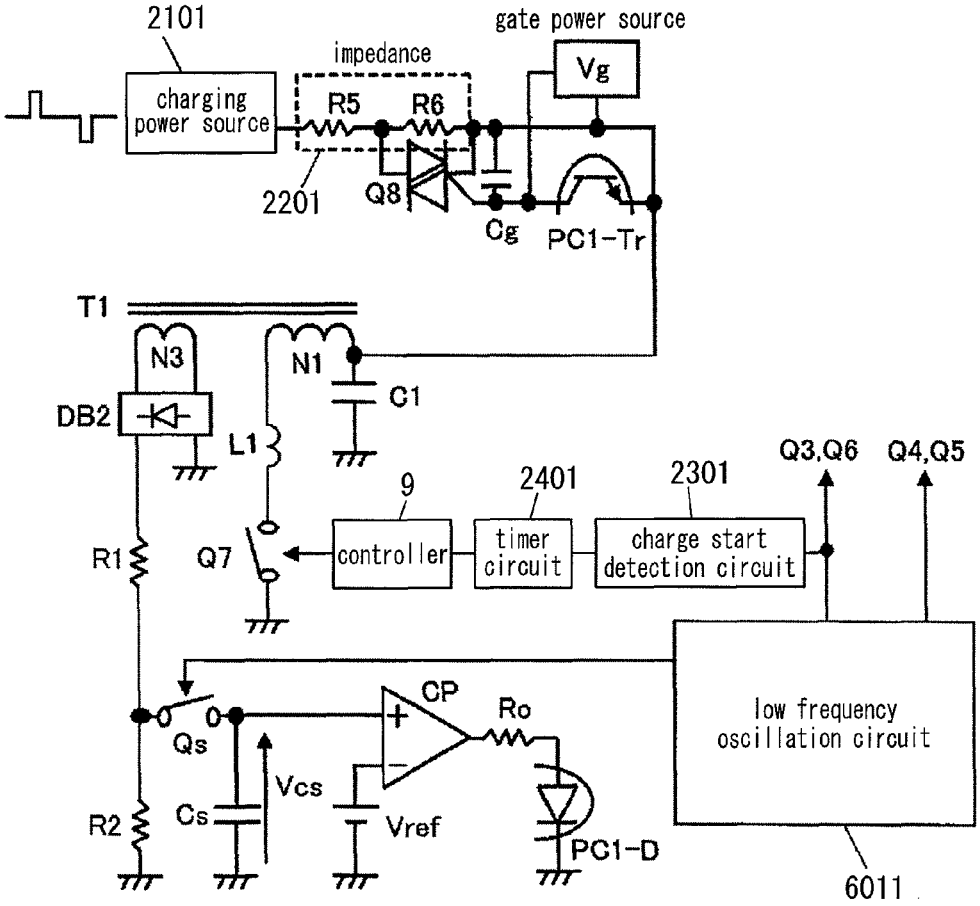
FIG. 3 shows main components of a first modification o the first embodiment.

FIG. 3 shows a circuit diagram showing main components of a first modification of the first embodiment. The main components are in common with the components in FIG. 1. In the circuit of FIG. 2, the charging power source 2101 is configured to charge the capacitor C1 in a single direction by using the direct current power source E001 which has a single polarity. However, the circuit in FIG. 3 employs "a power source which has a positive polarity and a negative polarity which are inverted in synchronization with the inverter 6001" as the charging power source 2101. Therefore, the charging power source 2101 charges the capacitor C1 in a positive direction and a negative direction alternately. The charging power source 2101 in this embodiment is configured to start charging the capacitor C1 immediately after the inversion of the polarity of the output of the inverter 6001. In addition, the charging power source 2101 is configured to stop charging the capacitor C1 from when the switching element Q7 is turned on to when the polarity of the output of the inverter 6001 is inverted next time. Furthermore, the capacitor C1 is alternately charged in the positive direction and in the negative direction at each time of inversion of the polarity of the output of the inverter 6001. Therefore, the switching element Q7 is realized by a switching element being configured to conduct the electrical current in the positive direction and also in the negative direction. It should be noted that the switching element Q7 of bidirectionality is, specifically, realized by a switching circuit comprising two MOS FETs. The MOSFETs comprise diodes are connected in inverses direction each other. The MOSFETs comprises source terminals which are common to each other. Consequently, the MOSFETs are connected in series with each other whole the directionality is opposite.

The secondary winding N2 of the transformer T1 is omitted in the figure. However, the secondary winding N2 is placed to cooperate with the capacitor C2 and the high pressure discharge lamp 8 to form a closed series circuit.

The detection voltage which is induced in the third winding N3 has a polarity which is inverted according to the polarity of the electrical charge of the capacitor C1. Therefore, the third winding N3 is connected with a voltage dividing circuit through a rectifier DB2 for full-wave rectification. The voltage dividing circuit comprises a resistor R1 and a resistor R2 which is connected in series with the resistor R1. Consequently, the pulse voltage detection circuit 1201 is configured to detect the peak value of the pulse voltage in the positive direction and in the negative direction.

Followings are explanation of the pulse voltage detection circuit of FIG. 3. The switching element Qs is provided for sampling-and-holding. The switching element Qs is configured to be turned on in synchronization with a timing of induction of the pulse voltage. Consequently, the voltage Vcs (which is equal to a voltage applied to the resistor R2) is applied to the capacitor Cs. As a result, the capacitor Cs holds the voltage Vcs. A comparator CP compares the voltage Vcs held by the capacitor Cs with the voltage Vref. When the voltage Vcs is higher than the Vref, the comparator CP outputs a "HIGH output". In contrast, when the voltage Vcs is lower than the voltage Vref, the comparator CP outputs a "LOW output". When the comparator CP outputs the HIGH output, a light emitting diode PC1-D of the photo coupler PC1 outputs an optical signal through the resistor Ro. Subsequently, an explanation of the starting voltage regulation circuit is made. A photo transistor PC1-Tr of the photo coupler PC1 is turned on upon receiving the optical signal. Then, the both terminals of a gate capacitor Cg of a triac Q8 is closed. Consequently, the triac Q8 is turned off. Therefore, the impedance 2201 is realized by a series circuit comprising a resistor R5 and a resistor R6 which is in series with the resistor R5. As a result, the capacitor C1 is charged by the charging power source 2101 at a slow speed. In contrast, when the photo transistor PC1-Tr of the photo coupler PC1 has off-state, the gate power source Vg charges the gate capacitor Cg. Consequently, the triac Q8 is turned on. As a result, both terminals of the resistor R6 is closed. Therefore, the impedance 2201 is realized by only the resistor R5. As a consequent, the capacitor C1 is charged by the charging power source 2101 at a high speed.

In this manner, the charging power source 2101 starts charging the capacitor C1 immediately after the inversion of the polarity of the output of the inverter 6001. When the charge start detection circuit 2301 detects the start of the charge of the capacitor C1, the charge start detection circuit 2301 outputs the charge start signal. The timer circuit 2401 is configured to receive the charge start signal to start measuring the timing. When the timer circuit 2401 detects a predetermined time passage from the reception of the charge start signal, the timer circuit 2401 outputs the charge completion signal to the controller 9. The controller receives the charge completion signal to turn on the switching element Q7. It should be noted that the charge start detection circuit in this modification is configured to detect the timing of the start of the charging of the capacitor C1 by the detection of the inversion of the output of the inverter 6001.

The inverter 6001 comprises the full bridge circuit which is composed of the switching elements Q3 to Q6 shown in FIG. 2. The inverter 6001 is controlled by an output of the low frequency oscillation circuit 6011 to turn on and turn off "the first pair of the switching elements Q3 and Q6" and "the second pair of the switching elements Q4 and Q5" alternately. The charge start detection circuit 2301 is configured to detect an operation signal of the switching elements Q3 and Q6. The charge start detection circuit 2301 is configured to detect "the timing of the inversion from High output to Low output" or "the timing of the inversion from Low output to High output" as a timing of the start of the charging of the capacitor C1 to output the charge start signal. The timer circuit 2401 is configured to receive the charge start signal to start measuring the time passage. The timer circuit 2401 is configured to measure the predetermined period of time for charging the capacitor in such a manner that the secondary winding N2 induces the pulse voltage. Subsequently, the timer circuit outputs the on-signal after an elapse of a certain time. However, the impedance 2201 of the charging path of the capacitor C1 is variable. Therefore, even if a period of time for charging the capacitor C1 is constant, the charging voltage of the capacitor at a moment when the pulse voltage is induced is varied according to the impedance 2201. This is because an impedance value of the impedance 2201 is variable. Therefore, the amount of the charge of the capacitor C1 at the moment when the pulse voltage is induced is varied according to the impedance.

Figure 4:
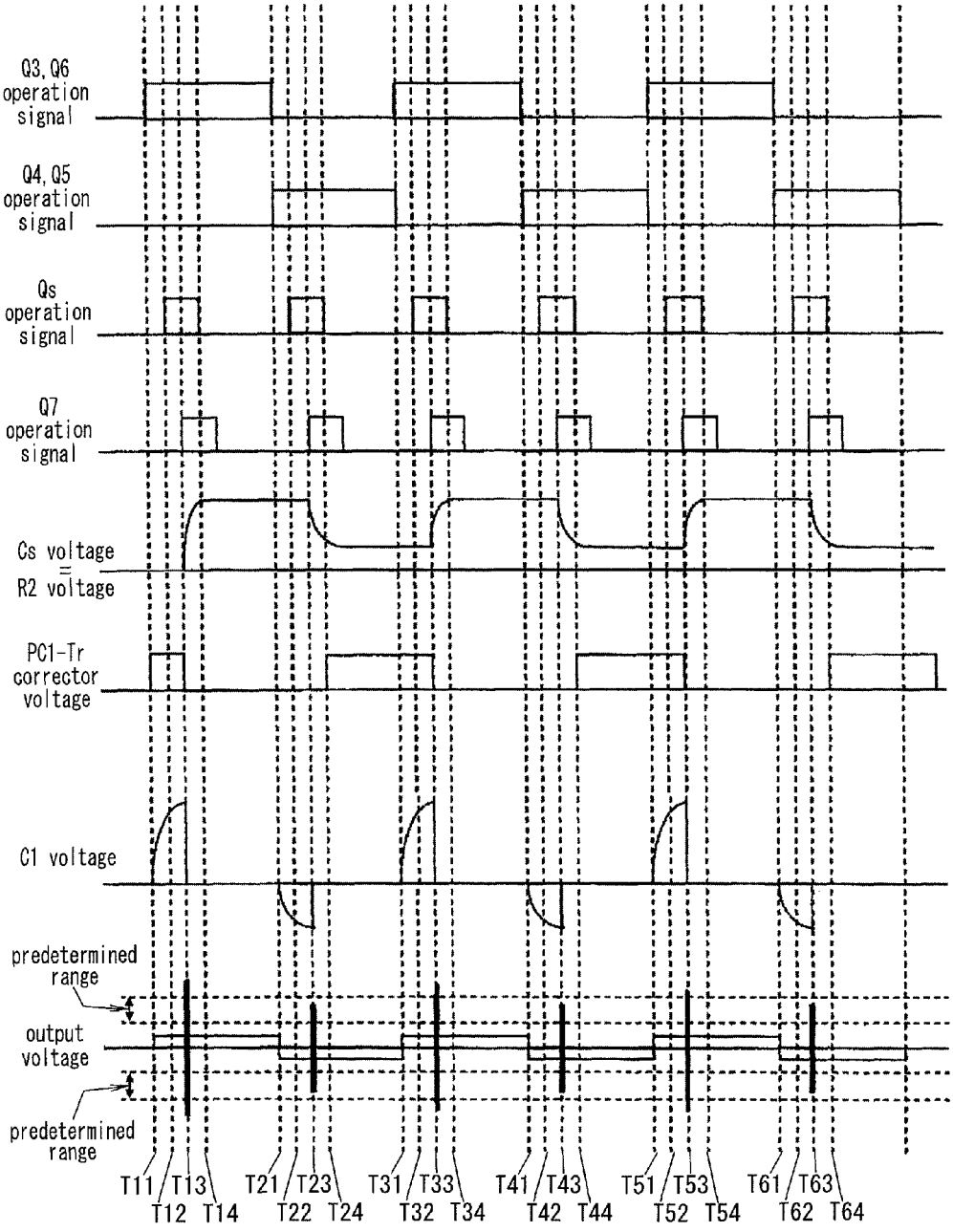
FIG. 4 is a waveform showing an operation of the first modification of the first embodiment.

FIG. 4 shows an operation waveform diagram of this embodiment. In FIG. 4, a "Q3 Q6 operation signal" is an on-signal for turning on the switching elements Q3 and Q6. A "Q4 Q5 operation signal" is an on-signal for tuning on the switching elements Q4 and Q5. A "Qs operation signal" is an on-signal for turning on the switching element Qs. The timer circuit 2401 is configured to output the on-signal in such a manner that the switching element Qs is turned on at a timing in synchronization with a timing of generating the pulse voltage. Q7 operation signal is an on-signal for turning on the switching element Q7. The Q7 operation signal is output from the controller 9 according to the charge completion signal which is output from the timer circuit 2401 after a delay of the certain period of time from the timing of the inversion of the polarity. It should be noted that the Qs operation signal is issued by the low frequency oscillation circuit 6011 in FIG. 3. However, it is also possible to employ the timer circuit 2401 being configured to generate the Qs operation signal and to output the Qs operation signal. Consequently, it is possible to obtain the same effect. It is preferred that the Qs operation signal becomes on-state immediately before the Q7 operation signal becomes on-state. It is preferred that the Qs operation signal becomes off-state after the detection of the peak of the pulse voltage.

In the operation waveform of FIG. 4, the Cs voltage is equal to the voltage held by the capacitor Cs. That is, the Cs voltage shows a sampled-and-held voltage applied to the resistor R2 when the switching element Qs is turned on. PC1-Tr corrector voltage shows a voltage of the gate capacitor Cg of the triac Q8 for regulation of the impedance. C1 voltage shows a voltage of the capacitor C1. The output voltage shows a voltage applied to the high pressure discharge lamp 8 when the high pressure discharge lamp 8 has no load.

Hereinafter, the operation of the modification is explained with the operation waveform of FIG. 4.

The specific configuration of the charging power source 2101 of FIG. 3 is explained. A series circuit comprises an impedance 2201 and the capacitor C1 which is cooperative with the impedance 2201 to form the charging path. The inverter 6001 shown in FIG. 2 has "a first connection point between the switching element Q3 and the switching element Q4" and "a second connection point between the switching element Q5 and the switching element Q6". The series circuit is connected between the first connection point and the second connection point through the switching circuit. The switching circuit is configured to be closed at a timing of generation of the pulse voltage after the inversion of the polarity. The series circuit acts as the charging power source 2101. However, the charging power source is not limited thereto.

When the switching elements Q3 and Q6 are turned on and the switching elements Q4 and Q5 are turned off, the charging power source 2101 flows the charging current to the capacitor C1 through the impedance 2201. Consequently, the voltage of the capacitor C1 is increased. The charge start detection circuit 2301 is configured to detect the timing of inversion of the polarity to output the charge start signal. The timer circuit 2401 receives the charge start signal, and output the charge completion signal after the elapse of the predetermined time. The controller 9 receives the charge completion signal to turn on the switching element Q7. Consequently, the capacitor C1 is discharged. When the capacitor C1 is discharged, the capacitor C1 applies the discharge current to the discharge circuit. When the discharge current is applied to the primary winding N1, the pulse voltage is induced in the secondary winding N2. The pulse voltage is applied to the high pressure discharge lamp. In addition, when the switching elements Q3 and Q6 are turned off and the switching elements Q4 and Q5 are turned on, the charging power source 2101 applies the charging current which flows in the inverse direction to the capacitor C1 through the impedance 2201. Consequently, the voltage of the capacitor C1 is increased in the negative direction. The charge start detection circuit 2301 detects the timing of the inversion of the polarity to output the charge start signal. The timer circuit 2401 receives the charge start signal to output the charge completion signal after the elapse of the predetermined time from when the timer circuit 2401 receives the charge start signal. The controller 9 receives the charge completion signal to turn on the switching element Q7. Consequently, the electrical charge accumulated in the capacitor C1 is discharged to the primary winding N1, whereby the pulse voltage is induced in the secondary winding N2. The pulse voltage which is induced in the secondary winding is superimposed on the lighting voltage which is output from the inverter 6001, whereby the starting voltage is produced. The starting voltage is applied to the high pressure discharge lamp 8 through the capacitor C2.

The pulse voltage has a correlative relationship with respect to the voltage value of the capacitor C1 at the moment immediately before the discharge of the capacitor C1. In other words, the pulse voltage has a correlative relationship with respect to the amount of the charge in the capacitor C1 at the moment immediately before the capacitor C1 is discharged. Therefore, it is possible to vary the pulse voltage by varying the voltage of the capacitor C1 at the moment when the switching element Q1 is turned on. The pulse voltage and the lighting voltage which is generated in the secondary winding N2 causes the electrical current to the secondary winding N2. When the electrical current is flown to the secondary winding N2, the detection voltage is induced in the third winding N3. The detection voltage is applied to the pulse voltage detection circuit through the voltage dividing circuit. The divided detection voltage is detected by the pulse voltage detection circuit. When the divided detection voltage is higher than a predetermined voltage value, the switching element Q1 is turned on such that the voltage of the capacitor C1 at a moment when the switching element Q1 is turned on is decreased. Consequently, the peak value of the pulse voltage is decreased. In contrast, the divided detection voltage is lower than the predetermined voltage value, the switching element Q1 is turned on such that the voltage of the capacitor C1 at a moment when the switching element Q1 is turned on is increased. Consequently, the peak value of the pulse voltage is decreased.

At a moment of T11, the plus terminal of the comparator CP holds 0V. In contrast, the minus terminal of the comparator CP holds Vref. Therefore, the comparator outputs the output voltage "Low". Consequently, the light emitting diode PC1-D of a primary side of the photo coupler PC1 has off state. Similarly, the photo transistor PC1-Tr of the secondary side of the photo coupler PC1 has off state. The electrical charge held in the gate capacitor Cg which is charged by the gate power source Vg of the triac Q8 is not eliminated. Therefore, the triac Q8 has on state. In this case, the charging power source 2101 applies the current to the capacitor C1 through the resistor R5 of the impedance 2201, thereby storing the electrical charge to the capacitor C1. Subsequently, at a moment of T13, the switching element Q7 is turned on. At the moment when the switching element Q7 is turned on, the electrical charge which is stored in the capacitor C1 is rapidly applied to the primary winding N1 of the transformer T1 through the switching element Q7. The voltage which is determined by the gradient di/dt of the current and the gradient LN1×di/dt which is determined by the inductance value LN1 of the primary winding N1 is stepped up at a turn ratio of the transformer T1 to the voltage which is induced in the secondary winding N2. The voltage induced in the secondary winding N2 causes the insulation breakdown of the high pressure discharge lamp 8.

The detection voltage which is induced in the third winding N3 is applied to the voltage dividing circuit which is composed of the rectifier DB2, the resistor R1, and the resistor R2. Subsequently, the low frequency oscillation circuit 6011 turns on the switching element Qs for sampling-and-holding at a moment of T12. Consequently, the resistor R2 is connected in parallel with the resistor Cs. Therefore, the voltage applied to the resistor R2 is also applied to the capacitor Cs. Subsequently, the low frequency oscillation circuit 6011 turns off the switching element Qs at a time T14. Consequently, the voltage of the capacitor Cs is kept. When the voltage Vcs of the capacitor Cs is higher than the voltage Vref, (1) the comparator outputs "High output", (2) the light emitting diode PC1-D of the photo coupler PC1 is turned on, (3) the photo resistor PC1-Tr of the secondary side of the photo coupler PC1 is turned on, and (4) the triac Q8 is turned off. Therefore, the capacitor C1 is charged by the charging power source through the series resistor which comprises the resistor R5 and the resistor R6 which is connected in series with the resistor R5. Therefore, the time constant of the charging circuit which is composed of the capacitor C1 and the impedance 2201 is increased. As a result, the voltage of the capacitor C1 at a moment when the switching element Q7 is turned on is decreased. That is, the amount of the charge in the capacitor C1 at the moment when the switching element Q7 is turned on is decreased. Therefore, when the switching element Q7 is turned on at a moment T23, the high pressure pulse voltage which is induced in the secondary winding N2 becomes lower than the voltage which is induced at the moment of T13.

When the voltage Vcs of the capacitor Cs becomes lower than the reference voltage Vref at a moment of T24, (1) the comparator CP outputs the "Low output", (2) the light emitting diode PC1 of the primary side of the photo coupler PC1 has off state, (3) the photo transistor PC1-Tr of the secondary side of the photo coupler PC1 has off state, and (4) triac Q8 is turned on. Therefore, the capacitor C1 is charged by the charging power source through the resistor R5. Therefore, the time constant of the charging circuit which comprises a capacitor C1 and the impedance 2201 is decreased. Consequently, the charging voltage of the capacitor C1 at the moment when the capacitor C1 is discharged is increased. In this manner, to vary the impedance 2201 of the charging path which leads to the capacitor C1 makes the regulation of the pulse voltage which is induced in the secondary winding N2. To regulate the pulse voltage which is induced in the secondary winding N2 makes the control of the starting voltage applied to the high pressure discharge lamp within a predetermined range.

Figure 5:
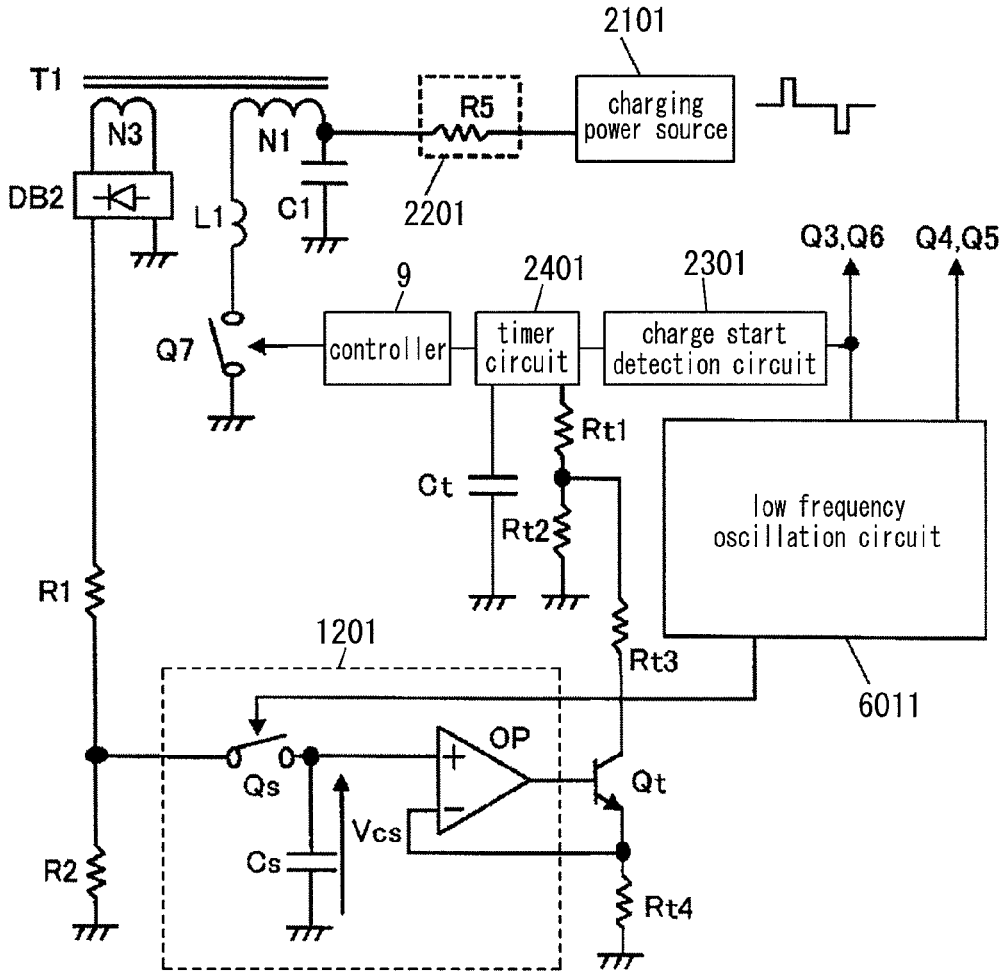
FIG. 5 shows the main components of the second modification of the first embodiment.

FIG. 5 shows main components of the second modification of the first embodiment. The circuit components of the main components are in common with the components in FIG. 1. In this modification, the time constant of the electrical charge of the capacitor C1 is constant. The peak value of the pulse voltage is regulated by variation of the timing of turning on the switching element Q7. It should be noted that the start operation voltage detection circuit 2401 in this modification comprises a charge start detection circuit 2401 and the timer circuit 2301.

The charging power source 2101 is, similar to the first modification of the first embodiment, configured to charge the capacitor C1 in the positive direction and in the negative direction by using the power source having positive and negative polarities which is inverted in synchronization with the inversion of the inverter 6001. The charge of the capacitor C1 is started immediately after the inversion of the polarity of the output of the inverter 6001. The charge of the capacitor is stopped from when the switching element Q7 is turned on to when the polarity is inverted next time.

In this modification, the impedance 2201 is composed of the resistor R5. Therefore, the time constant of the charging circuit comprising the capacitor C1 and the impedance 2201 is constant. The charging power source 2101 starts storing the charge to the capacitor C1 through the impedance 2201. The capacitor C1 is charged at a speed which is determined on the basis of the time constant of the resistor R5 and the capacitor C1.

As mentioned above, the pulse voltage has a correlative relationship with respect to the voltage which is held in the capacitor C1. Therefore, the peak value of the pulse voltage is varied according to the voltage of the capacitor C1 at the moment when the switching element Q7 is turned on. When the pulse voltage is induced in the secondary winding N2, the electrical current is applied to the secondary winding N2. The electrical current applied to the secondary winding N2 induces the detection voltage in the third winding N3. The detection voltage is applied to the pulse voltage detection circuit 1201 through the voltage dividing circuit, thereby being detected by the pulse voltage detection circuit 1201. The pulse voltage detection circuit 1201 outputs the detection signal on the basis of the detected voltage. "The detection signal" and "the charge start detection signal which is sent from the charge start detection circuit 2401" makes the timer circuit 2301 to turn on the switching element arbitrarily. When the detection voltage is higher than the predetermined value, the switching element Q7 is turned on at a moment when the voltage of the capacitor C1 is low. Consequently, the peak voltage of the high pressure pulse voltage is decreased. In contrast, when the detected voltage is lower than the predetermined value, the switching element Q7 is turned on at the moment when the voltage of the capacitor C1 is high. As a result, the peak value of the high pressure pulse voltage is increased.

Hereinafter, the specific configurations are explained. The operation of detection of the voltage Vcs of the capacitor Cs on the basis of the peak value of the high pressure pulse voltage from the detection value of the third winding N3 is same as the operation of the first modification of the first embodiment. In this embodiment, the operational amplifier OP is employed instead of the comparator CP. The operational amplifier OP is cooperative with the transistor Qt to form a buffer circuit. The operational amplifier has an extremely high amplification ratio. Therefore, the voltage of the plus terminal of the operational amplifier OP becomes equal to the voltage of the minus terminal of the operational amplifier OP. Therefore, the output voltage of the operational amplifier OP is equal to a voltage value which is a sum of the voltage Vcs and the voltage VBE. The voltage Vcs is equal to voltage held in the capacitor Cs. The voltage VBE is equal to the voltage between the base and the emitter of the transistor Qt. The voltage VBE is equal to the voltage between the base and the emitter of the transistor Qt. That is, the operational amplifier OP is cooperative with the transistor Qt to form a buffer amplifier. The buffer amplifier has an amplification ratio of "1". The buffer amplifier is configured to apply voltage Vcs of the capacitor Cs for sample-and-hold by correction of the low impedance. Therefore, the electrical current which is applied to the resistor Rt4 is equal to the quotient of the voltage Vcs of the capacitor Cs divided by the resistor Rt4. In addition, the corrector current of the transistor Qt which is equal to the electrical current approximately equal to the current which is a quotient of the voltage Vcs of the capacitor Cs divided by the resistor Rt4 is applied to the resistor Rt3. The series circuit which comprises the resistor Rt3, the transistor Qt, and the resistor Rt4 is connected in parallel with the resistor Rt2. The series circuit which comprises the resistor Rt3, the transistor Qt, and the resistor Rt4 is cooperative with the resistor Rt1 to determine the time constant for charging the capacitor Ct of the timer circuit 23.

Figure 6:
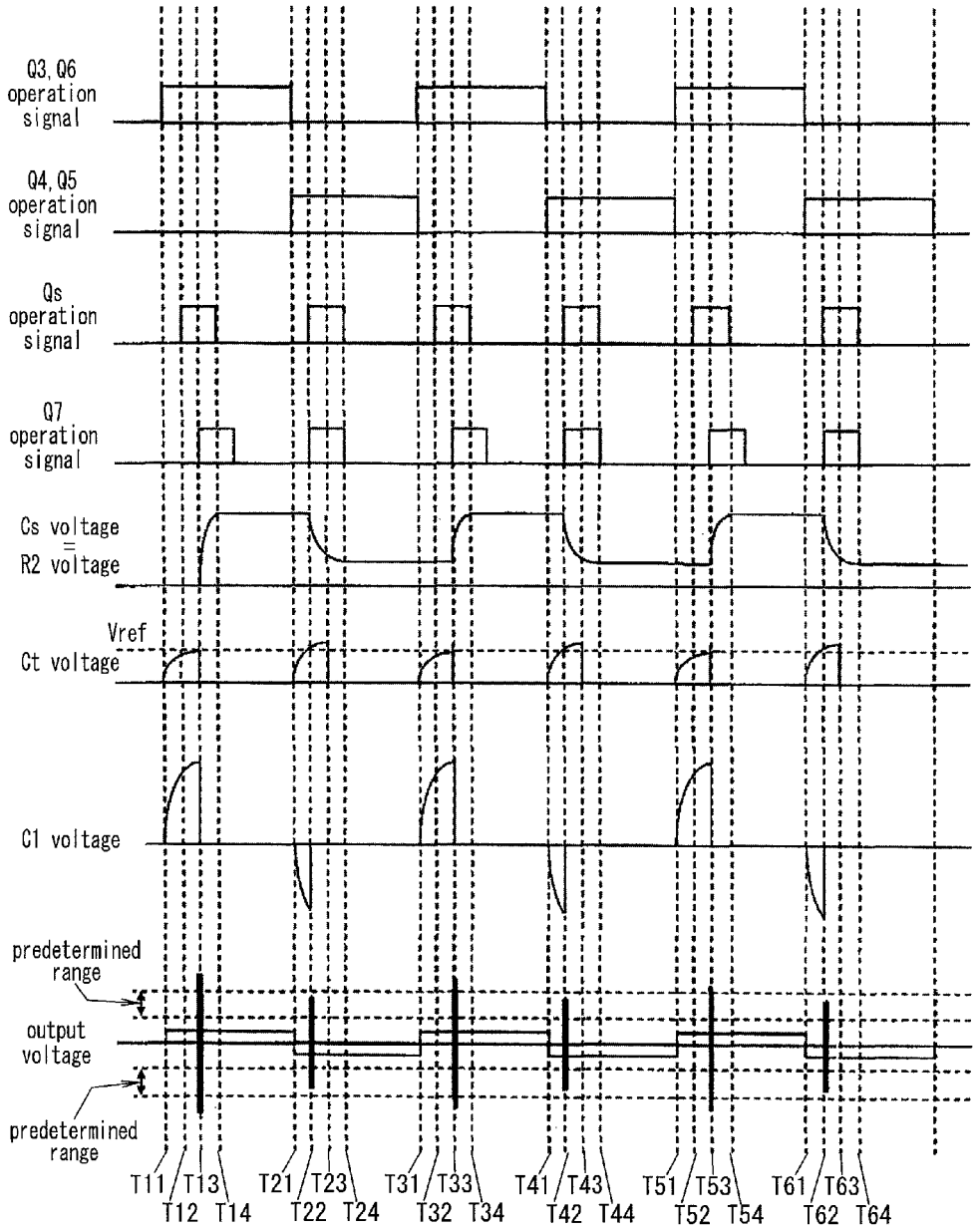
FIG. 6 shows a waveform showing an operation of the second modification of the first embodiment.

FIG. 6 shows an operation waveform of the modification. Compared with FIG. 4, it is different from FIG. 4 in the operation signal of the switching element Q7 is turned on when the voltage of the capacitor Ct reaches the voltage Vref, whereby the voltage in the capacitor C1 is discharged. Therefore, in this modification, the operation signal which determines the timing of turning on is varied according to the voltage of the capacitor Cs.

The timer circuit 2301 is realized by a general-proposed IC for timer. The timer circuit 2301 is configured to apply current which is equal to current which flows through the resistor Rt1 from the internal power source to the capacitor Ct. It should be noted that "the current which has a proportional relationship with respect to the current which is equal to the current which flows through the resistor Rt1" may use instead of "the current which is equal to the current which flows through the resistor Rt1". When the voltage held by in the capacitor Ct reaches the predetermined voltage Vref, the timer circuit outputs 2301 outputs the on signal to the switching element Q7. As the pulse voltage becomes higher, the detection voltage in the third winding N3 also becomes higher. As a result, the voltage Vcs of the capacitor Cs becomes high. The operational amplifier OP operates such that the positive side input voltage becomes equal to the negative side input voltage. Therefore, as the voltage Vcs of the capacitor Cs is increased, the voltage applied to the resistor Rt4 is also increased. As a result, the electrical current which flows through the resistor Rt3, the transistor Qt, and the resistor Rt4 is also increased. Consequently, the electrical current which flows to the capacitor Ct is increased. As a result, a period of time for requiring the voltage of the capacitor Ct to reach the predetermined voltage Vref becomes short. Therefore, the switching element Q7 is turned on by the controller 9 at the moment when the voltage of the capacitor C1 is low. In contrast, when the pulse voltage is decreased, the voltage applied to the resistor Rt4 is also decreased. As a result, the charging current of the capacitor Ct is decreased, whereby the timing for turning on the switching element Q7 is delayed. As a result, the circuit is operated so as to increase the pulse voltage. With this configuration, it is possible to regulate the pulse voltage within a predetermined range.

In the circuit of FIG. 5, the Qs operation signal is generated by the low frequency oscillation circuit 6011. However, in this modification, the timing for generating the pulse is variable. Therefore, it is possible to employ the timer circuit 2401 being configured to output the Qs operation signal. It is preferred that the Qs operation signal becomes on state immediately before the Q7 operation signal becomes on state. Furthermore, it is also preferred that the Qs operation signal becomes off state immediately after the detection of the peak of the pulse voltage.

Figure 7:
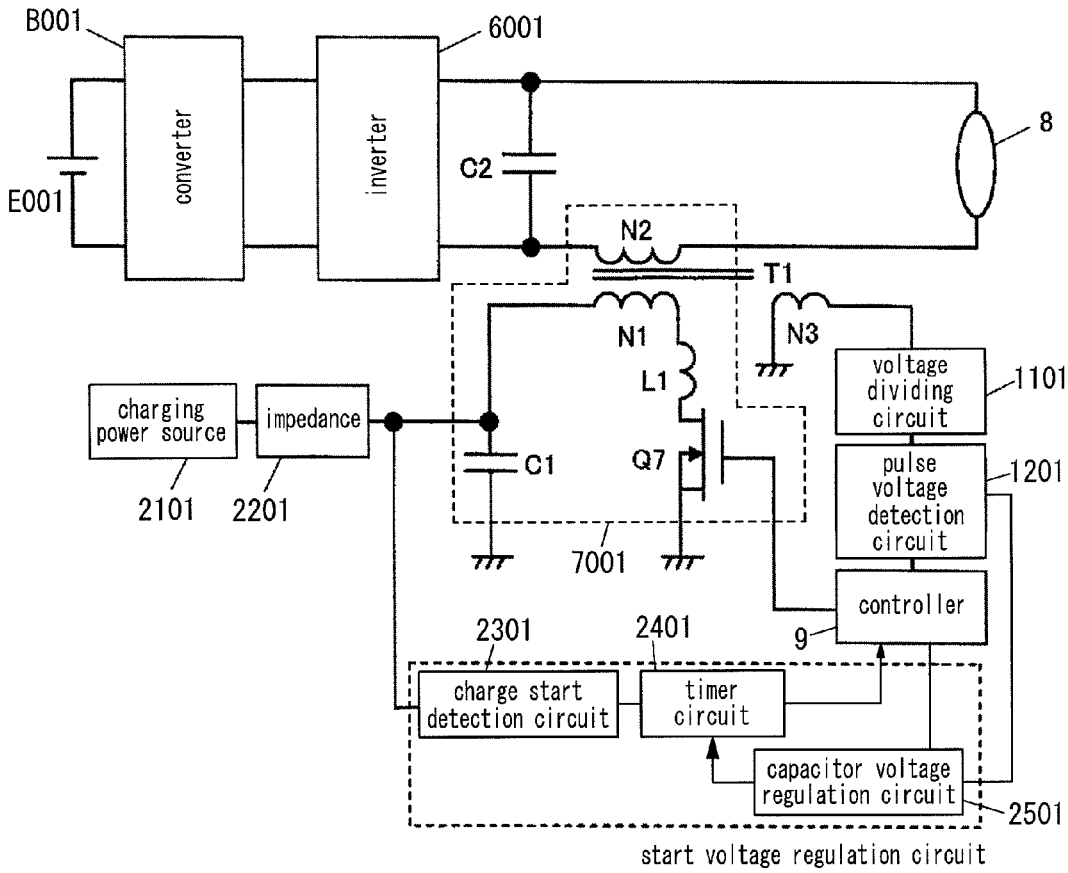
FIG. 7 shows a circuit diagram showing a third modification of the first embodiment.

FIG. 7 shows a circuit diagram of the third modification of the first embodiment. The circuit components of this modification are approximately same as the circuit components in FIG. 1 of the first embodiment. However, it is different from FIG. 1 in the timer circuit 2401. Specifically, in FIG. 1 of the first embodiment, the impedance 2201 is varied. However, in this modification, the time passage of the timer circuit 2401 is varied.

Figure 8:
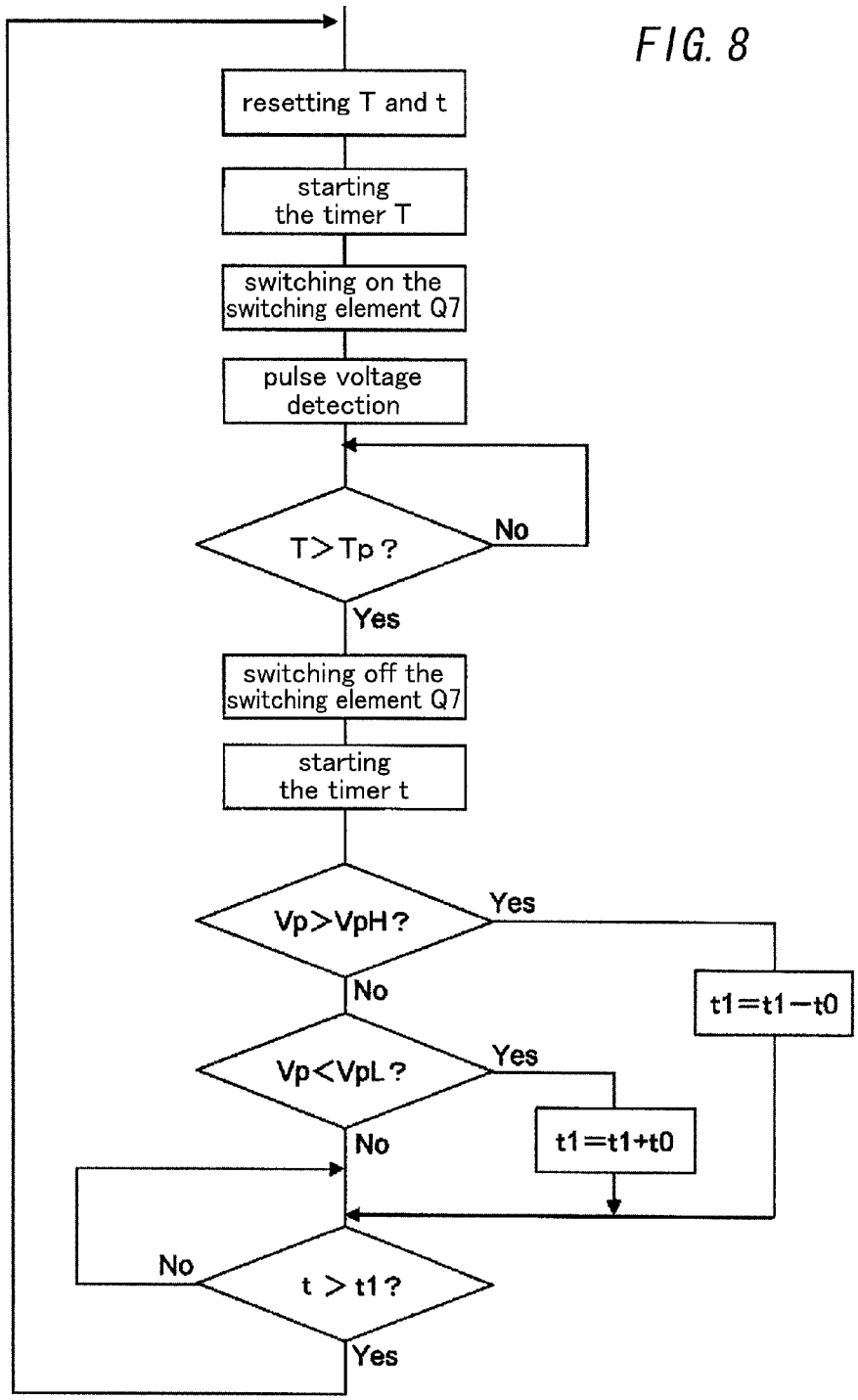
FIG. 8 shows a flow charge showing an operation of the third modification of the first embodiment.

FIG. 8 shows a flow chart for explaining the operation of the high pressure discharge lamp lighting device. The timer T comprises a microcomputer. The timer T measures the time passage Tp from when the switching element Q7 is turned on to when the switching element Q7 is turned off. The timer t comprises a microcomputer. The timer t measures the period t1 from when the capacitor C1 is started to be charged to when the switching element Q7 is turned on. Therefore, the timer T compares a predetermined period Tp with the period which is measured by the timer T. Similarly, the timer t compares a predetermined period t1 with the period which is measured by the timer t. When T is greater than Tp, the switching element Q7 is turned off. When t is greater than t1, the switching element Q7 is turned on.

First, the timer T and the timer t are reset, whereby T and t become zero. Then, the timer T start measuring the time passage, and turn on the switching element Q7, whereby the pulse voltage Vp is detected. Subsequently, the timer T judges whether a predetermined period of time Tp is passed or not. The timer T waits the time passage of the predetermined period of time Tp. The switching element Q7 is turned off after the elapse of the predetermined period of time Tp. Subsequently, the timer t start measuring the time passage. When the switching element Q7 is turned off, the charge to the capacitor C1 is started. Therefore, the timer t corresponds to the timer circuit 2401 which is configured to measure the period of time from the start of the charging of the capacitor C1.

Next, the voltage value of the pulse voltage Vp is judged whether the voltage value of the pulse voltage Vp is within the range between an upper limit value VpH of the predetermined range and a lower limit value VpL of the predetermined range or not. When the voltage Vp is greater than the voltage VpH, the charging period of time t1 is redefined. The redefined period of time t1 is capable of being obtained by subtracting a predetermined value t0 from a charging period of time t1. In contrast, when the voltage Vp is smaller than the voltage VpL, the charging period of time t1 is also redefined. The redefined charging period of time t1 is capable of being obtained by the predetermined value t0 to a charging period of time t1. Subsequently, the timer t judges whether the time passage exceeds the period of time t1 or not, and wait until the time passage exceeds the period of time t1. When t becomes greater than t1, the switching element Q7 is turned on, whereby the high pressure pulse voltage is generated. This operation is performed repeatedly.

With this configuration, when the pulse voltage Vp becomes greater than the upper limit VpH of the predetermined range, the charging period t1 of the capacitor C1 from when the switching element Q7 is turned on is decreased. As a result, the switching element Q7 is turned on at a moment when the capacitor C1 holds the low voltage. Therefore, it is possible to decrease the pulse voltage Vp. In contrast, when the pulse voltage Vp is lower than the lower limit value VpL, the period of time t1 for charing the capacitor C1 until the switching element Q7 is turned on is increased. As a result, the switching element Q7 is turned on under a condition where the high voltage is charged to the capacitor C1. Therefore, it is possible to increase the pulse voltage Vp.

Figure 50:
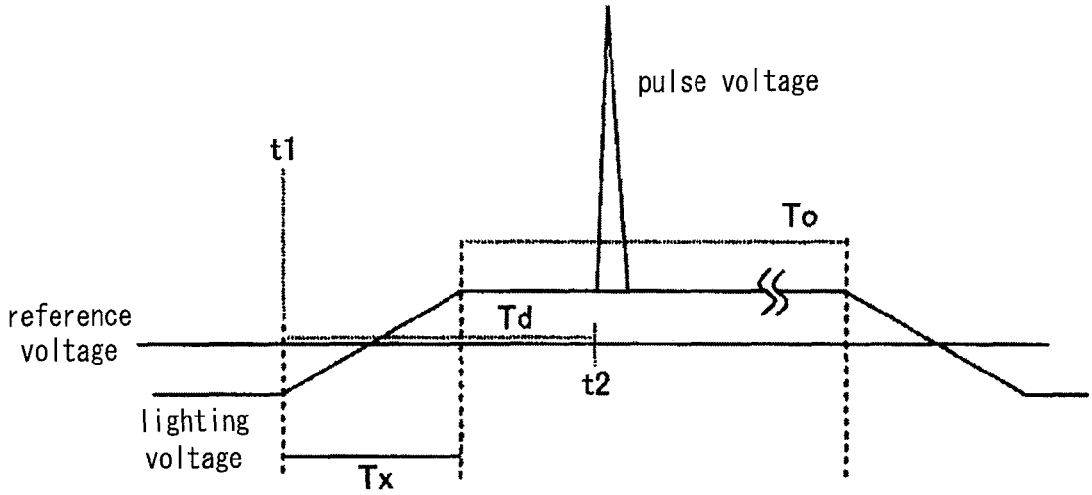
FIG. 50 shows a waveform showing a pulse voltage which is delayed a predetermined period of time from a moment when the lighting voltage is inverted.

It should be noted that the detection voltage which is induced in the third winding N3 has a correlative relationship with respect to the starting voltage which includes the pulse voltage which is superimposed on the lighting voltage. As shown in FIG. 50, the lighting voltage which is output from the inverter 6001 has a period Tx. In the period Tx, the waveform fails to follow the timing of inversion of the inversion signal which is output from the output control circuit 4001 to the switching elements Q3 to Q6. In addition, there is a case where the voltage value of the lighting voltage is overshot when the polarity is inverted. Therefore, it is preferred to employ the controller 9 being configured to turn on the switching element Q7 after a predetermined period of time Td from the moment t1 when the polarity is inverted. In this case, the output control circuit 4001 is configured to output the polarity inversion signal to the controller 9. The controller 9 is configured to turn on the switching element Q7 after a predetermined period of time Td from when the controller receives the charge completion signal and the polarity inversion signal. In this case, the controller 9 comprises a detection circuit and a delay circuit. The detection circuit is configured to detect the timing of the inversion of the polarity on the basis of the polarity inversion signal to output the signal. The delay circuit is configured to receive the signal to delay the controller 9 by a predetermined period of time from when the delay circuit receives the signal such that the controller 9 turns on the switching element Q7 at the time t2. Consequently, the controller is configured to output the pulse voltage in the period To when the lighting voltage has the constant voltage.

(Second Embodiment)

Figure 9:
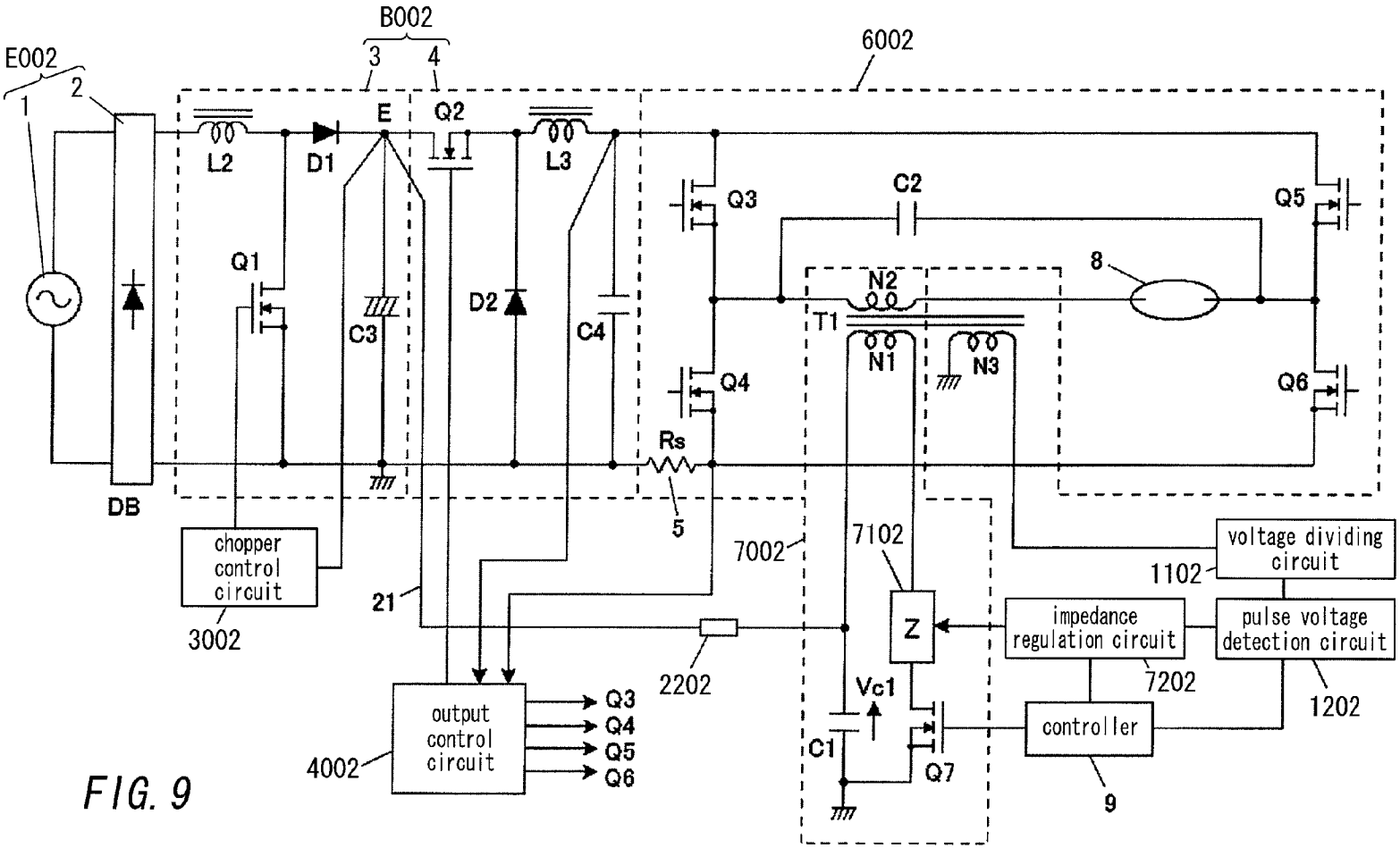
FIG. 9 shows entire configurations of a circuit diagram of the second embodiment.

FIG. 9 shows entire configurations of the second embodiment in this invention. Hereinafter the circuit components of the second embodiment are explained. The rectification circuit 2 is realized by the diode bridge DB. The diode bridge is configured to full-wave rectifies the commercial alternating power source 1 to output the pulsating voltage. The output of the diode bridge DB is connected with a series circuit which comprises an inductor L2 and the switching element Q1 which is in series with the inductor L2. The smoothing capacitor C3 is connected across the switching element Q1 through the diode D1. The inductor L2 is cooperative with the switching element Q1, the diode D1, and the smoothing capacitor C3 to form the step up chopper 3. The switching element Q1 is configured to be turned on and be turned off by the chopper control circuit 3002. The chopper control circuit 3002 is easily realized by the commercially available integrated circuit. The switching element Q1 is turned on and turned off at frequency which is higher than a frequency of the commercial alternating power source 1. Consequently, the output voltage which is output from the diode bridge DB is stepped up to the direct current voltage having a specified value. The smoothing capacitor C3 is charged by the direct current voltage.

The direct current power source E002 in this embodiment is a direct current voltage source which outputs the direct current voltage made from the output voltage which is output from the commercial alternating current power source and which is rectified and smoothed by the smoothing capacitor C3. Therefore, the direct current power source E001 is realized by a step up chopper 3 which is connected to the diode bridge DB.

The step up chopper 3 is connected with the step down chopper 4. The step down chopper 4 acts as the ballast for regulating "the voltage value of the direct current voltage which is output from the step up chopper 3" to a desired voltage value. In addition, the step down chopper 4 is controlled to output the variable output voltage such that the step down chopper 4 supplies the suitable electric power to the high pressure discharge lamp 8 from when the high pressure discharge lamp 8 is started to when the high pressure discharge lamp 8 is stably operated through an arc discharge period. It is noted that the step up chopper 3 is cooperative with a step down chopper 4 to form a converter B002.

The circuit components of the step down chopper 4 are explained as follows. The positive terminal of the smoothing capacitor C3 is connected to the positive terminal of the capacitor C4 through the switching element Q2 and the inductor L3. The negative terminal of the capacitor C4 is connected to the negative terminal of the smoothing capacitor C3. The negative terminal of the capacitor C4 is connected to an anode of the diode D2 for flowing the regenerative current. A cathode of the diode D2 is connected to a connection point between the switching element Q2 and the inductor L3.

The circuit operation of the step down chopper is explained. The switching element Q2 is turned on and turned off at a high frequency on the basis of the output control circuit 4002. When the switching element Q2 is turned on, the direct current power source E002 applies the electrical current to the switching element Q2, the inductor L3, and the capacitor C4. When the switching element Q2 is turned off, the regenerative current is applied to the inductor L3, the capacitor C4, and the diode D2. Consequently, the direct current voltage which is made from the stepped down direct current voltage of the direct current power source E002 charges the capacitor C4. The output control circuit 4002 is configured to vary the duty cycle of the switching element Q2. (The duty cycle means the rate of the on period to the one cycle.) Consequently, the voltage applied to the capacitor is varied.

The inverter 6002 is connected to the step down chopper 4. The inverter 6002 is configured to convert the direct current voltage which is output from the step down chopper 4 into the lighting voltage. The lighting voltage is a rectangular alternating wave. The inverter 6002 is configured to apply the lighting voltage to the high pressure discharge lamp. The inverter 6002 is realized by a full-bridge circuit which comprises the switching elements Q3 to Q6. The first pair of the switching elements Q3, Q6 and the second pair of the switching elements Q4, Q5 are turned on and turned off alternately at a low frequency by the control signal of the output control circuit 4002. Consequently, the output voltage of the step down chopper 4 is converted into the rectangular alternating voltage. The rectangular alternating voltage is applied to the high pressure discharge lamp 8. The high pressure discharge lamp 8 (which is a load) is realized by the high intensity high pressure discharge lamp (HID lamp) such as the metal halide lamp and the high pressure mercury lamp.

The igniter 7002 is operated when the high pressure discharge lamp 8 is started. The igniter 7002 is configured to generate the pulse voltage for starting the high pressure discharge lamp 8. The igniter 7002 is configured to superimpose the pulse voltage on the lighting voltage to apply the pulse voltage on the lighting voltage to the high pressure discharge lamp 8. The igniter 7002 comprises the capacitor C1, the transformer T1, the switching element Q7, and the impedance 7102. The capacitor C1 receives the predetermined voltage value Vc1 of the voltage through the impedance 22, thereby being charged by the predetermined voltage value Vc1. The switching element Q7 is configured to be turned on and turned off by the control signal which is sent from an outside. The impedance 7102 is provided for protecting the overcurrent of the switching element Q7. The impedance 7102 comprises a variable impedance. The transformer T1 comprises the primary winding N1, the secondary winding N2, and the third winding N3. The primary winding N1 is connected across the capacitor C1. The primary winding N1 is connected in series with the impedance 7102 and the switching element Q7. The secondary winding N2 is connected across the inverter 6002. The secondary winding N2 is connected in series with the high pressure discharge lamp. The secondary winding is configured to induce the pulse voltage by the voltage which is developed in the primary winding N1. The third winding N3 is configured to generate the detection voltage by the current which is developed in the primary winding N1 and the secondary winding N2. The impedance 2202 and the capacitor C1 forms the charging circuit for charging the capacitor C1. In addition, the capacitor C1 is cooperative with the primary winding N1, the impedance 7102, and the switching element Q7 to form the discharge circuit of the capacitor C1. The controller 9 is configured to turn on and turn off the switching element Q7. The controller 9 is configured to turn on the switching element Q7 to cause the discharge of the capacitor C1. As the capacitor C1 is discharged, the capacitor C1 applies the discharge current to the primary winding N1. The discharge current which is applied to the primary winding N1 induces the pulse voltage in the secondary winding N2. The pulse voltage which is induced in the secondary winding N2 is, as mentioned above, superimposed on the lighting voltage. As the pulse voltage and the lighting voltage is developed in the secondary winding N2, the detection voltage is induced in the third winding N3. The detection voltage has a correlative relationship with respect to the starting voltage. It should be noted that the capacitor C2 is a bypass capacitor for bypassing the high frequency voltage. The capacitor C2 is provided for preventing the pulse voltage which is developed in the transformer T1 from being applied to the inverter 6002. The capacitor C2 is cooperative with the secondary winding N2 of the transformer and the high pressure discharge lamp 8 to form a closed series circuit. When the pulse voltage is developed in the secondary winding N2 of the transformer T1, the pulse voltage is applied to the high pressure discharge lamp 8 through the capacitor C2.

Followings are the steps of starting the high pressure discharge lamp 8 from an unlighted condition to a lighted condition.

When the high pressure discharge lamp lighting device has a no load mode, the high pressure discharge lamp 8 has off condition. The igniter 7002 applies the pulse voltage to the high pressure discharge lamp 8 in order to break down the insulation between the electrodes of the high pressure discharge lamp 8.

Then, in the start operation mode, when the electric insulation of the high pressure discharge lamp is broken down by the pulse voltage, the arc discharge is caused subsequent to the glow discharge. After the arc discharge is started, the temperature in the discharge tube becomes uniform. In addition, the lamp voltage is gradually increased over several minutes from when the high pressure discharge lamp is started. Consequently, the voltage applied to the high pressure discharge lamp becomes the stability voltage from several volts to the stable volts.

Finally, in the stably lighting mode, after the lamp is lighted, the temperature of the discharge tube is raised to have a stable condition after the several minutes from when the discharge lamp lighting device is started. As a result, the voltage applied to the lamp becomes constant.

The detection voltage which is developed in the third winding is detected by the pulse voltage detection circuit 1202 through the voltage dividing circuit. The pulse voltage detection circuit 1202 is configured to output the detection signal on the basis of the voltage which is detected by the pulse voltage detection circuit 1202. The detection signal indicates the voltage level which corresponds to the voltage which is detected by the pulse voltage detection circuit 1201. The controller 9 calculates the corrective value of the pulse voltage which is developed next time on the basis of the detection signal. According to the corrective value, the impedance regulation circuit 7202 regulates the impedance value of the impedance 7102. As the impedance value of the impedance 7202 is varied, the impedance value of the discharge circuit is varied. Therefore, the discharge current which flows to the primary winding N1 is varied when the capacitor C1 is discharged again.

Figure 10:
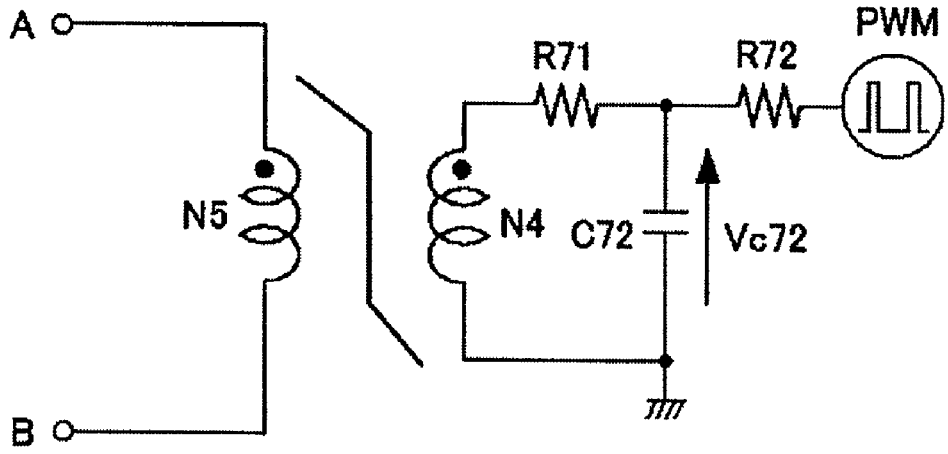
FIG. 10 shows main components of the circuit diagram of the second embodiment.

The impedance 7102 is, for example, realized by a saturable inductance element (saturable reactor) shown in FIG. 10. The impedance variation control circuit 72 is configured to output a PWM signal for varying the duty cycle according to the corrective value. Subsequently, an integration circuit R72 is cooperative with the integration capacitor C72 to produce the bias voltage Vc72. An electrical current which corresponds to the level of the bias voltage Vc72 flows to the control winding N4 from the integration capacitor C72 through the bias resistor R71. Consequently, the current level which leads the main winding N5 to saturate when the switching element Q7 has on state is varied.

The impedance regulation circuit 7202 corrects the impedance value of the impedance 7102. Then, the controller 9 sends the on signal to the switching element Q7 whereby, the switching element Q7 is turned on. Consequently, the capacitor C1 which is charged is discharged. When the capacitor C1 discharges, the discharge current is applied to the discharge circuit. Consequently, the discharge current is applied to the primary wining N1, whereby the regulated pulse voltage is induced in the secondary winding N2. Therefore, the impedance variation control circuit 72 acts as the stating voltage regulation circuit.

It should be noted that when the switching element Q7 of the discharge circuit is turned on, the charging voltage Vc1 of the capacitor C1 has approximately constant voltage. For example, the capacitor C1 is configured to be charged by the direct current power source 21 through the impedance 2202 such as a switching element or the resistor at an arbitrarily timing such that the capacitor C3 holds the voltage Vc3.

According to this embodiment, even if the output line is extended, it is possible to obtain the high pressure discharge lamp lighting device which is configured to output the high pressure pulse voltage having a certain peak value for necessary to start the high pressure discharge lamp at a low price and simple configurations.

In this embodiment, the voltage which is induced in the third winding N3 is detected as the detection voltage. However, it is possible to employ the pulse voltage detection circuit which is connected in parallel with the high pressure discharge lamp 8. Consequently, the pulse voltage detection circuit is configured to detect the starting voltage applied to the high pressure discharge lamp 8. In addition, it is also possible to employ the pulse voltage detection circuit which is connected in parallel with the primary winding N1. Consequently, the pulse voltage detection circuit is configured to detect the pulse voltage which is induced in the primary winding N1.

Figure 11:
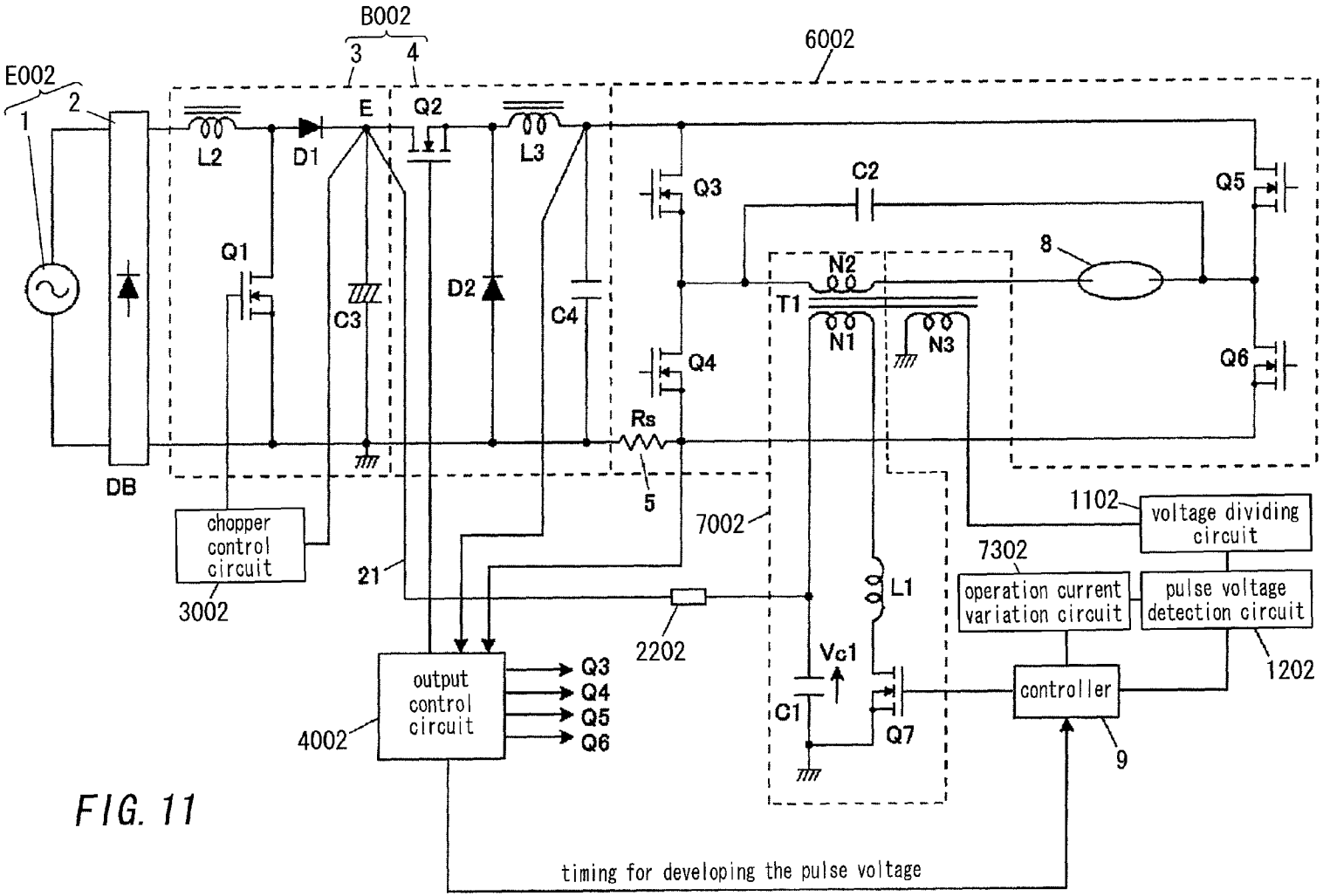
FIG. 11 shows entire configurations of the circuit diagram of a first modification of the second embodiment.

FIG. 11 shows a first modification of the second embodiment. This modification comprises an inductance L1 instead of the variable impedance element 7102 compared with the second embodiment. The inductance L1 is provided for prevention of the excess current. In addition, the second modification comprises the operation voltage variation circuit 7302 instead of the impedance variation control circuit 7202. The switching element Q7 has an internal impedance which is varied according to the applied voltage when the switching element Q7 is turned on. The operation voltage variation circuit 7302 is configured to vary the on resistance of the switching element Q7 on the basis of the corrective value of the pulse voltage. In other words, the operation voltage variation circuit 7302 is configured to regulate the voltage when the operation voltage variation circuit 7302 turns on the switching element Q7. Consequently, the internal impedance of the switching element Q7 is varied. Consequently, the impedance of the charging circuit is varied. That is, the operation voltage variation circuit 73 acts as the starting voltage regulation circuit.

The detection voltage which is induced in the third winding N3 is applied to the pulse voltage detection circuit 12 through the voltage dividing circuit 1102. The pulse voltage detection circuit 1202 is configured to output the detection signal indicative of the voltage level corresponding to the starting voltage on the basis of the divided detection voltage. The operation voltage variation circuit 7302 is configured to regulate the voltage level for operating the switching element Q7 on the basis of the detection signal.

Figure 12:
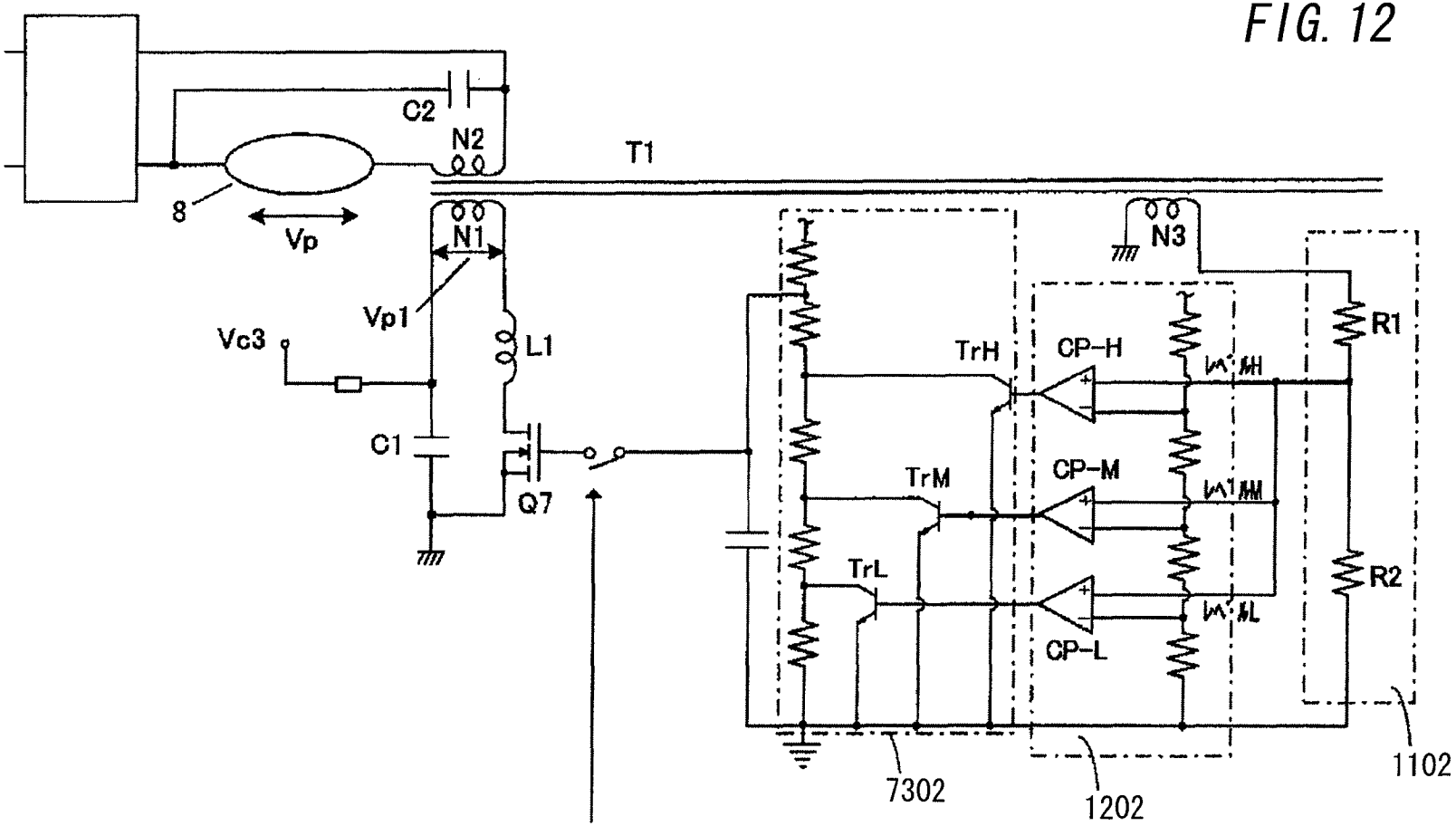
FIG. 12 shows a circuit diagram showing main components of the first modification of the second embodiment.
Figure 13:
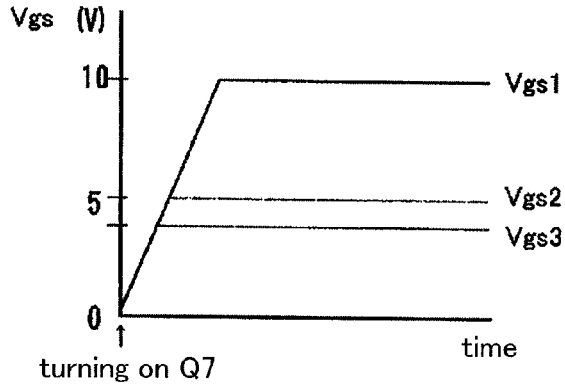
FIG. 13 shows a characteristic figure for explaining the operation of the first modification of the second embodiment.

As shown in FIG. 12, when the controller 9 receives the pulse output timing signal from the output control circuit 4002, the controller 9 turns on the switching element Q7. That is, the controller 9 applies the voltage having an operation voltage level which is determined by the operation voltage variation circuit 7302 to the switching element Q7 in order to turn on the switching element Q7.

The switching element Q7 is configured to be turned on at a timing after a predetermined period when the polarity is inverted. Consequently, it is possible achieve the sensitive feedback of the peak voltage level without disturbance noise caused by the hydraulic transient of the rectangular alternating wave. In addition, the switching element Q7 is turned on at a timing before the several hundred microseconds to the several milliseconds from the polarity inversion of the next time such that it is possible to supply electric power which is required for stabilizing the discharge condition of the high pressure discharge lamp when electrical insulation of the high pressure discharge lamp is broken by the pulse voltage.

FIG. 12 shows main components in this modification. The voltage dividing circuit 1102 divides the detection voltage which is detected in third winding N3 by the resistor R1 and the resistor R2. The divided voltage is applied to a pulse voltage detection circuit 1202. The pulse voltage detection circuit 1202 comprises a comparator CP-H, a comparator CP-M, and a comparator CP-L to have a plurality of reference levels. (In FIG. 12, the pulse voltage detection circuit 1202 has a reference level H, a reference level M, and a reference level L.) According to the comparative result of the comparators CP-H, CP-M, and CP-L, the voltage level for operating the switching element Q7 is corrected by the operation voltage variation circuit 7302.

When the pulse voltage is low, only the comparator CP-L corresponding to the level L is turned on. Therefore, the operation voltage level for turning on the switching element Q7 is increased. In contrast, when the pulse voltage is high, the comparator CP-H is also turned on. Therefore, the operation voltage level for turning on the switching element Q7 is decreased. In this manner, the operation voltage level of the switching element Q7 is controlled as the three stages of Vgs1, Vgs2, and Vgs3.

Figure 14:
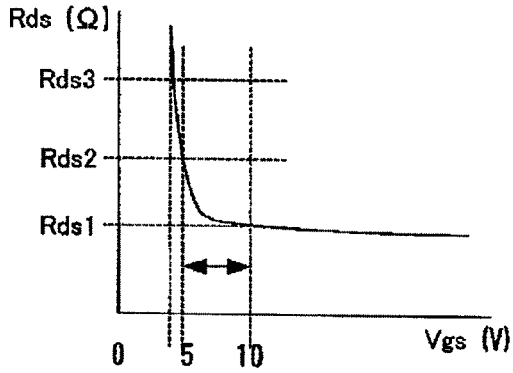
FIG. 14 shows a characteristic figure for explaining the operation of the first modification of the second embodiment.

When the operation voltage level for turning on the switching element Q7 is varied, as shown in FIG. 14, the on-resistance Rds between the drain and the source is varied with respect to the voltage Vgs between the gate and the source of the FET. Consequently, the impedance of the discharge circuit when the switching element Q7 is turned on is varied.

Figure 15:
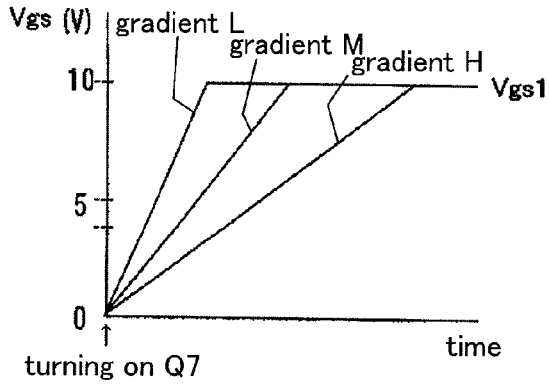
FIG. 15 shows a characteristic figure for explaining the operation of the first modification of the second embodiment.

In addition, as shown in FIG. 15, it is possible to achieve the same control by varying operation voltage of the switching element Q7 with time. (It is possible to achieve the same control by varying the gradient of the increase of the voltage.)

When the controller 9 sends the on-signal to the switching element Q7 to turn on the switching element Q7, the discharge circuit is formed. Consequently, the capacitor C1 is discharged. The discharge of the capacitor C1 applies the discharge current to the discharge circuit. When the discharge current is applied to the primary winding N1, the pulse voltage is induced in the secondary winding N2. In addition, when the discharge current is applied to the primary winding N1, the detection voltage is induced in the third winding N3.

According to this embodiment, it is possible to obtain the high pressure discharge lamp lighting device which is realized simple circuit with low cost, and which is configured to output a high pressure pulse voltage having a constant peak value when the high pressure discharge lamp is started even if the output wiring is extended.

Figure 16:
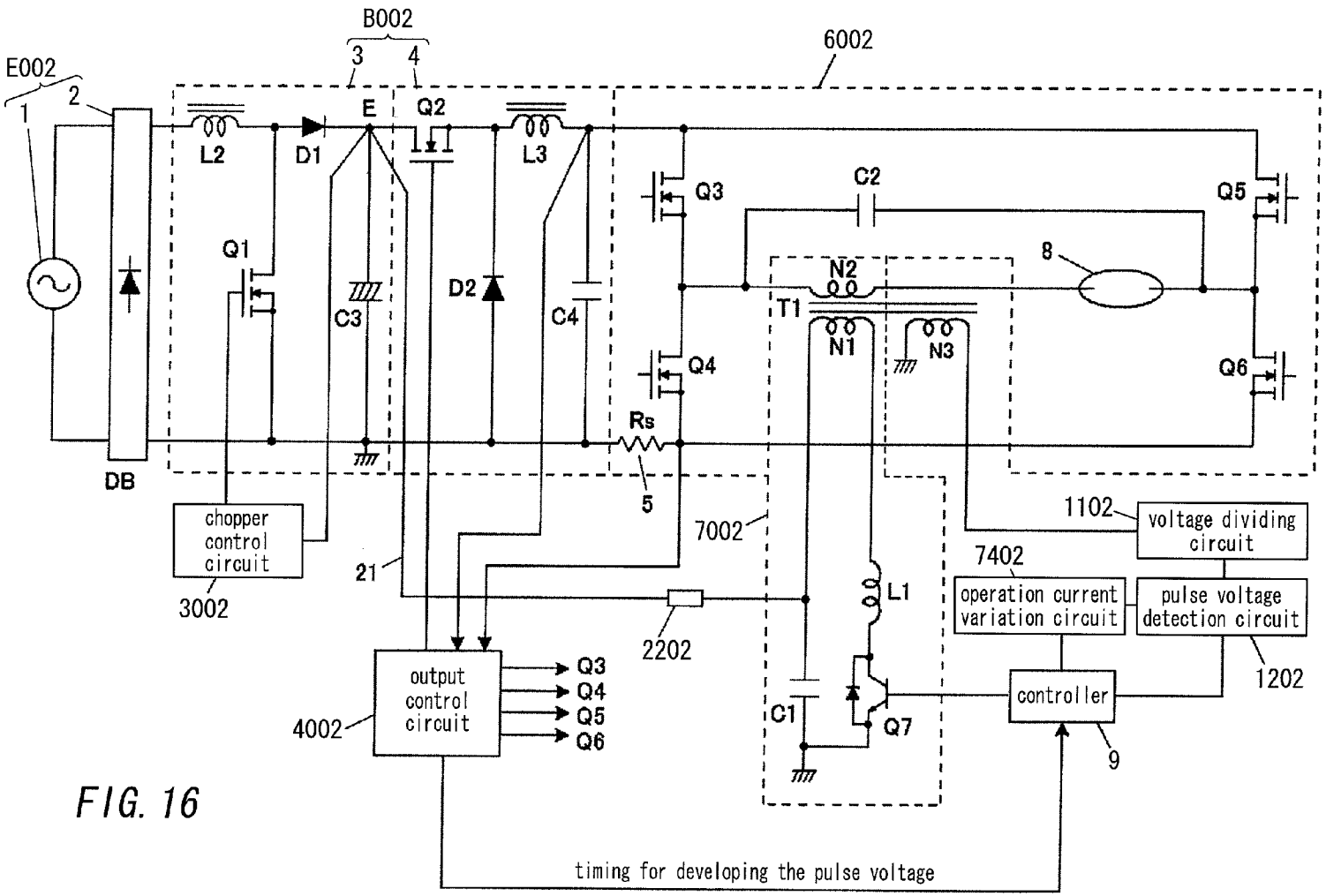
FIG. 16 shows a circuit diagram showing entire components of a second modification of the second embodiment.

FIG. 16 shows a circuit diagram of the second modification of the second embodiment. In this modification, the switching element Q7 is realized by a bipolar transistor instead of the MOSFET. In addition, an operation current variation circuit 74 is employed instead of the operation voltage variation circuit 73. Furthermore, a diode is placed between the corrector and the emitter of the bipolar transistor such that the diode flows the regenerative current from the emitter to the corrector.

The operation current variation circuit 7402 is configured to vary the amplitude or the gradient of the operation current (base current) of the bipolar transistor according to the corrective value of the pulse voltage.

Figure 17:
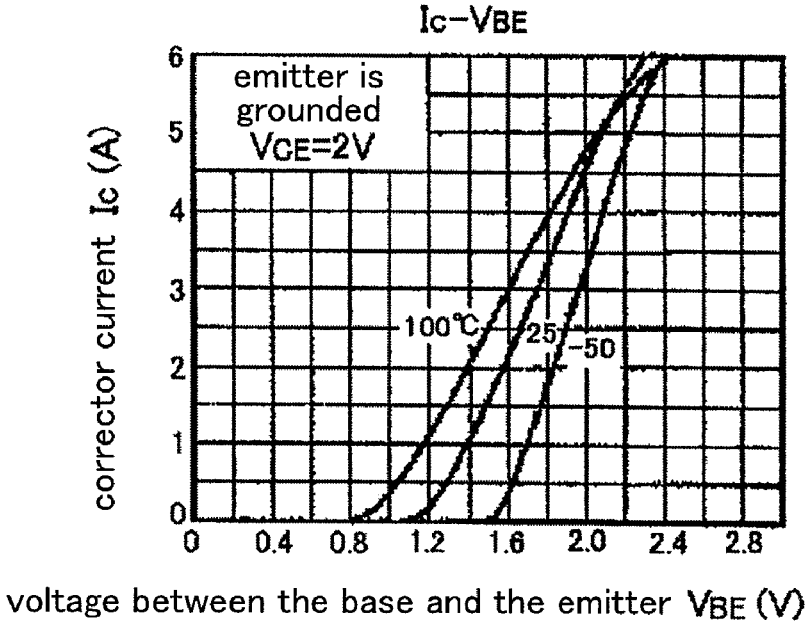
FIG. 17 shows a characteristic diagram for explaining the operation of the second modification of the second embodiment.

FIG. 17 shows a relationship between "the voltage VBE between the base and the emitter" and "the corrector current Ic of the corrector". As is obvious from the characteristics, in order to vary the corrector current Ic of the corrector, it is possible to vary the voltage Vbe between the base and the emitter according to the corrective value of the pulse voltage. Consequently, it is possible to vary the impedance component of the switching element Q7 in on-state. Components and operations other than the above is same as the components and the operations of the second embodiment.

Figure 18:
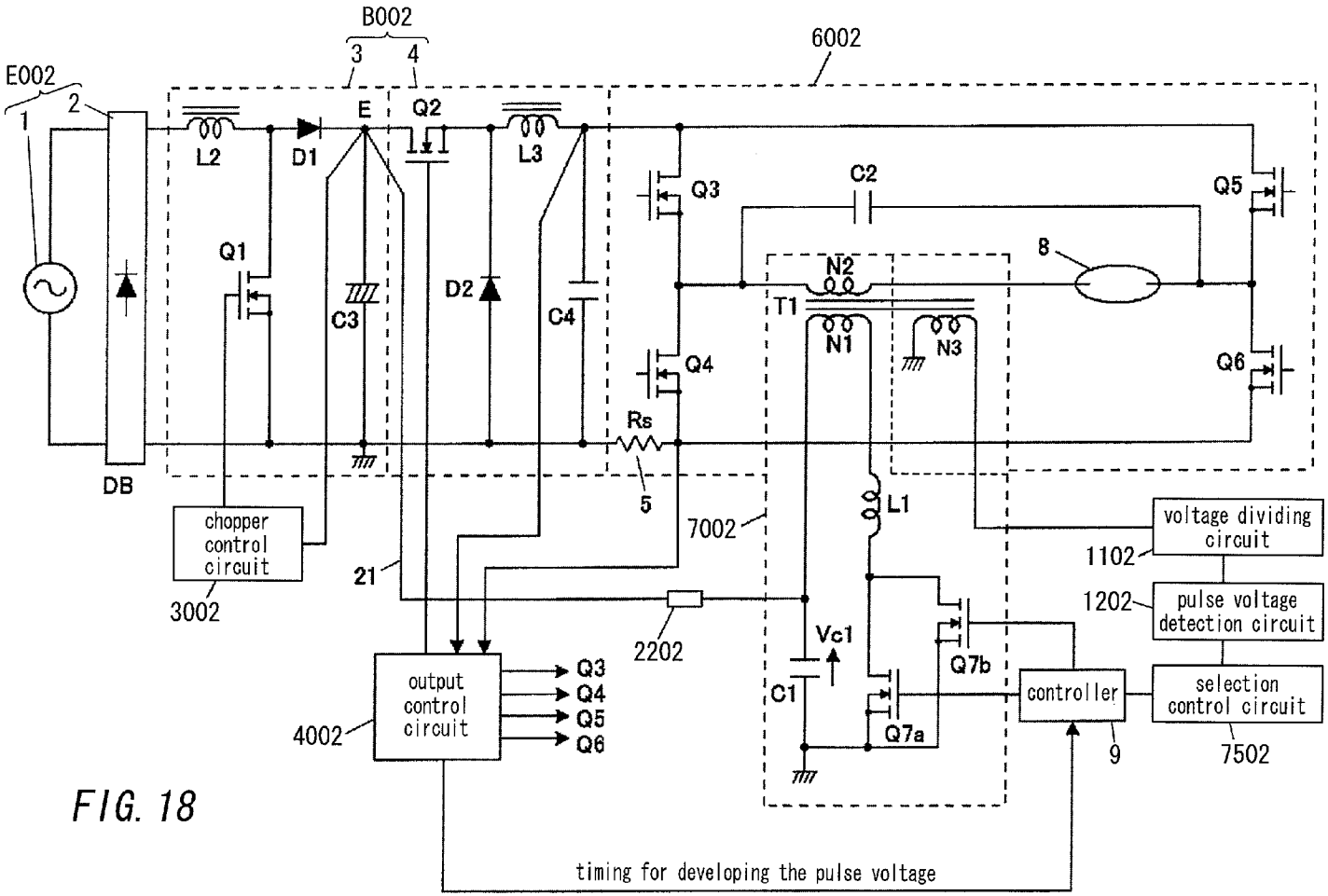
FIG. 18 shows a circuit diagram showing entire components of the third modification of the second embodiment.

FIG. 18 shows a circuit diagram of the third modification of the second embodiment. In this modification, two switching elements Q7*a* and Q7*b* are employed instead of the switching element Q7 of the second modification. The switching element Q7*a* in on-state has a resistance value which is different from a resistance value of the switching element Q7*b* in on-state. The switching element Q7*a* is connected in parallel with the switching element Q7*b*. In addition, the circuit further comprises the selection control circuit 7502 which is configured to determine the corrective value of the pulse voltage on the basis of the detection result of the voltage of the pulse voltage detection circuit. The selection control circuit 7502 is configured to output the selection signal to the controller 9 on the basis of the corrective value of the pulse voltage. The selection signal allows the controller to turn on the switching element Q7*a* or the switching element Q7*b* selectively. According to the selection signal, the controller is configured to turn on either one of the switching element Q7*a* or the switching element Q7*b* which is different in the resistance value in on-state from the switching element Q7*a*. Consequently, the impedance of the discharge current is varied. It should be noted that it is possible to employ the selection control circuit 7502 which is integral with the controller 9.

The difference between "the resistance values of the switching elements Q7*a* in on-state" and "the resistance value of the switching element Q7*b* in on-states" are determined on the basis of the corrective accuracy. In addition, it is possible to employ further switching elements to connect in parallel with the switching elements Q7*a* and Q7*b* as necessary. In addition, it is also possible to combine the above configuration with the variation control of the gate voltage explained in the second embodiment.

Figure 19:
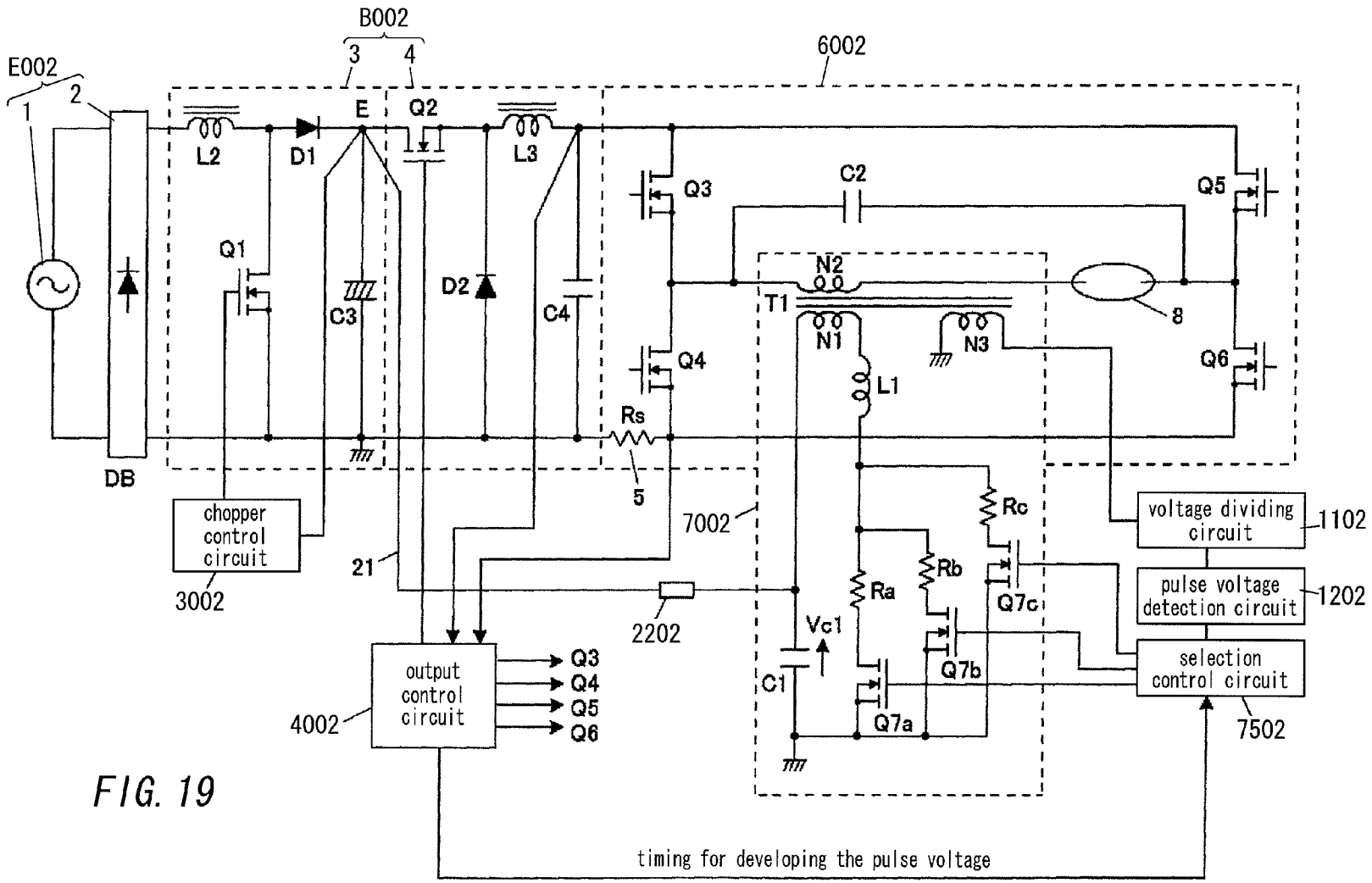
FIG. 19 shows a circuit diagram showing entire components of another third modification of the second embodiment.

In addition, as shown in FIG. 19, it is possible to employ the switching element Q7*a* which is connected in series with the resistor R1, the switching elements Q7*b* which is connected in series with the resistor R2, and the switching element Q7*c* which is connected in series with the resistor R3. In this case, the resistor R1, Rb, and Rc are different in the resistance values from each other. Consequently, it is possible to vary the impedance of the discharge circuit when one of the switching elements Q7*a*, Q7*b*, and Q7*c* is turned on. The components and the operation other than the above is same as the components and the operation of the second embodiment.

Figure 20:
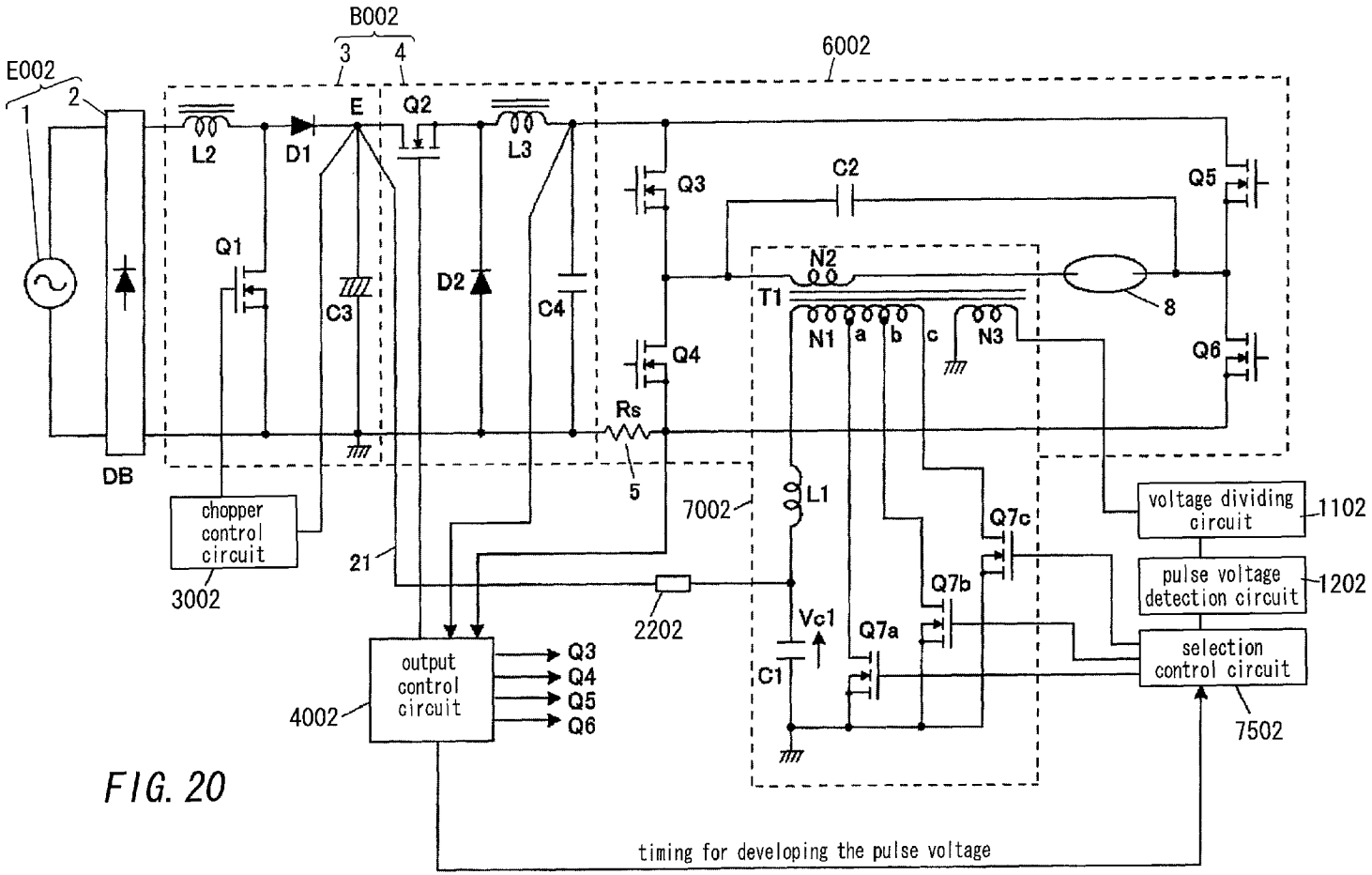
FIG. 20 shows a circuit diagram showing entire components of the fourth modification of the second embodiment.

FIG. 20 shows a circuit diagram of the fourth modification of the second embodiment. In this embodiment, the transformer T1 comprises the primary winding N1 which has a tap A and a tab B. The switching element Q7*a* is connected to the primary winding N1 through the tap A. Consequently, the number of turn of the primary winding N1 between the capacitor C1 and the tap A is equal to TNa times. The switching element Q7*b* is connected to the primary winding N1 through the tap B. The number of turn of the secondary winding N2 between the capacitor C1 and the tap B is equal to TNb times. The primary winding is connected to the switching element Q7 through the end terminal C. The number of turn of the primary winding between the capacitor C1 to the end terminal C is equal to TNc times. It is noted that the number of turn of the secondary winding N2 is equal to TN2 times. The switching element Q7*a* is connected in parallel with the switching element Q7*c* through the tap A. The switching element Q7*b* is connected in parallel with the switching element Q7*c* through the tap B. In addition, the circuit further comprises the selection control circuit 7502. The selection control circuit 7502 is provided for turning on one of the switching element Q7*a*, the switching element Q7*b*, and the switching element Q7*c* selectively. The selection control circuit 7502 is provided with a controller integrally for turning on each the switching elements Q7*a*, Q7*b*, and Q7*c*. The discharge circuit is configured to step up "the voltage induced in the primary winding N1 of the transformer T1 when the switching element Q7*a* has on state" in order to output "the high pressure pulse voltage which is equal to TNa/TN2 times of the voltage induced in the primary winding N1". Consequently, the discharge circuit applies the high pressure pulse voltage to the high pressure discharge lamp 8. The discharge circuit is configured to step up "the voltage induced in the primary winding N1 of the transformer T1 when the switching element Q7*b* has on state" in order to output "the high pressure pulse voltage which is equal to TNb/TN2 times of the voltage induced in the primary winding N1". The discharge circuit is configured to step up "the voltage induced in the primary winding N1 of the transformer T1 when the switching element Q7*c* has on state" in order to output "the high pressure pulse voltage which is equal to TNc/TN2 times of the voltage induced in the primary winding N1.

The number of the tap of the primary winding N1 is arbitrarily determined on the basis of the corrective accuracy. The turn ratios are also arbitrarily determined on the basis of the corrective accuracy. In addition, it is possible to combine this configuration with the variation control of the gate voltage explained in the second embodiment. The components and the operations other than the above is same as the components and the operations in the second embodiment.

According to this embodiment, it is possible to obtain the high pressure discharge lamp lighting device which is realized simple circuit with low cost, and which is configured to output a high pressure pulse voltage having a constant peak value when the high pressure discharge lamp is started even if the output wiring is extended.

It should be noted that the switching element which is employed in the igniter 7002 is not limited to the MOSFET and the bipolar transistor. That is, semiconductor switching element such as a IGBT and a bidirectional thyristor is capable of employing as the switching element of the igniter 7002.

(Third Embodiment)

Figure 21:
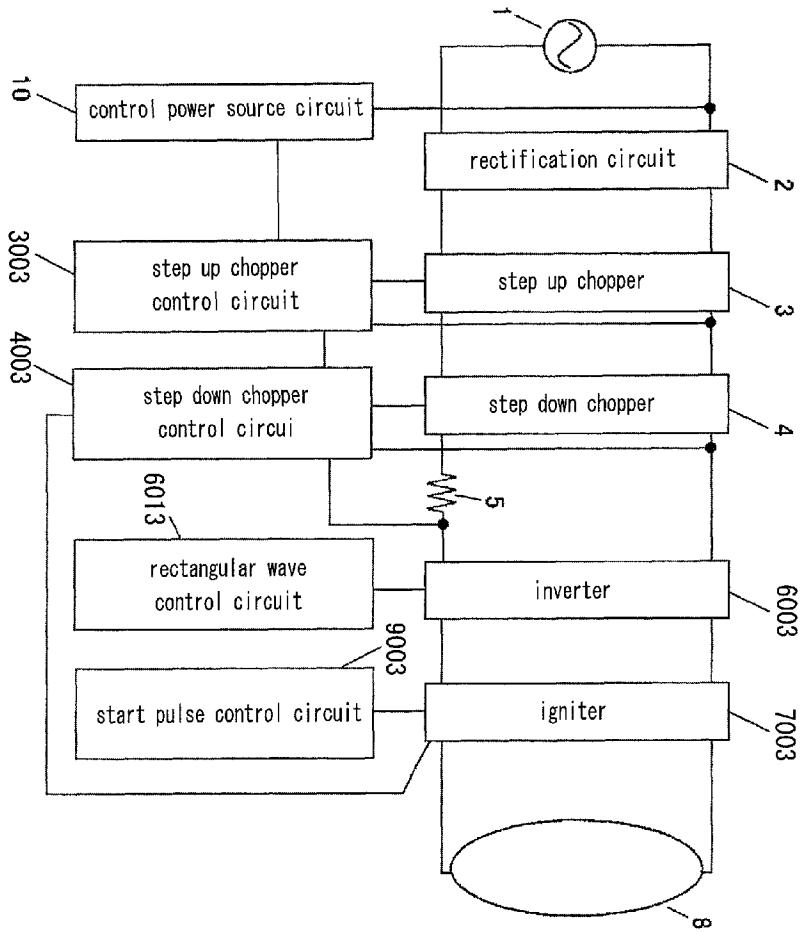
FIG. 21 shows a block diagram showing schematic configurations of the third embodiment.
Figure 22:
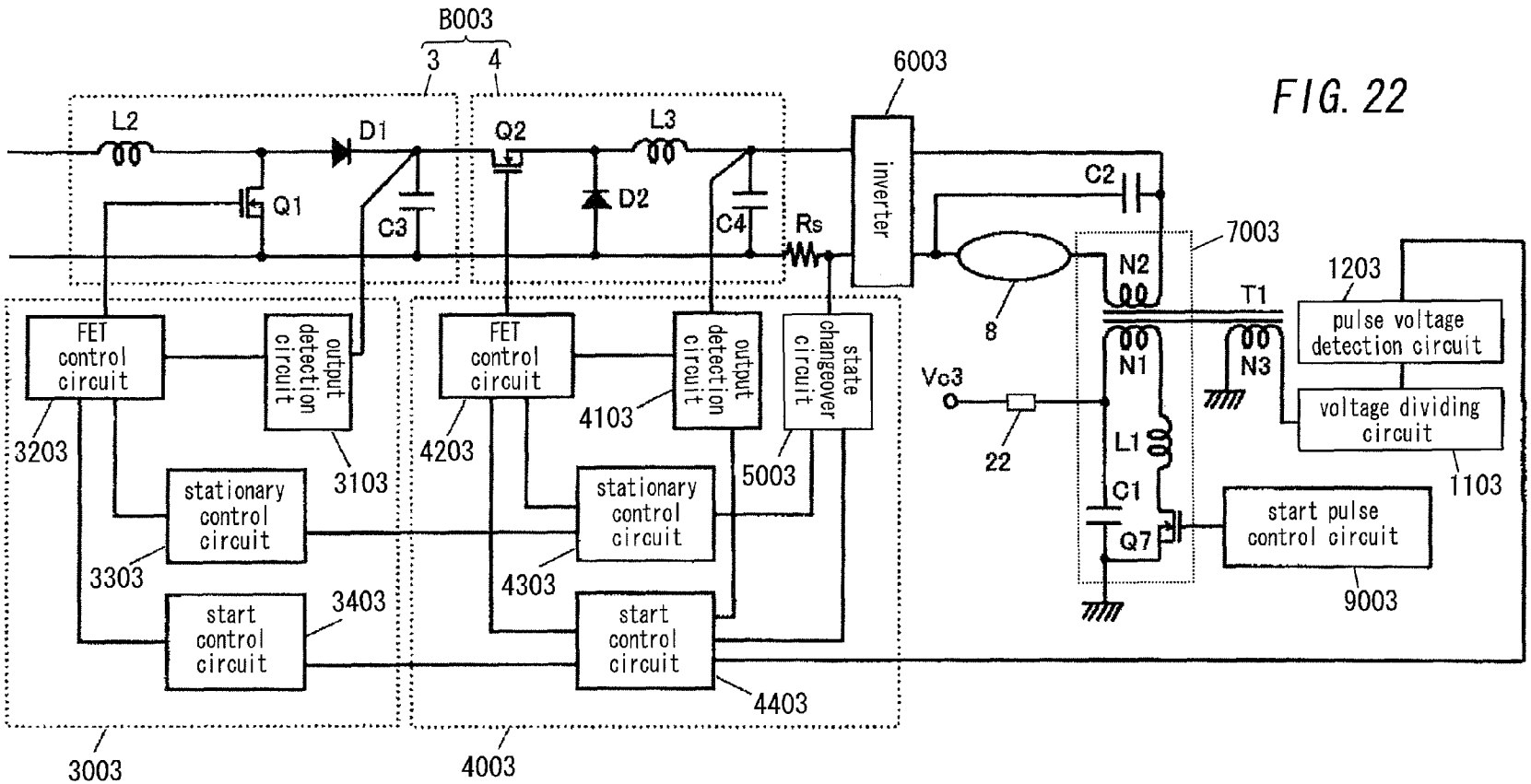
FIG. 22 shows a block circuit diagram showing a specific configuration of the third embodiment.

FIG. 21 shows a block diagram of the third embodiment. In this embodiment, the step up chopper 3 is cooperative with the step down chopper 4 to form a converter B003. FIG. 22 shows a detail illustration of the step up chopper 3, the step down chopper 4, the igniter 7003, the step up chopper control circuit 3003, and the step down chopper control circuit 3004.

FIG. 22 shows the circuit components of the step up chopper 3. The inductor L2 is cooperative with the switching element Q1 to form a series circuit. The series circuit is connected across the rectification circuit 2. The smoothing capacitor C3 is connected across the switching element Q1 through the diode D1. The inductor L2 is cooperative with the switching element Q1, the diode D1, and the smoothing capacitor C3 to form the step up chopper 3. The step up chopper control circuit 3003 is configured to turn on and turn off the switching element Q1. The switching element Q1 is controlled to be turned on and turned off at a frequency which is sufficiently higher than a frequency of the commercial alternating current power source 1. Consequently, the output voltage which is output from the rectification circuit 2 is stepped up to a specified direct current voltage. The specified direct current voltage is applied to the smoothing capacitor C3.

The direct current power source in this embodiment is realized by a direct current power source comprising the commercial alternating current power source 1 and the smoothing capacitor C3 which rectifies and smoothes the output of the commercial alternating power source 1. However, the direct current power source is not limited thereto.

The step down chopper 4 is connected across the step up chopper 3. The step down chopper 4 acts as the ballast. Therefore, the step down chopper 4 supplies the target electric power to the high pressure discharge lamp 8 (which is the load). In addition, the step down chopper 4 is controlled to supply the suitable electric power to the high pressure discharge lamp 8 through the period of arc discharge from when the high pressure discharge lamp is started to when the high pressure discharge lamp 8 is stably operated.

The circuit components of the step down chopper 4 are explained. The positive terminal of the smoothing capacitor C3 (which acts as the direct current power source) is connected to the positive terminal of the capacitor C4 through the switching element Q2 and the inductor L3. The negative terminal of the capacitor C4 is connected to the negative terminal of the smoothing capacitor C3. The negative terminal of the capacitor C4 is connected to the anode of the diode D2. The diode D2 is provided for flowing the regenerative current. The cathode of the diode D2 is connected to the connection point between the switching element Q2 and the inductor L3.

The circuit operation of the step down chopper 4 is explained. The switching element Q2 is configured to be turned on and turned off at a high frequency according to the control signal which is output from the step down chopper control circuit 4003. When the switching element Q2 has on state, the step up chopper outputs the current to the switching element Q2, the inductor L3, and the capacitor C4. When the switching element Q2 has off state, the regenerative current is flown to the inductor L3, the capacitor C4, and the diode D2. Consequently, the output voltage which is output from the step up chopper 3 is stepped down, whereby the direct current voltage is applied to the capacitor C4. The step down chopper control circuit 4003 is configured to vary the duty cycle of the switching element Q2. (The duty cycle means the ratio of the on period to the one cycle.) Consequently, the voltage applied to the capacitor C4 is varied.

The inverter 6003 is connected to the step down chopper 4. The inverter 6003 is realized by the full bridge circuit. The full bridge circuit comprises the four switching elements. The inverter 6003 is configured to convert the output power of the step down chopper 4 to the lighting voltage of the rectangular alternating wave at low frequency in synchronization with the rectangular wave polarity reversing signal which is output from the rectangular wave control circuit 6013. Consequently, the inverter 6003 supplies the lighting voltage to the high pressure discharge lamp 8. The high pressure discharge lamp 8 is realized by a high intensity high pressure discharge lamp such as the metal halide lamp and the high pressure mercury lamp.

The step down chopper control circuit 4003 comprises a stationary control circuit 4303, a start control circuit 4403, a state changeover circuit 5003, an output detection circuit 4103, and a FET control circuit 4203. The stationary control circuit 4303 is configured to determine an output target voltage value of "the voltage which is output from the step down chopper 4 and which is output when the high pressure discharge lamp has a stationary state". The start control circuit 4403 is configured to compare "the high pressure pulse voltage which is detected by the pulse voltage detection circuit 12 when the high pressure discharge lamp is started" with "the target value of the high pressure pulse voltage". Subsequently, the start control circuit 4403 is configured to determine an output target value of the step down chopper 4 on the basis of the comparative result. The state changeover circuit 5003 is configured to detect the output current which is output from the step down chopper 4 in order to change the operation between the start control circuit 4403 and the stationary control circuit 4303. The output detection circuit 4103 is configured to detect the output of the step down chopper 4. The FET control circuit 4203 is configured to turn on and turn off the switching element Q2 on the basis of the input which is output from the start control circuit 4403 or the stationary control circuit 4303.

In addition, the step up chopper control circuit 3003 comprises a stationary control circuit 3303, a start control circuit 3403, an output detection circuit 3103, and a FET control circuit 3202. The stationary control circuit 3303 is configured to determine the output target value which is output from the step up chopper 3 when the high pressure discharge lamp is in the stationary state. The start control circuit 3403 is configured to determine the output target value of the step up chopper when the high pressure discharge lamp is in the start state. The output detection circuit 3103 is configured to detect the output of the step up chopper 3. The FET control circuit 3203 is configured to turn on and turn off the switching element Q1 on the basis of the input which is output from the start control circuit 3403 or the stationary control circuit 3303.

The igniter 7 is configured to be operated only when the high pressure discharge lamp 8 is started. The igniter 7 is configured to generate the pulse voltage. The igniter 7 is configured to superimpose the pulse voltage on the lighting voltage. The igniter 7 comprises the capacitor C1, the transformer T1, the switching element Q7, and the impedance 71. The capacitor C1 is configured to be charged by a predetermined voltage value of the voltage Vc1 by the step up chopper 3 through the impedance 22. The switching element Q7 is turned on and turned off by the outside control signal. The impedance 71 is provided for protection of the excess current to the switching element Q7. The transformer T1 comprises the primary winding N1, the secondary winding N2, and the third winding N3. The primary winding N1 is connected across the capacitor C1. The primary winding N1 is connected in series with the impedance 71 and the switching element Q7. The secondary winding N2 is connected across the inverter 6003. The secondary winding N2 is connected in series with the high pressure discharge lamp 8. The secondary winding N2 is configured to develop the pulse voltage when the current is applied to the primary winding N1. The third winding N3 is configured to induce the detection voltage when the pulse voltage is developed in the secondary winding N2. The impedance 22 is cooperative with the capacitor C1 to form a charging circuit for charging the capacitor C1. The capacitor C1 is cooperative with the primary winding N1, the impedance 71, and the switching element Q7 to form the discharge circuit for discharging the capacitor C1. The start pulse control circuit 9003 is configured to turn on and turn off the switching element Q7. The start pulse control circuit 9003 is configured to turn on the switching element Q7 to discharge the capacitor C1 which is charged by the charging power source 2102. When the capacitor C1 is discharged, the capacitor C1 applies the discharge current to the primary winding N1. The discharge current applied to the primary winding induces the pulse voltages in the secondary winding. The pulse voltage which is induced in the secondary winding is, as mentioned above, superimposed on the lighting voltage. In addition, the pulse voltage and the lighting voltage being developed in the secondary winding N2 induces the detection voltage in the third winding N3. The detection voltage has a correlative relationship with respect to the starting voltage. The capacitor C2 is provided for bypassing the high frequency voltage. Consequently, the capacitor C2 prevents the high frequency voltage from being applied to the inverter 6003. The capacitor C2 is cooperative with the secondary winding N2 and the high pressure discharge lamp 8 to form a closed series circuit. As the high pressure pulse voltage is induced in the secondary winding N2 of the transformer T1, the high pressure pulse voltage is applied to the high pressure discharge lamp 8 through the capacitor C2.

Figure 23A:
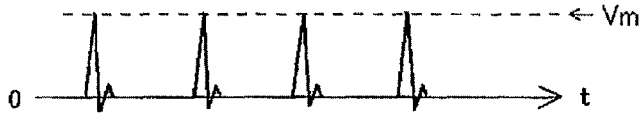
FIG. 23*a* to FIG. 23*c* show an operation waveforms of the third embodiment in a case where the output wiring is shortest.
Figure 23B:
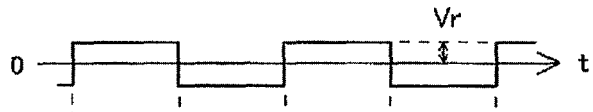
Figure 23C:
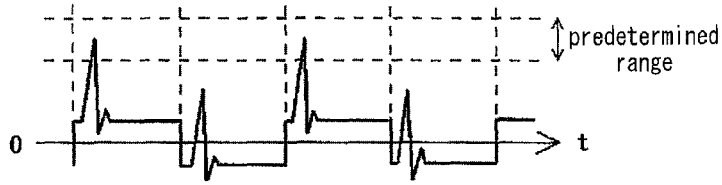
Figure 24A:
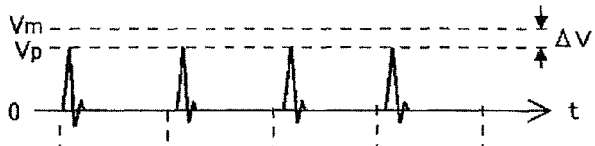
FIGS. 24*a* to 24*d* show operation waveforms of the third embodiment in a case where the output wiring is middle.
Figure 24B:
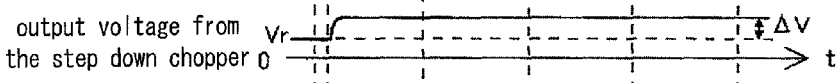
Figure 24C:
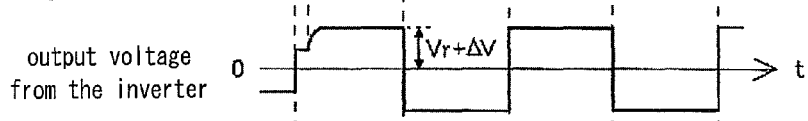
Figure 24D:
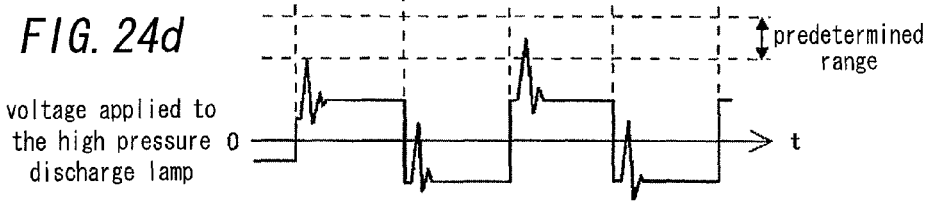

FIG. 23 shows waveforms in a condition where the length of the wiring to the high pressure discharge lamp 8 is short and where a floating capacitance of the wiring is extremely small. In this case, a maximum value of the high pressure pulse voltage which is stepped up by the transformer T1 is determined as the target value Vm of the high pressure pulse voltage. The output voltage value of the voltage which is output from the step down chopper 4 is determined as the output target value Vr in the stationary state.

FIG. 24 shows waveforms in a condition where the length of the wiring to the high pressure discharge lamp 8 is long and where the high pressure pulse voltage which is stepped up is attenuated by the floating capacitance of the wiring. The detection voltage developed in the third winding N3 is applied to the pulse voltage detection circuit 12 through the voltage dividing circuit 11. The pulse voltage detection circuit 12 is configured to output the detection signal on the basis of the detection voltage which is divided by the voltage dividing circuit 11. The detection signal is indicative of the voltage level which corresponds to the starting voltage. The detection signal is sent to the start control circuit 4403. The start control circuit 4403 is acts as the starting voltage regulation circuit. The start control circuit 4403 is configured to calculate the difference between "the high pressure pulse voltage Vp which is indicated by the voltage level of the detection signal" and "the target value Vm of the high pressure pulse voltage. That is, the difference indicates a shortfall voltage δV from the target value. Then, the start control circuit 4403 determines "the output target value of the step down chopper" which is higher than the stationary target value Vr of the step down chopper by δV. The FET control circuit 4203 of the step down chopper control circuit 4003 receives the output which is output from the start control circuit 4403 in order to turn on and turn off the switching element Q2. When the switching element Q2 is turned on and turned off, the output voltage which is output from the step down chopper is regulated. Subsequently, the output detection circuit 4103 is configured to detect the output voltage of the step down chopper 4 in order to feed back the output voltage to the FET control circuit 4203. According to the result which is fed back from the output detection circuit, the FET control circuit 41 regulates the timing of turning on and turning off the switching element Q2. In this manner, the output voltage which is output from the step down chopper 4 is regulated to the output target value.

FIG. 25 shows waveforms in a case where "the output target value Vd of the voltage which is output from the step down chopper 4" which is determined by the start control circuit 4403 of the step down chopper control circuit 4003 is higher than the voltage value of the input voltage which is output from the step down chopper 4. In this case, the start control circuit 4403 of the step down chopper control circuit 4003 sends the output target value Vd to the start control circuit 3403 of the step up chopper control circuit 3003. The start control circuit 3403 acts as a part of the start voltage regulation circuit. The start control circuit 3403 of the step up chopper control circuit 3003 outputs a target voltage value which is higher than the output target value Vd of the step down chopper 4 as the output target value Vu of the step up chopper 3. The FET control circuit 3203 of the step up chopper control circuit 3003 is configured to control the switching element Q1 on the basis of the target voltage value which is sent from the start control circuit 3403. The output detection circuit 3103 detects the output voltage of the step up chopper 3 in order to feed back the output voltage to the FET control circuit 3203. The FET control circuit 3203 regulates the timing of turning on and turning off the switching element Q1 again on the basis of the result of the feedback. In this manner, the step up chopper 3 is configured to step up the output voltage. As a result, the input voltage of the step down chopper 4 is also raised, whereby it is possible to raise the upper limit of the output voltage which is output from the step down chopper 4.

Figure 26:
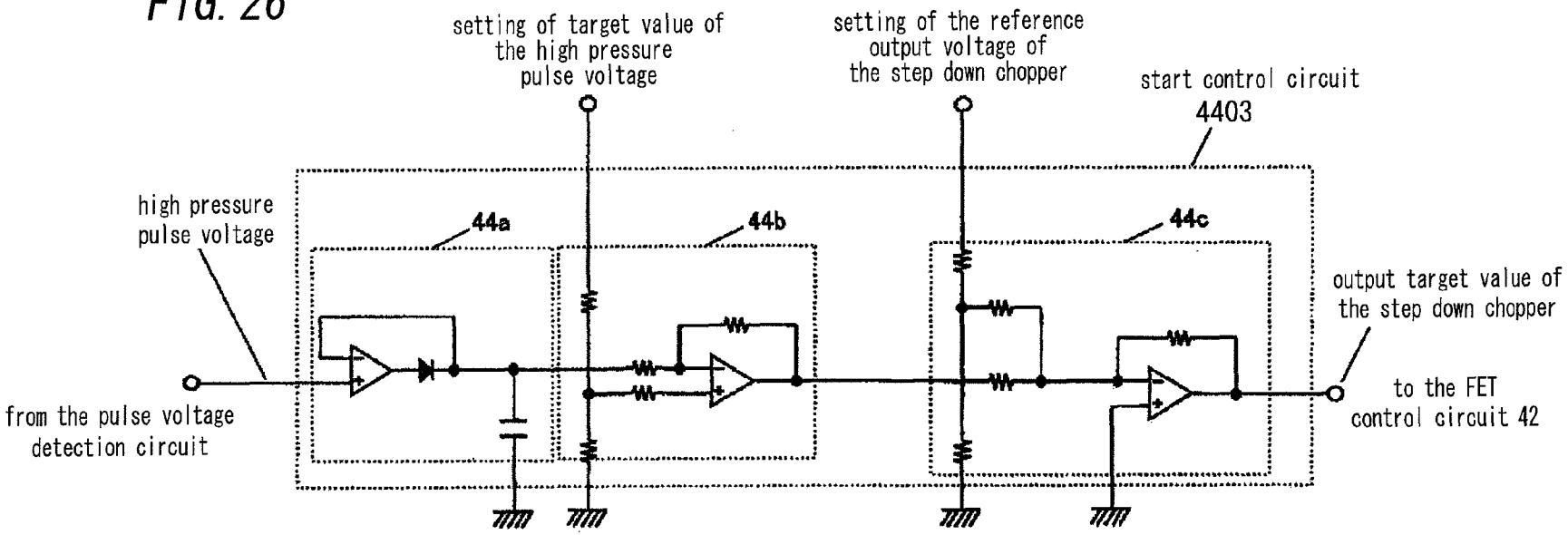
FIG. 26 shows a circuit diagram of main components in the third embodiment.
Figures 27A, 27B, 27C, 27D, 27E, 27F:
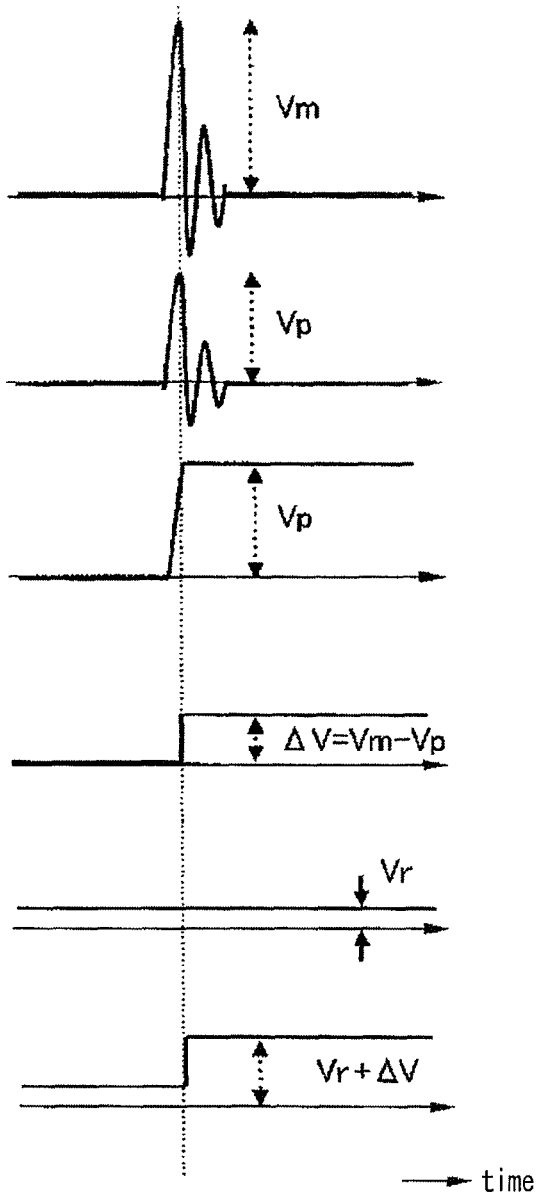
FIGS. 27*a* to 27*f* show waveforms of the third embodiment.

FIG. 26 shows configurations of the start control circuit 4403 of the step down chopper control circuit 4003 in this embodiment. In addition, FIG. 27 shows waveforms which corresponds to the each components in FIG. 24. The start control circuit 4403 comprises a peak value detection circuit 44*a*, a high pressure pulse detection circuit 44*b*, and a step down chopper setting circuit 44*c*. The peak value detection circuit 44*a* is configured to receive the feedback which indicates the pulse voltage which is output from the pulse voltage detection circuit 12 in order to detect the peak value Vp of the pulse voltage. The high pressure pulse detection circuit 44*b* is configured to calculate a difference between the peak value Vp of the pulse voltage and the target value Vm of the pulse voltage, whereby the high pressure pulse detection circuit 44*b* outputs a calculation result. The step down chopper setting circuit 44*c* adds the reference voltage Vr of the step down chopper 4 to the difference δV of the pulse voltage, whereby the step down chopper setting circuit 44*c* outputs a target value to the FET control circuit 4203.

As mentioned above, the shortfall of the high pressure pulse voltage which is stepped up by the transformer T1 is offset by the output voltage which is output from the step down chopper 4. Consequently, it is possible to constantly keep the peak value of the voltage applied to the high pressure discharge lamp 8 when the high pressure discharge lamp 8 is started.

In this embodiment, the voltage which is induced in the third winding is detected as the detection voltage. However, it is possible to connect the pulse voltage detection circuit in parallel with the high pressure discharge lamp 8. In this case, the pulse voltage detection circuit is configured to detect the starting voltage which is applied to the high pressure discharge lamp 8. In addition, it is also possible to connect the pulse voltage detection circuit in parallel with the primary winding N1. Consequently, the pulse voltage detection circuit is configured to detect the pulse voltage which is induced in the primary winding N1.

Figure 28:
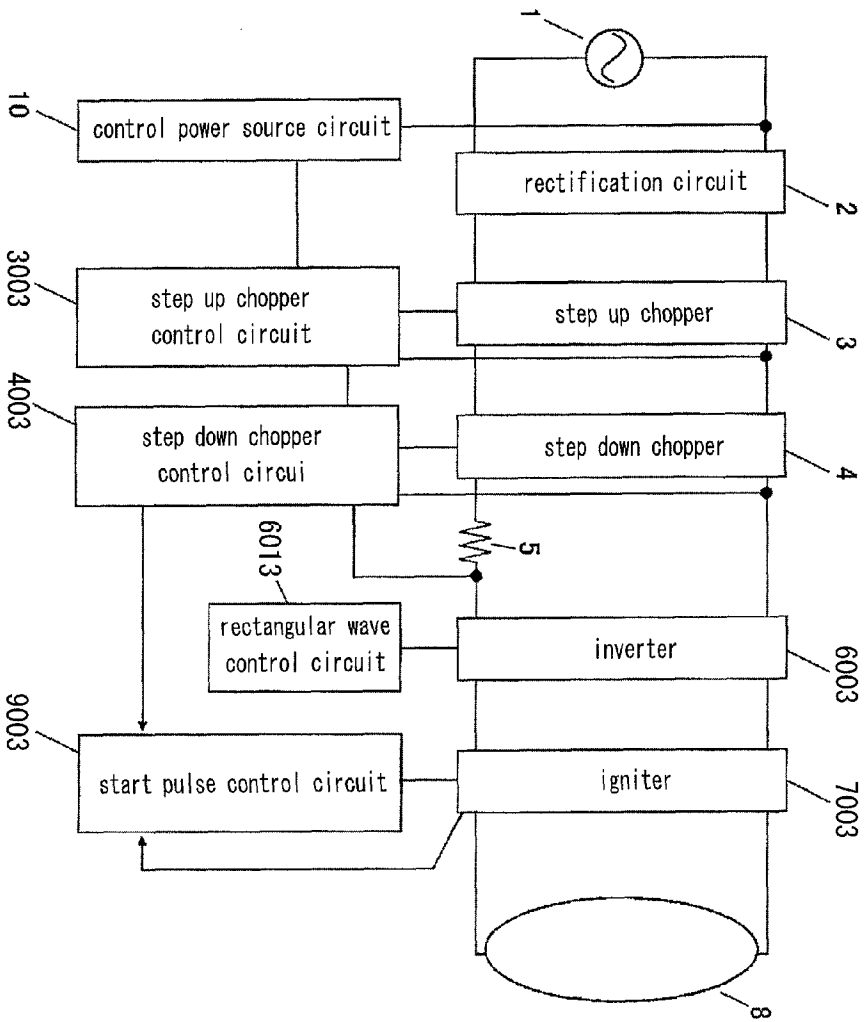
FIG. 28 shows a block diagram showing a schematic configuration of a first modification of the third embodiment.
Figure 29:
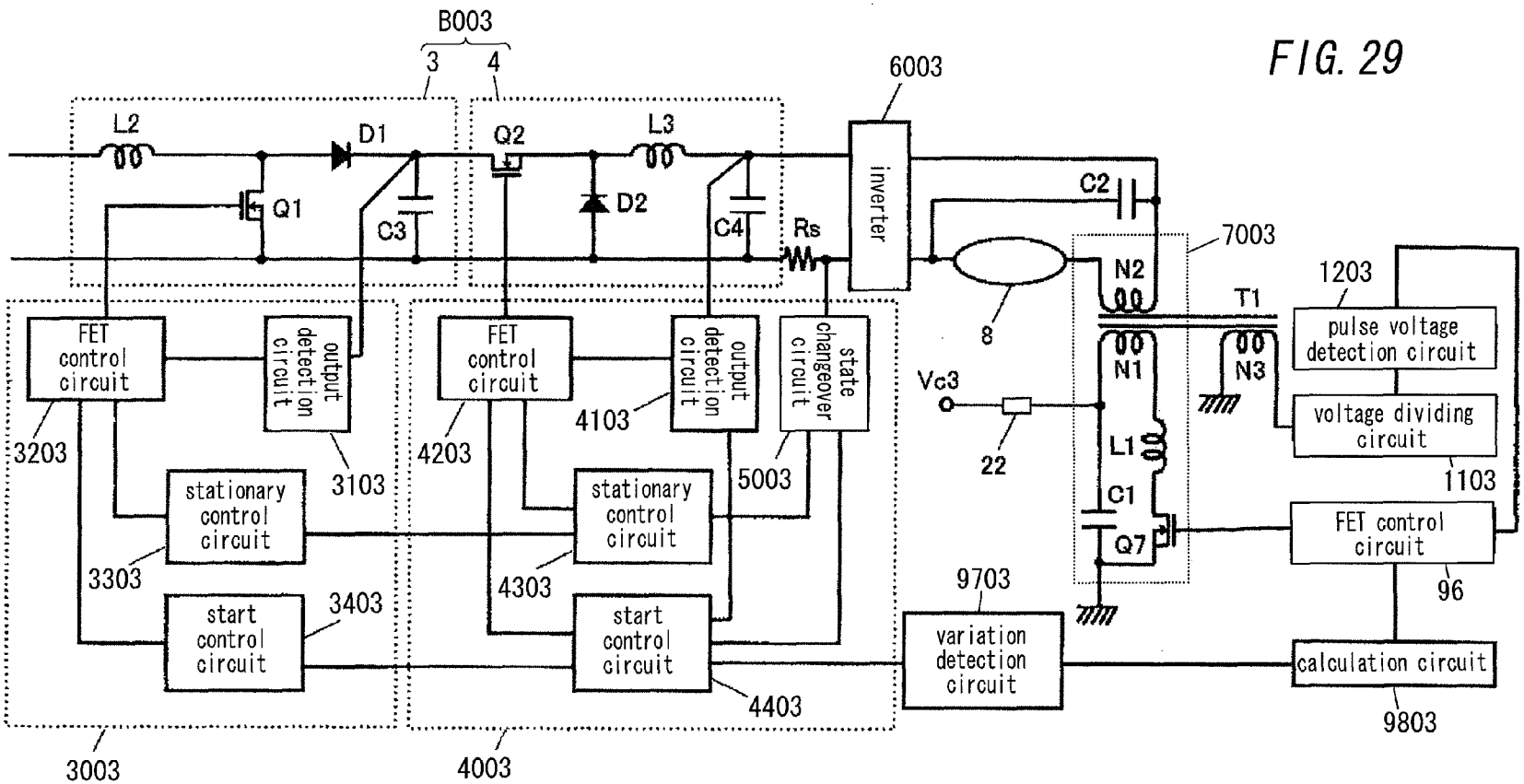
FIG. 29 shows a block circuit diagram showing a specific configuration of the first modification of the third embodiment.

FIG. 28 shows a block diagram of a first modification of the third embodiment. FIG. 29 shows a detail illustration of the step up chopper 3, the step down chopper 4, the igniter 7003, the step up chopper control circuit 3003, and the step down chopper control circuit 4003.

As shown in FIG. 29, the step down chopper control circuit 4003 comprises a stationary control circuit 4303, a start control circuit 4403, a state changeover circuit 5003, an output detection circuit 4103, and a FET control circuit 4203. The stationary control circuit 4303 is configured to determine the output target value of the voltage which is output from the step down chopper 4. The start control circuit 4403 is configured to determine the variation of the output voltage which is output from the step down chopper when the high pressure discharge lamp is started. The state changeover circuit 5003 is configured to detect the output current which is output from the step down chopper 4. The state changeover circuit 5003 is configured to detect the output of the step down chopper 4. The FET control circuit 4203 is configured to turn on and turn off the switching element Q2 on the basis of the input which is sent from the start control circuit 4403 and the stationary control circuit 4303.

FIG. 30 shows waveforms in the components, respectively.

When there is no load, as shown in FIG. 31, the step down chopper 4 is controlled such that the output voltage of the step down chopper 4 has a certain variation. In FIG. 31, abscissa axis indicates the time. The ordinate axis indicates the voltage value. The step down chopper 4 outputs the output voltage. The output voltage which is output from the step down chopper 4 is inverted by the inverter 6003 into the low frequency alternating voltage shown in FIG. 31. The cycle length of the low frequency alternating current is generally equal to several hundreds. The amplitude of the low frequency alternating current is generally equal to several hundred volts.

In this modification, the start pulse control circuit comprises a variation detection circuit 9730 and a calculation circuit 9803. The variation detection circuit 9730 is configured to detect the variation amount of the direct current voltage which is output from the step down chopper 4. The variation detection circuit 9730 is configured to output the output voltage detection signal which indicates the variation amount of the direct current voltage. The calculation circuit 9830 is configured to calculate the timing on the basis of detection signal which is output from the pulse voltage detection circuit 12 and the output voltage detection signal which is output from the variation detection circuit 9703. The timing which is calculated by the calculation circuit 9803 corresponds to a timing at which the starting voltage becomes the desired value. FET control circuit 96 is configured to turn on the switching element Q7 at the timing which is calculated by the calculation circuit 9803. Therefore, the start control circuit 3403 is cooperative with the start control circuit 4403, the variation detection circuit 9703, and the calculation circuit 9803 to form a starting voltage regulation circuit.

Figure 33:
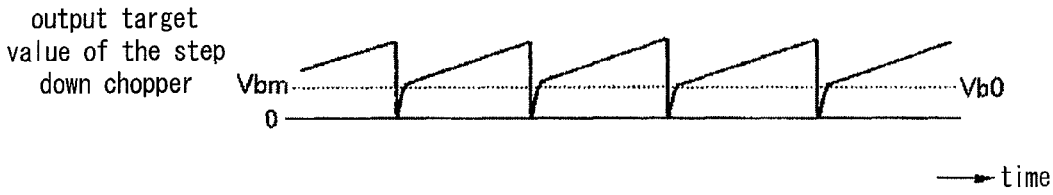
FIG. 33 shows a waveform showing an output target value for starting the step down chopper in the first modification of the third embodiment.

FIG. 32 shows a specific circuit configuration of the start control circuit 4403 of the step down chopper control circuit 4003 in the modification. The start control circuit 4403 is configured to charge the capacitor through a constant current circuit. The capacitor is discharged at timing at which the inverter 6003 inverts the polarity. Consequently, the output which is shown in FIG. 33 is output.

Figure 34:
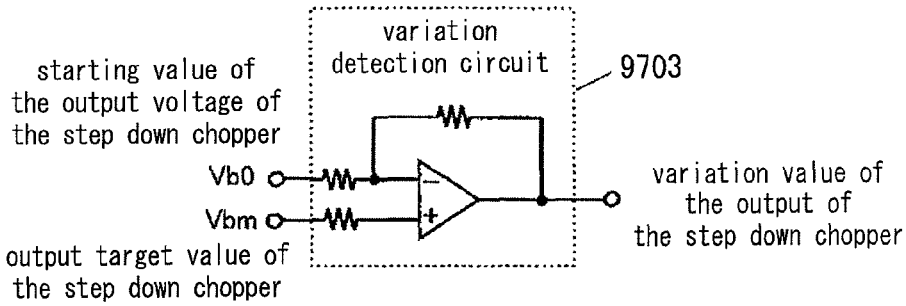
FIG. 34 shows a circuit diagram showing a output variation detection circuit of the step down chopper of the first modification of the third embodiment.
Figure 35:
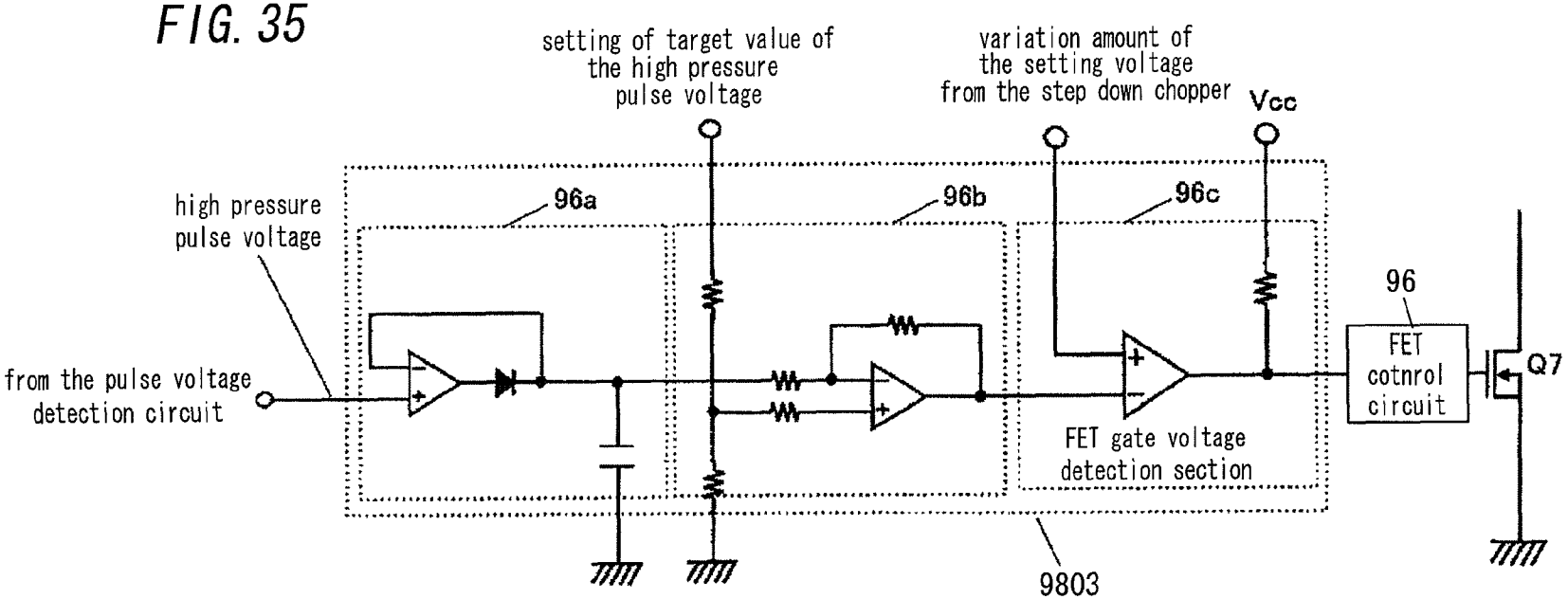
FIG. 35 shows a circuit diagram showing a start pulse voltage generation circuit control circuit of the first modification of the third embodiment.

FIG. 34 and FIG. 35 show configurations of the start pulse control circuit 9003. FIG. 36 shows waveforms in the components, respectively.

FIG. 34 shows a detail of the variation detection circuit 9703 in the start pulse control circuit 9003. The variation detection circuit 9703 is realized by an operational amplifier. The variation detection circuit 9703 is configured to calculate the output variation value of the step down chopper 4 to output the calculation result to the FET control circuit 96.

FIG. 35 shows a calculation circuit 9803 of the start pulse control circuit 9003. The calculation circuit 9803 comprises a peak value detection circuit 96*a* and a pulse variation detection circuit 96*b*. The peak value detection circuit 96*a* is cooperative with a pulse variation detection circuit 96*b* to calculate the difference δV from the feedback of the high pressure pulse voltage, and output the calculation result to the FET gate voltage regulation circuit 96*c*. FET gate voltage control circuit 96*c* is configured to allow the FET control circuit 96 to turn on the switching element Q7 when the difference δV becomes equal to the output variation value of the voltage which is output from the step down chopper. Consequently, it is possible to offset the variation amount of the pulse voltage by the variation amount of the output voltage which is output from the inverter 6003. As a result, it is possible to constantly keep the peak voltage applied to the high pressure discharge lamp.

In addition, as shown in FIG. 31, the output voltage which is output from the step down chopper 4 is varied continuously from at a moment when the polarity of the lighting voltage is inverted. However, the variation of the output voltage is not limited thereto. For example, it is possible to vary the output voltage in a stepwise fashion shown in FIG. 37. In a case where the output voltage of the step down chopper 4 is varied in the stepwise fashion, the FET control circuit 96 and the calculation circuit 9803 are set to turn on the switching element Q7 such that when the period between the output signal from the pulse voltage detection circuit 12 and the output signal from the variation detection circuit 9730 becomes smallest. In a case where the output voltage from the step down chopper is varied in an upwards stepwise fashion, it is possible to easily adjust "the peak value applied to the high pressure discharge lamp 8" equal to the target value.

Figure 38:
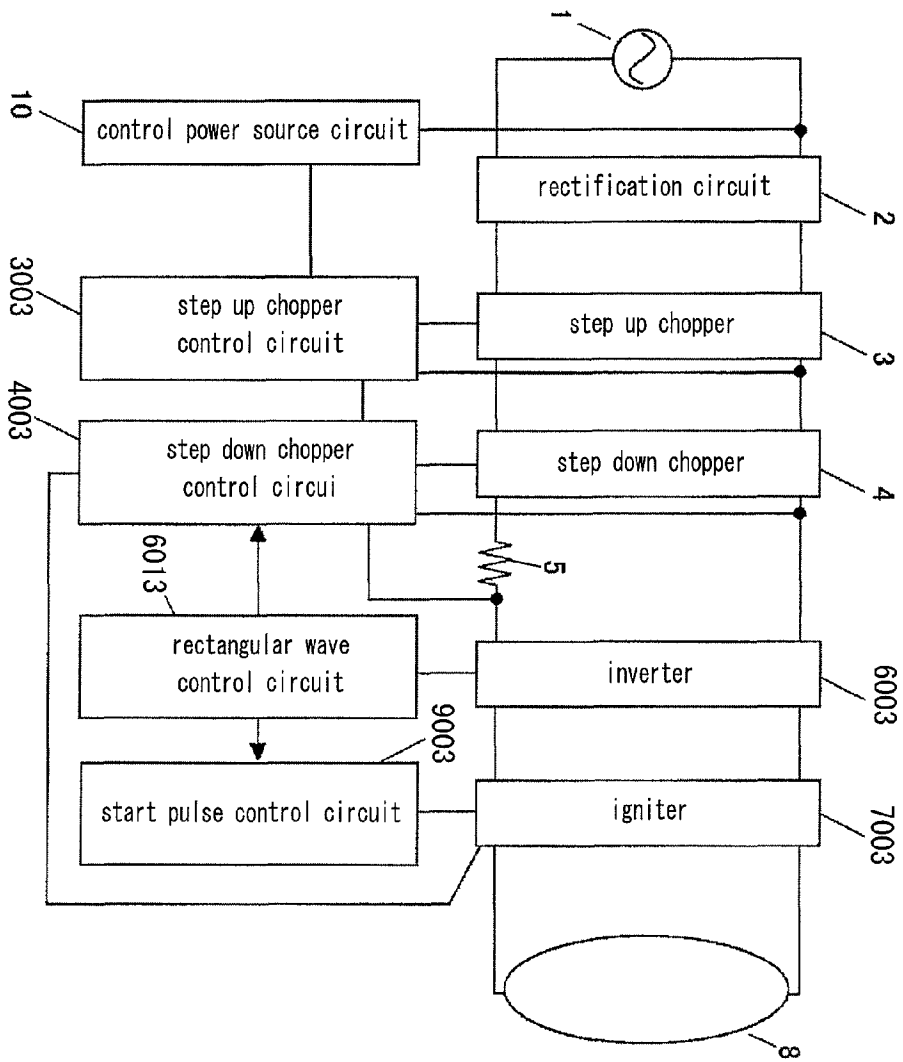
FIG. 38 shows a block diagram showing a schematic configuration of the second modification of the third embodiment.

FIG. 38 shows an entire configuration of the block diagram of the second modification of the third embodiment. In this embodiment, the configurations for detecting the high pressure pulse voltage which is stepped up by the transformer T1, and for feeding back the detected high pressure pulse voltage in order to regulate the output of the step down chopper 4 are same as those of FIG. 22 in the third embodiment.

In this embodiment, the start control circuit 4403 of the step down chopper control circuit 4003 is configured to detect the polarity reversing signal which is output from the rectangular wave control circuit 6013. Subsequently, the start control circuit 4403 determines the output target value of the step down chopper 4 on the basis of the variation amount of the pulse voltage in a first period. The first period is equal to a half cycle of the rectangular alternating wave having a polarity which is same to the polarity of the pulse voltage.

In addition, the start pulse control circuit 9003 is configured to detect the polarity inversion signal which is output from the rectangular wave control circuit 6013, and is configured to develop the high pressure pulse voltage only in the half cycle of the rectangular alternating wave having a polarity which is same to the polarity of the pulse voltage. For example, there are some situations where the polarity of the rectangular wave output voltage is same as the polarity of the high pressure pulse voltage. Under this situation, the FET control circuit 96 of the start pulse control circuit 9003 turns on the switching element Q7 at a timing of inverting the polarity of the rectangular output voltage from the negative polarity to the negative polarity.

Figure 39:
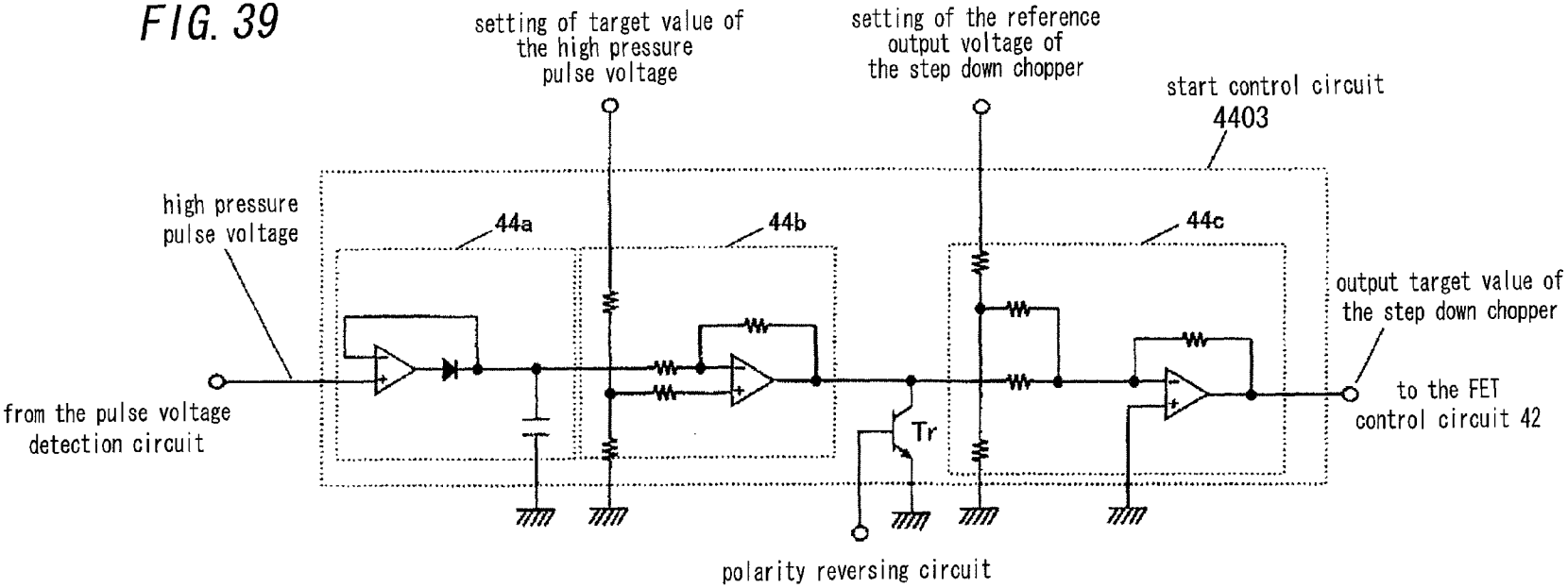
FIG. 39 shows a circuit diagram showing a start operation control circuit of the step down chopper in the second modification of the third embodiment.

FIG. 39 shows configurations of the start control circuit 4403 of the step down chopper 4 in this embodiment. In this embodiment, a transistor Tr is connected to an output terminal of the high pressure pulse detection circuit 44*b* of the start control circuit 4403 (such as FIG. 26). When the transistor Tr is turned on, the output of the high pressure pulse detection circuit 44*b* is grounded. The base of the transistor Tr receives the polarity reversion signal from the rectangular wave control circuit 6013. Consequently, the transistor Tr is turned on in only a half cycle where the high pressure pulse voltage has a polarity which is opposite to the polarity of the rectangular wave output voltage. Furthermore, the output voltage of the high pressure pulse variation detection unit 44*b* is set to zero. In addition, the output target value of the step down chopper 4 is set to have a value equal to a value of the reference output voltage.

Figures 40A, 40B, 40C, 40D, 40E:
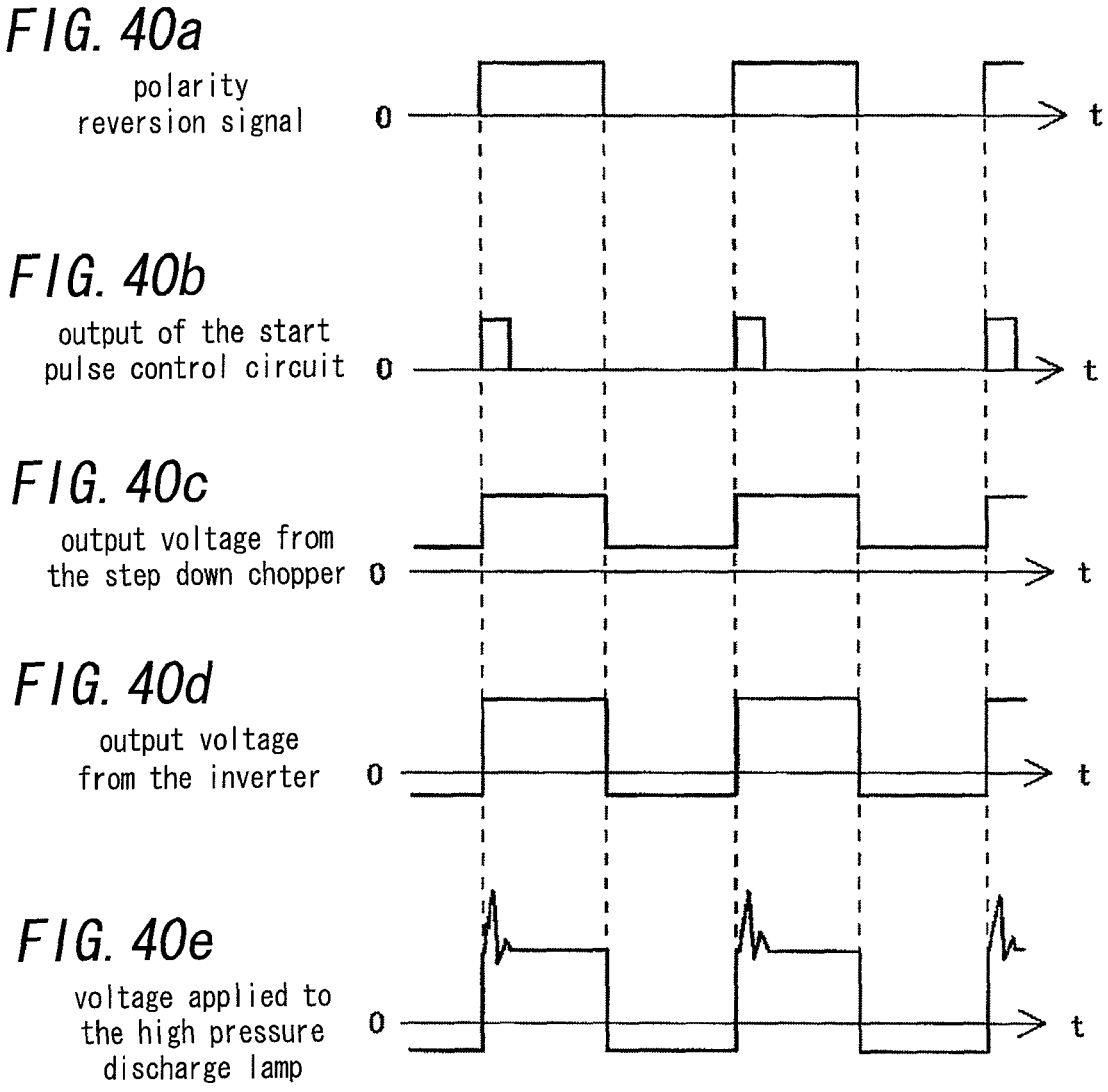
FIG. 40*a* to FIG. 40*e* show waveforms o the second modification of the third embodiment.

FIG. 40 shows waveforms of the components, respectively. Apparent from FIG. 40, "combinations of the polarity of the high pressure pulse voltage and the polarity of the rectangular wave output" includes some combination which is not suitable for regulating the output of the step down chopper 4. Therefore, it is preferred to regulate the output of the step down chopper 4 only when the output of the step down chopper 4 has the polarity which is same as the polarity of the high pressure pulse voltage. Consequently, a regulation range of the peak voltage which is applied to the high pressure discharge lamp is broadened compared with a case where an effective value of the output voltage is equal. In addition, with this configuration, it is possible to prevent the development of the wasted pulse voltage.

Figure 41:
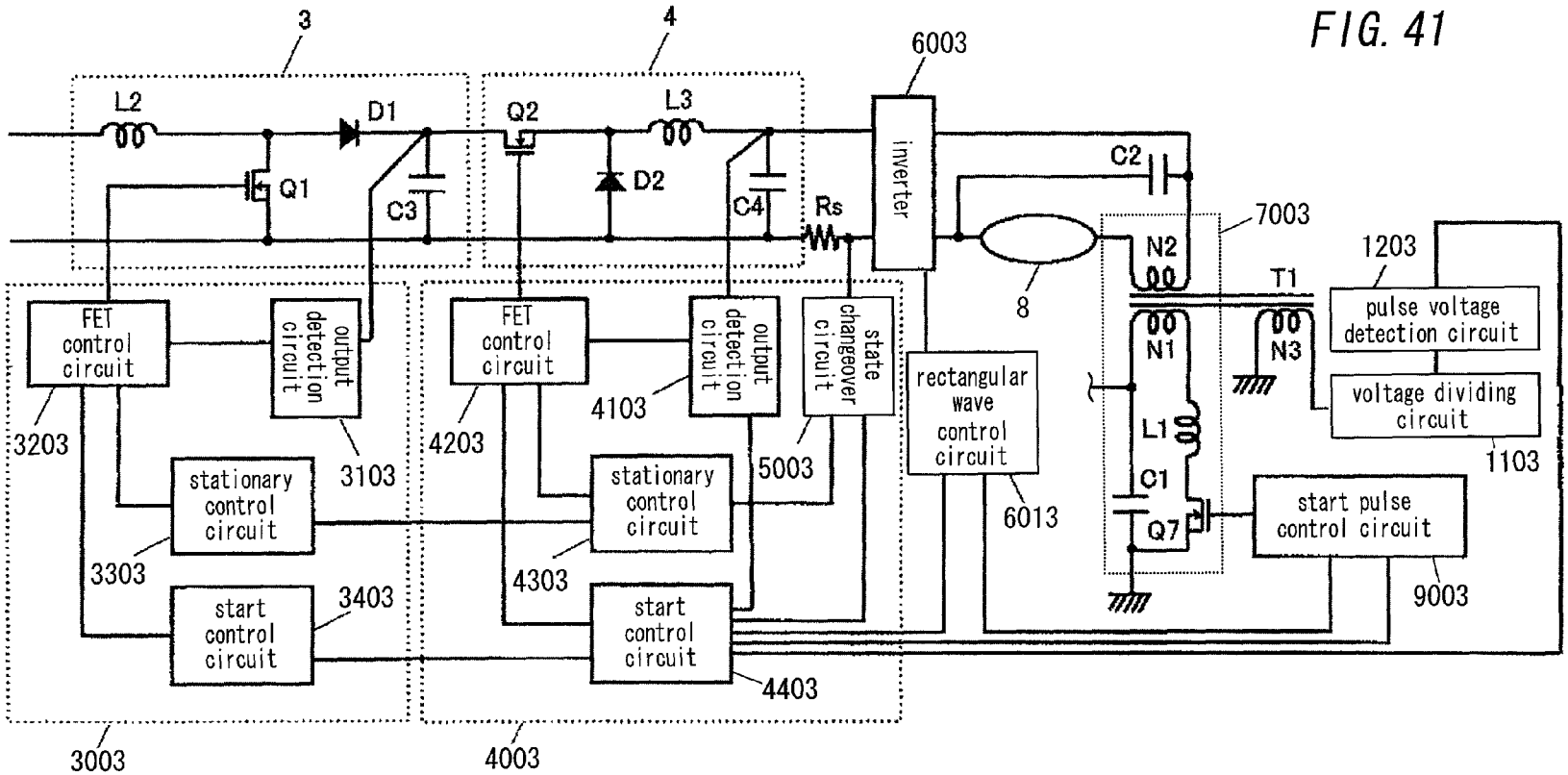
FIG. 41 shows a block circuit diagram showing a specific configuration in the third modification of the third embodiment.

FIG. 41 shows a circuit diagram showing entire configurations in a third modification of the third embodiment. This modification also comprises components which are in common with the components of the third embodiment. Therefore, the components in this modification is configured to detect the pulse voltage which is stepped up by the transformer T1, is configured to feed back the detected pulse voltage in order to regulate the output of the step down chopper 4, and is configured to regulate the generation of the pulse voltage detected by the polarity reversion signal of the rectangular wave control circuit 6013 by the start pulse control circuit 9003.

Figures 42A, 42B, 42C, 42D, 42E:
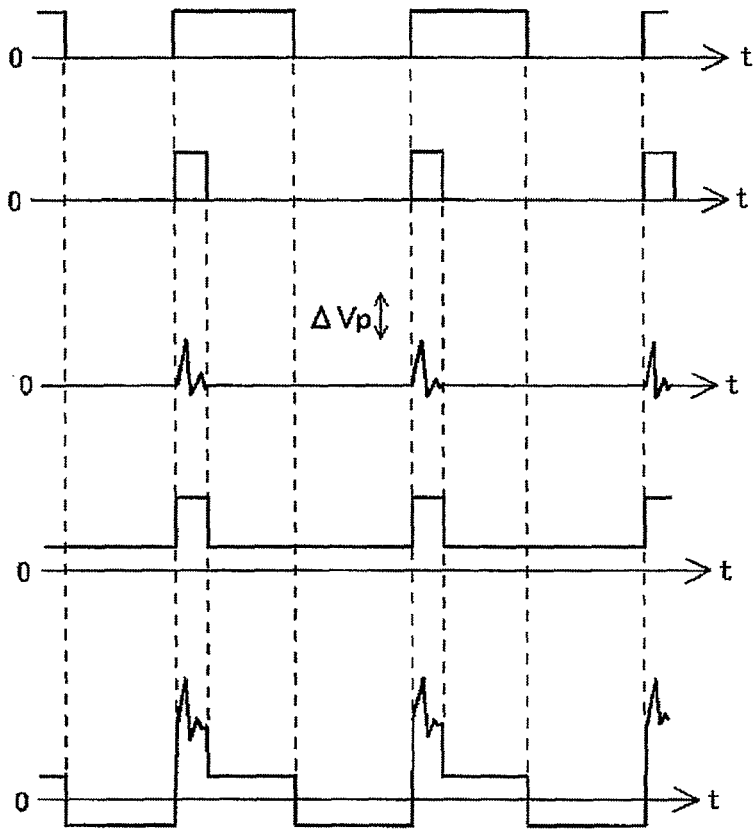
FIGS. 42*a* to 42*e* shows waveforms of the third modification of the third embodiment.

FIG. 42 shows waveforms of the components, respectively. The start control circuit 4403 of the step down chopper control circuit 4003 is configured to detect the polarity reversion signal which is output from the rectangular wave control circuit 6013. The start control circuit 4403 is configured to determines the output target value and regulate the output of the step down chopper 4 only in a half cycle of the rectangular wave output having a polarity which is equal to the polarity of the pulse voltage. The output target value is determined on the basis of the polarity reversion signal which is detected by the start control circuit 4403. The start control circuit 4403 is configured to regulate the output of the step down chopper 4 on the basis of the output target value.

When "the polarity of the voltage of the rectangular wave output is positive" and also the output of the step down chopper 4 is regulated, the start pulse control circuit 9003 turns on the switching element Q7 at a timing at which the polarity of the voltage of the rectangular wave is changed from the negative to the positive.

When the polarity of the voltage of the rectangular wave is changed from the negative state to the positive state, the start control circuit 4403 of the step down chopper 4003 is configured to determine the output target value of the step down chopper according to an amount of variation of the high pressure pulse voltage. That is, the output target value of the step down chopper 4 is temporary raised so as to offset the shortfall δVp of the high pressure pulse voltage. Subsequently, when the start pulse control circuit 9003 turns off the switching element Q7, the start control circuit 4403 of the step down chopper control circuit 4003 lowers the output target value of the voltage which is output from the step down chopper 4.

As mentioned above, the output of the step down chopper 4 is regulated only when the high pressure pulse voltage is generated. Therefore, it is possible to decrease the effective value of the voltage for starting the high pressure discharge lamp 8 considerably. As a result, it is possible to broaden the regulation range of the peak value of the pulse voltage which is applied to the high pressure discharge lamp, compared with the case where the effective value of the output voltage is approximately equal. In addition, it is possible to prevent the generation of the wasted pulse voltage.

(Fourth Embodiment)

Figure 43:
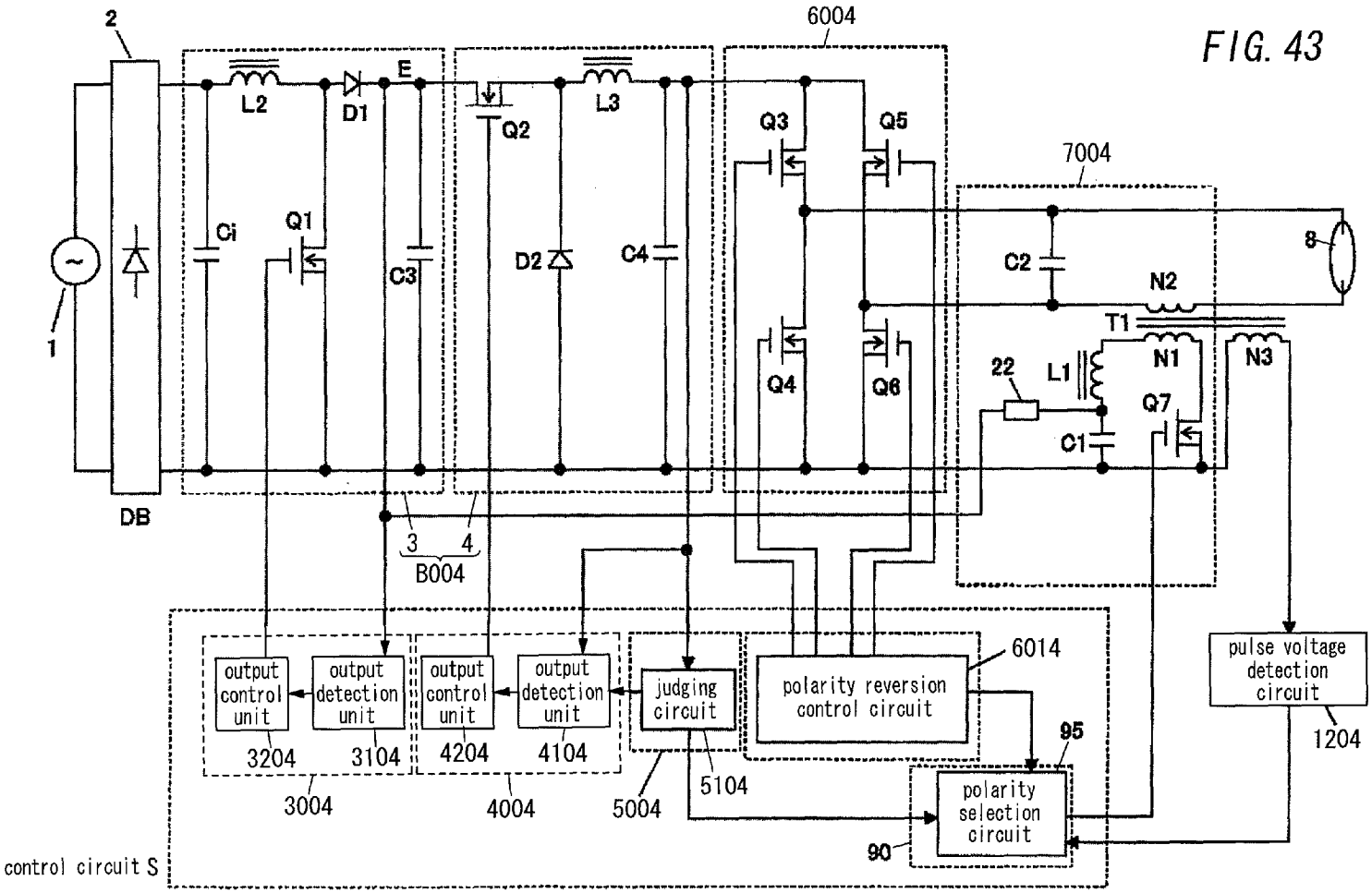
FIG. 43 shows a circuit diagram of the fourth embodiment.

FIG. 43 shows a circuit diagram of the entire components in the fourth embodiment. Hereinafter, the circuit components are explained. The high pressure discharge lamp lighting device is configured to receive the electric power from the commercial alternating current power source 1. The rectification circuit 2 is realized by the diode bridge DB. The rectification circuit 2 is configured full-wave rectifies the alternating current voltage supplied from the commercial alternating current power source 1 in order to output the pulsating voltage. The diode bridge DB is connected to a capacitor Ci in such a manner that the diode bridge DB is connected in parallel with the capacitor Ci. The diode bridge DB is connected to a series circuit. The series circuit is composed of the inductor L2 and the switching element Q1. The smoothing capacitor C3 is connected across the switching element Q1 through the diode D1. The inductor L2 is cooperative with the switching element Q1, the diode D1, the capacitor Ci, and the smoothing capacitor C3 to form a step up chopper 3. The switching element Q1 is turned on and turned off by the step up chopper controller 3004. The step up chopper controller 3004 is realized by the integrated circuit which is commercially available. The switching element Q1 is configured to be turned on and be turned off at frequency which is sufficiently higher than a frequency of the commercial alternating current voltage which is supplied from the commercial alternating current power source 1. Consequently, the output voltage which is output from the diode bridge DB is stepped up to a certain direct current voltage, whereby the smoothing capacitor C3 is charged by the certain direct current voltage.

The direct current power source E is the direct current voltage source which includes a commercial alternating current power source 1 and the smoothing capacitor C3 which is configured to rectify and smooth the output of the commercial alternating current power source 1. Therefore, the direct current power source E is equivalent to the step up chopper which is connected to the output terminals of the diode bridge DB.

The output of the step up chopper 3 is connected to the step down chopper 4. The step down chopper 4 acts as the ballast, and is configured to supply the target electric power to the high pressure discharge lamp 8 (which is a load). In addition, the step down chopper 4 is controlled to supply the suitable electric power to the high pressure discharge lamp 8 through the period of arc discharge from when the high pressure discharge lamp is started to when the high pressure discharge lamp 8 is stably operated.

The circuit components of the step down chopper 4 are explained. The positive terminal of the smoothing capacitor C3 is connected to the positive terminal of the capacitor C4 through the switching element Q2 and the inductor L3. The negative terminal of the capacitor C4 is connected to the negative terminal of the smoothing capacitor C3. The negative terminal of the capacitor C4 is connected to the anode of the diode D2. The diode D2 is provided for flowing the regenerative current. The cathode of the diode D2 is connected to a connection point between the switching element Q2 and the inductor L3.

The circuit operation of the step down chopper 4 is explained hereinafter. The step down chopper controller 4004 is configured to turn on and turn off the switching element Q2 at a high frequency. When the switching element Q2 has on-state, the direct current power source E applies the current to the switching element Q2, the inductor L3, and the capacitor C4. When the switching element Q2 has off-state, the regenerative current is flown through the inductor L3, the capacitor C4, and the diode D2. Consequently, the direct current power source E applies the direct current voltage (which is stepped down) to the capacitor C4. The step down chopper controller 4004 is configured to vary the duty cycle of the switching element Q2. (The duty cycle means the ratio of the on period to the one cycle.) Consequently, the voltage held in the capacitor C4 is varid. Therefore, the step up chopper 3 is cooperative with the step down chopper 4 to form the converter B004.

The output terminal of the step down chopper 4 is connected to the inverter 6004. The inverter 6004 is realized by the full bridge circuit. The full bridge circuit comprises the switching elements Q3 to Q6. The first pair (including the switching element Q3 and the switching element Q6) and the second pair (including the switching element Q4 and the switching element Q5) are turned on and turned off at a low frequency by the control signal of the polarity reversion circuit alternately. Consequently, the direct current voltage which is output from the step down chopper 4 is converted into the lighting voltage which is alternating current by the inverter 6004. The inverter 6004 supplies the lighting voltage to the high pressure discharge lamp 8. The high pressure discharge lamp 8 (which is a load) is exemplified by the high intensity high pressure discharge lamp (HID lamp) such as the metal halide lamp and the high pressure mercury lamp.

The igniter 7004 is configured to be operated only when the high pressure discharge lamp is started. The igniter 7004 is configured to generate the pulse voltage for starting the pulse voltage to the high pressure discharge lamp 8. The igniter 7004 is configured to superimpose the pulse voltage on the lighting voltage to produce the starting voltage, and applies the pulse voltage to the high pressure discharge lamp 8. The igniter 7004 comprises the capacitor C1, the transformer T1, the switching element Q7, and the impedance 71. The capacitor C1 is configured to receive the predetermined voltage value of the voltage through the impedance 22 from the direct current power source E. The switching element Q7 is configured to be turned on and turned off by the control signal which is sent from the outside. The impedance 71 is provided for preventing the excess current from being applied to the switching element Q7. The transformer T1 comprises the primary winding N1, the secondary winding N2, and the third winding N3. The primary winding N1 is connected across the capacitor C1. The primary winding is connected in series with the impedance 71 and the switching element Q7. The secondary winding N2 is connected across the inverter 6004. The secondary winding N2 is connected in series with the high pressure discharge lamp. The secondary winding N2 is configured to develop the voltage when the current is flown to the primary winding N1. The third winding N3 is configured to induce the detection voltage. The detection voltage has a correlative relationship with respect to the pulse voltage which is induced in the secondary winding. The impedance 22 is cooperative with the capacitor C1 to form the charging circuit of the capacitor C1. The capacitor C1 is cooperative with the primary winding N1, the impedance 71, and the switching element Q7 to form the discharge circuit of the capacitor C1. The switching element Q7 is configured to be turned on when the control circuit S sends the signal. The control circuit S is configured to turn on the switching element Q7 in order to discharge the capacitor C1. When the capacitor C1 is discharged, the discharge current is flown to the discharge circuit. The discharge current which is flown to the primary winding N1 induces the pulse voltage in the secondary winding N2. In addition, the pulse voltage and the lighting voltage which is applied to the secondary winding N2 induce the detection voltage in the third winding N3. The capacitor C2 is configured to bypass the high frequency voltage such that the capacitor C2 prevents the pulse voltage which is developed by the transformer T1 to be applied to the inverter 6004. The capacitor C2 is cooperative with the secondary winding N2 and the high pressure discharge lamp 8 to form the closed series circuit. When the high pressure pulse voltage is induced in the secondary winding N2 of the transformer T1, the high pressure pulse voltage is applied to the high pressure discharge lamp 8 through the capacitor C2.

The control circuit S comprises a step up chopper controller 3004, a step down chopper controller 4004, a judging unit 5004, a polarity reversion control circuit 6014, and the pulse generation controller 90. The step up chopper controller 3004 is configured to feed back "the output voltage which is output from the step up chopper 3" to the step up chopper 3 in order to regulate the output voltage constantly. The step down chopper controller 4004 is configured to detect the output voltage which is output from the step down chopper 4. The step down chopper controller 4004 is configured to control the step down chopper 4 so as to determine the current which corresponds to the detected output voltage. The judging circuit 5004 is configured to judge the condition whether the high pressure discharge lamp 8 has on-state or off-state on the basis of the output voltage of the step down chopper 4. The polarity reversion control circuit 6014 is configured to turn on and turn off the switching elements Q3 to Q6. The pulse generation controller 90 is configured to control the igniter 7004.

Figure 44:
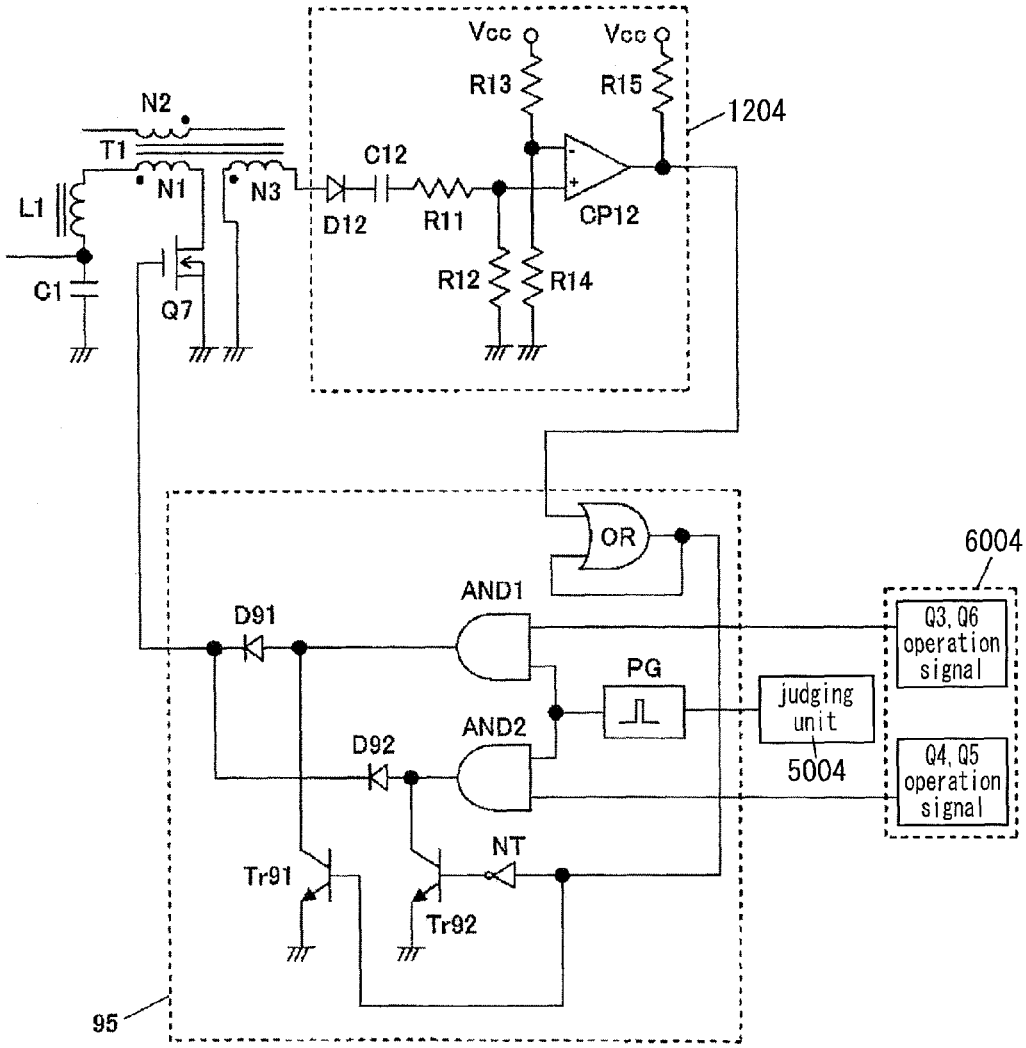
FIG. 44 shows circuit diagram showing main components in the fourth embodiment.

FIG. 44 shows the pulse generation controller 90 of the control circuit S. The pulse generation controller 90 is comprises a polarity selection circuit 95. The polarity selection circuit 95 is realized by logic circuits and other components. The logic circuits is configured to receive the detection signal which is output from the pulse voltage detection circuit 1204, the judging signal which is output from the judging unit 5004, and the polarity reversion signal which is output from the polarity reversion circuit 6004.

Figure 45:
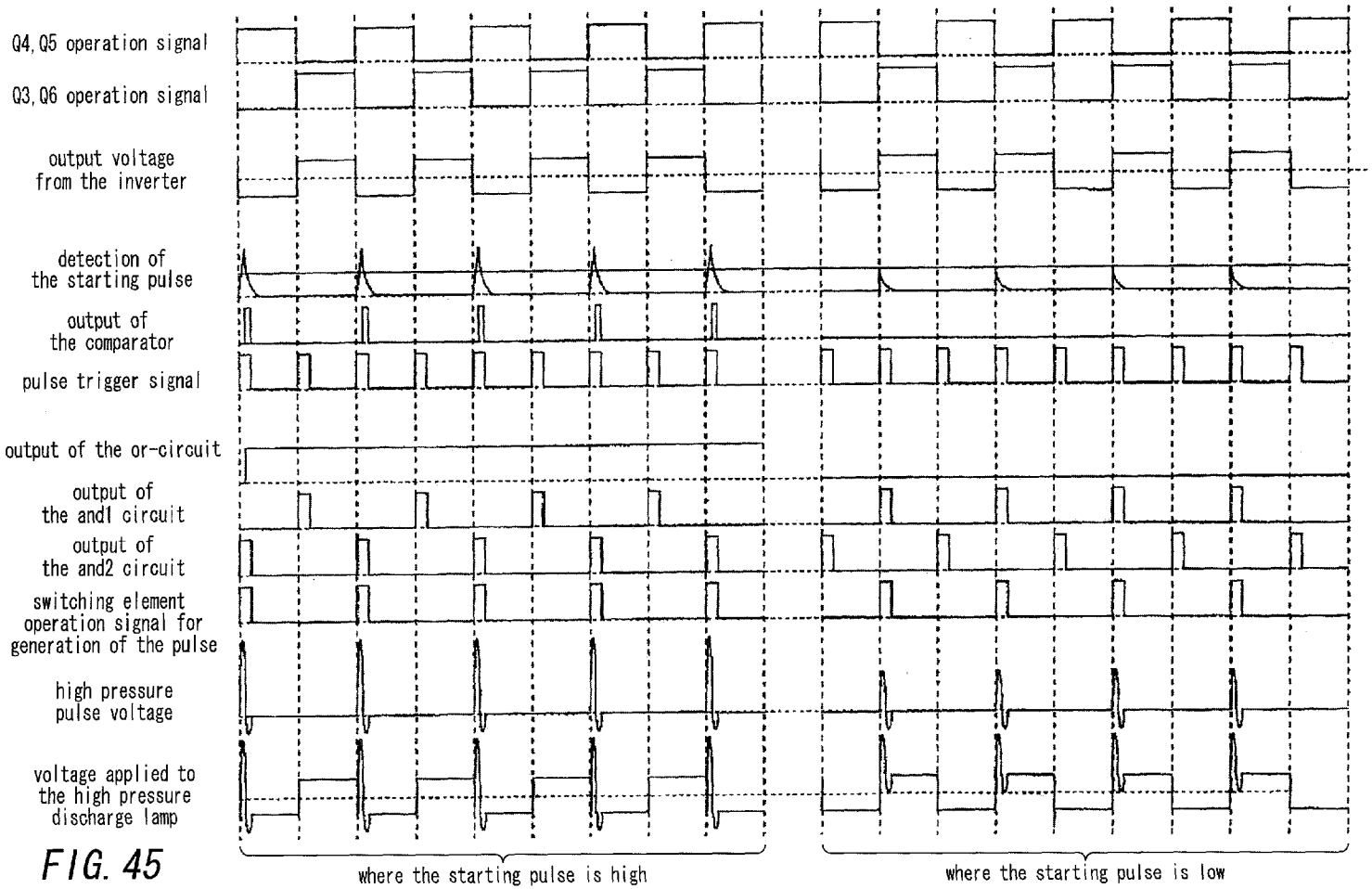
FIG. 45 shows an operation waveform of the fourth embodiment.

FIG. 45 shows the operation timings. The judging unit 5004 of the control circuit S is configured to judge the condition whether the high pressure discharge lamp has on state or off state. When the high pressure discharge lamp has off state, the control circuit S controls the igniter 7004 to start the high pressure discharge lamp 8.

The power source of the igniter 7004 is the step up chopper 3. The step up chopper 3 charges the capacitor C1. The control circuit S is configured to turn on the switching element Q7, whereby the capacitor C1 is discharged. The charged capacitor C1 generates the discharge current to the discharge circuit when the capacitor C1 is discharged. When the discharge current is flown to the primary winding N1, the pulse voltage is induced in the secondary winding N2. Furthermore, when the discharge current is flown to the primary winding N1, the detection voltage is induced in the third winding N3.

The detection voltage which is induced in the third winding N3 is compared with the reference value by a comparator CP12 of the pulse voltage detection circuit 1204. It is noted that there is no need to detect the voltage value in the third winding N3 accurately, compared with the case of regulating the pulse voltage constantly. For example, it is only required to judge whether the voltage value in the third winding N3 is higher than a predetermined value or lower than the predetermined value. Therefore, simple configuration in FIG. 44 may be employed as a means for detection of the voltage in the third winding N3.

In the pulse voltage detection circuit 1204 of FIG. 44, a first end of the third winding N3 is grounded, and a second end of the third winding N3 is connected to the voltage dividing circuit through a diode D12 and a differentiating circuit C12. The diode D12 is cooperative with the differentiating circuit C12 to half-wave rectifying the voltage. The voltage dividing circuit comprises a resistor R11 and a resistor R12. The divided detection voltage is input to a plus terminal of the comparator CP12. A minus terminal of the comparator CP12 receives the reference voltage which is made from the control power source voltage Vcc which is divided by the resistors R13 and R14. The output of the comparator CP12 is equivalent to an open corrector output or an open drain output which is pulled up by the resistor R15. When the voltage applied to the plus terminal becomes higher than the reference voltage of the minus terminal, the output terminal of the comparator CP12 holds High level. In this manner, the detection signal which indicates the starting voltage is output.

An output terminal of the comparator CP12 is connected to a first input terminal of a OR-circuit OR of the polarity selection circuit 95. A second input terminal of the OR-circuit OR is connected to the output terminal of the OR-circuit OR. Therefore, when the detected pulse voltage is higher than the reference value, the output of the OR-circuit OR holds High level. As a result, the transistor Tr91 is turned on. When the transistor Tr91 is turned on, the AND-circuit AND1 is prohibited to output a pulse trigger signal which is sent through the diode D91. (The pulse trigger signal is equivalent to an output of the pulse oscillator PG.) As a result, the operation signal (for turning on the switching element Q7) being in synchronization with the operation signal (for turning on the switching elements Q3, Q6) is cancelled.

Consequently, the pulse voltage which is developed by the igniter 7004 is superimposed on the rectangular wave output having a negative polarity. Therefore, if an amplitude of the pulse voltage is Vp and the peak value of the rectangular wave output is Vr, voltage difference Vp−Vr which is made from the subtraction of the voltage Vr from the voltage Vp is applied to the high pressure discharge lamp 8. In this manner, the polarity selection circuit 95 is configured to turn on the switching element Q7 in order to superimpose the pulse voltage on the lighting voltage which has a negative polarity. Therefore, the polarity selection circuit 95 acts as the starting voltage regulation circuit. Furthermore, the polarity selection circuit 95 acts as a controller for turning on the switching element Q7.

In contrast, if the pulse voltage which is detected is lower than the reference value, the output of the OR-circuit OR holds Low level. Therefore, the transistor Tr92 is turned on. As a result, the AND-circuit AND2 is prohibited to output the pulse trigger signal which is sent through the diode D92. (The pulse trigger signal is equivalent to the output of the pulse oscillation unit PG.) As a result, the operation signal (for turning on the switching element Q7) which is in synchronization with the operation signal (for turning on the switching elements Q4 and Q5) is cancelled.

Consequently, the pulse voltage which is generated by the igniter 7004 is superimposed on the rectangular wave output having a positive polarity. Therefore, if the amplitude of the pulse voltage is amplitude Vp, the peak value Vr with amplitude Vp of the pulse voltage is applied to the high pressure discharge lamp 8. Consequently, the polarity selection circuit 95 is configured to turn on the switching element Q7 such that the pulse voltage is superimposed on the pulse voltage when the pulse voltage has the positive polarity.

When the polarity of the rectangular wave is varied, the voltage applied to the high pressure discharge lamp 8 is equal to (Vp+Vr) or (Vp−Vr). As a result, the twice voltage difference of the peak value of the rectangular wave is caused.

Therefore, on the basis of the detection voltage induced in the third winding N3, it is preferred to change the timing whether the switching element Q7 is turned on in the positive voltage of the lighting voltage or the switching element Q7 is turned on in the negative voltage of the lighting voltage. Consequently, it is possible to offset the shortfall which is caused by the attenuation due to the wiring length. As a result, it is possible to apply the starting voltage, which is required for starting the high pressure discharging lamp, to the high pressure discharge lamp.

There is a situation where the wiring length is shortest. Under this situation, it is preferred that the voltage (Vp−Vr) is set to have a voltage value approximately equal to the maximum value of the starting pulse voltage which is defined by the high pressure discharge lamp lighting device. In contrast, there is a situation where the wiring length is longest. Under this situation, it is preferred that the reversion of the polarity is performed by the voltage (Vp−Vr) which is equivalent to the detection voltage corresponding to the voltage Vp which is equal to a minimum value of the starting pulse voltage defined by the high pressure discharge lamp lighting device In this embodiment, the voltage induced in the third winding N3 is detected as the detection voltage. However, it is possible to employ the pulse voltage detection circuit which is in parallel with the high pressure discharge lamp 8. Consequently, the pulse voltage detection circuit is configured to detect the starting voltage applied to the high pressure discharge lamp. In addition, it is also possible to employ the pulse voltage detection circuit which is connected in parallel with the primary winding N1. Consequently, the pulse voltage detection circuit is configured to detect the pulse voltage induced in the primary winding N1.

Figure 46:
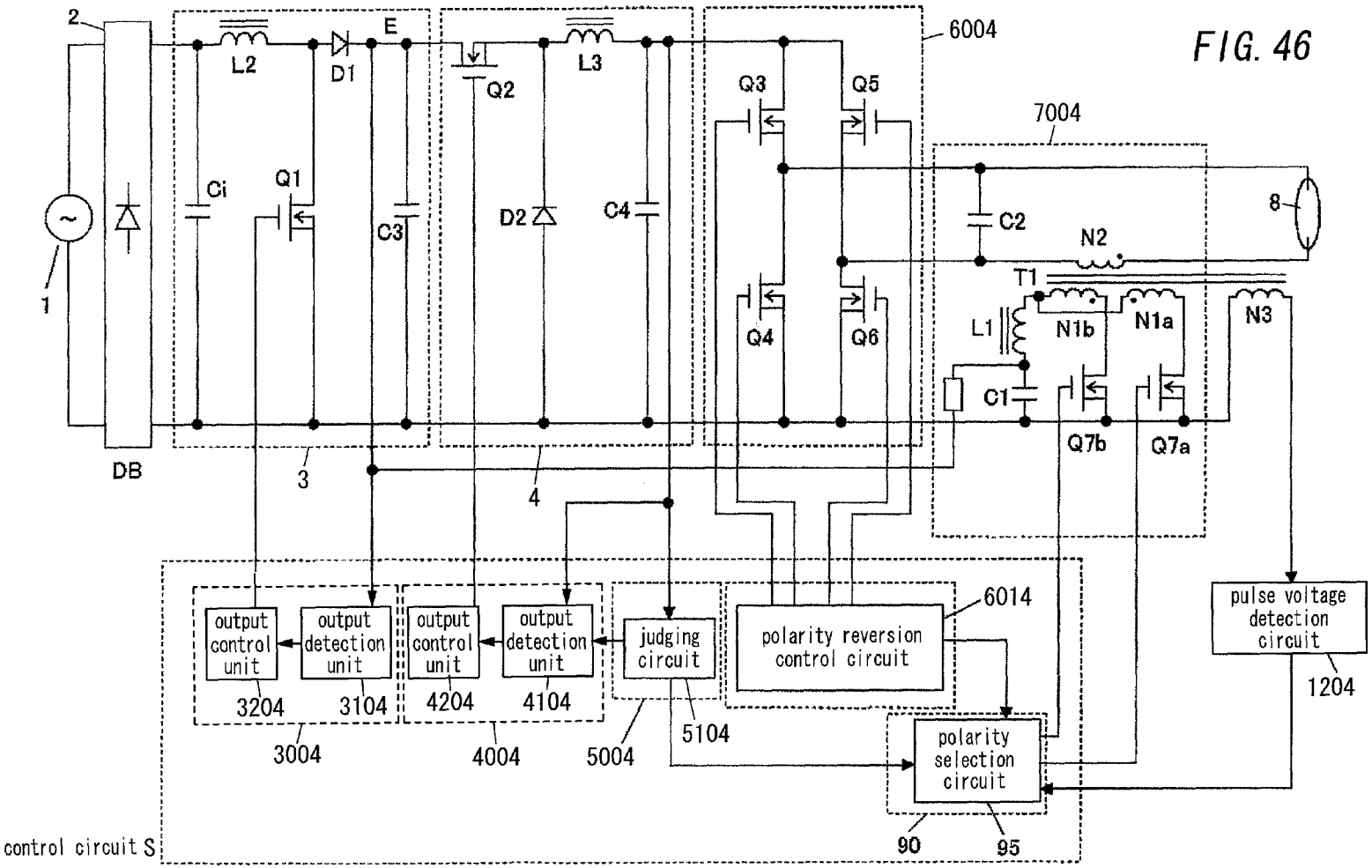
FIG. 46 shows a circuit diagram of the first modification of the fourth embodiment.
Figure 47:
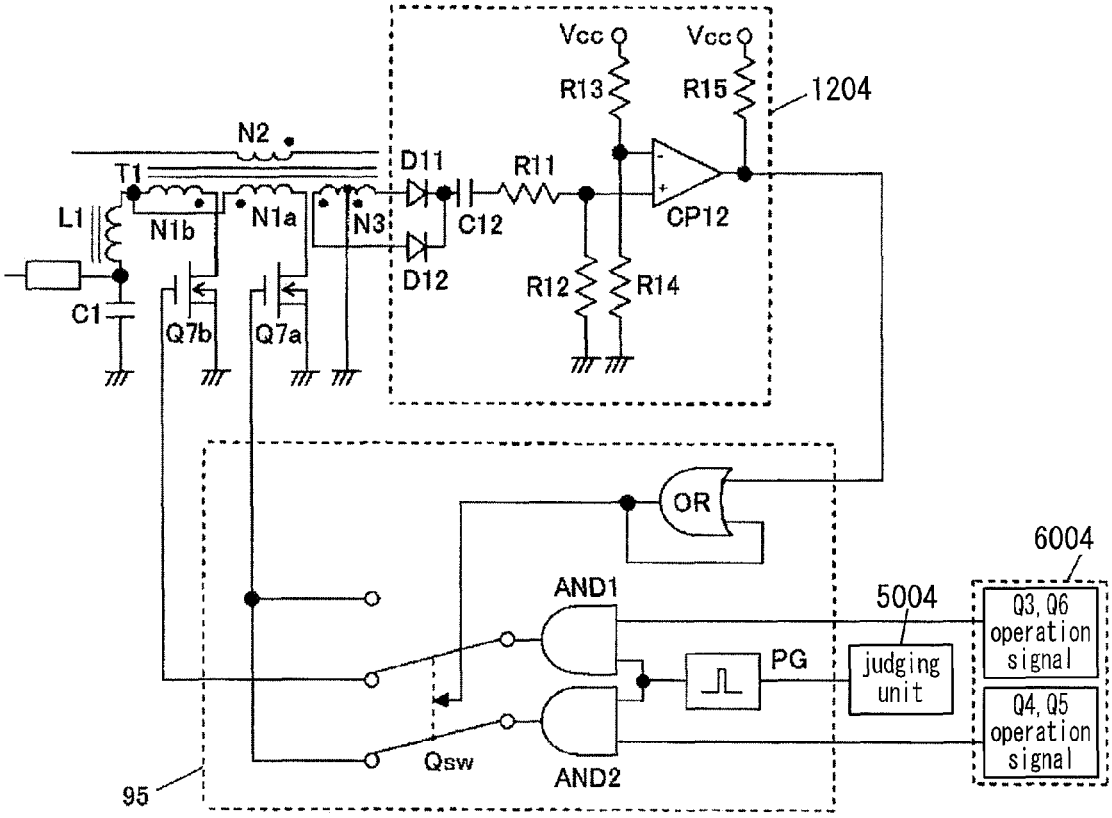
FIG. 47 shows a circuit diagram showing main components of the first modification of the fourth embodiment.

FIG. 46 shows a first modification of the fourth embodiment. The circuit components in this modification are different from that of the fourth embodiment in the following features. That is, in the igniter 7004, the transformer T1 comprises a first primary winding N1*a* and the second primary winding N1*b*. In addition, as shown in FIG. 47, the first primary winding N1*a* has a first output terminal which is located in a side of the capacitor C1. The first output terminal has a polarity which is different from the polarity of the terminal of the capacitor C1 of the second primary winding N1*b*. With this configuration, the first primary winding N1*a* is configured to develop the pulse voltage which has a first polarity. The second primary winding N1*b* is configured to develop the pulse voltage which has a second polarity. The first polarity is opposite to the second polarity. Therefore, when the capacitor C1 applies the discharge current to the first primary winding N1*a*, the first pulse voltage is induced in the first primary winding N1*a*. When the capacitor C1 applies the discharge current to the second primary winding N1*b*, the second pulse voltage is induced in the second primary winding N1*b*. The first pulse voltage is opposite to the second pulse voltage. According to this configuration, the circuit further comprises a switching element Q7*a*, and a switching element Q7*b*. The switching element Q7*a* is connected in series with the first primary winding N1*a*. The switching element Q7*b* is connected in series with the second primary winding N1*b*. Therefore, the switching element Q7*a* is cooperative with the first primary winding N1*a* to form a first discharge path. The switching element Q7*b* is cooperative with the second primary winding N1*b* to form a second discharge path. The first discharge path is connected in parallel with the second discharge path.

Figure 48:
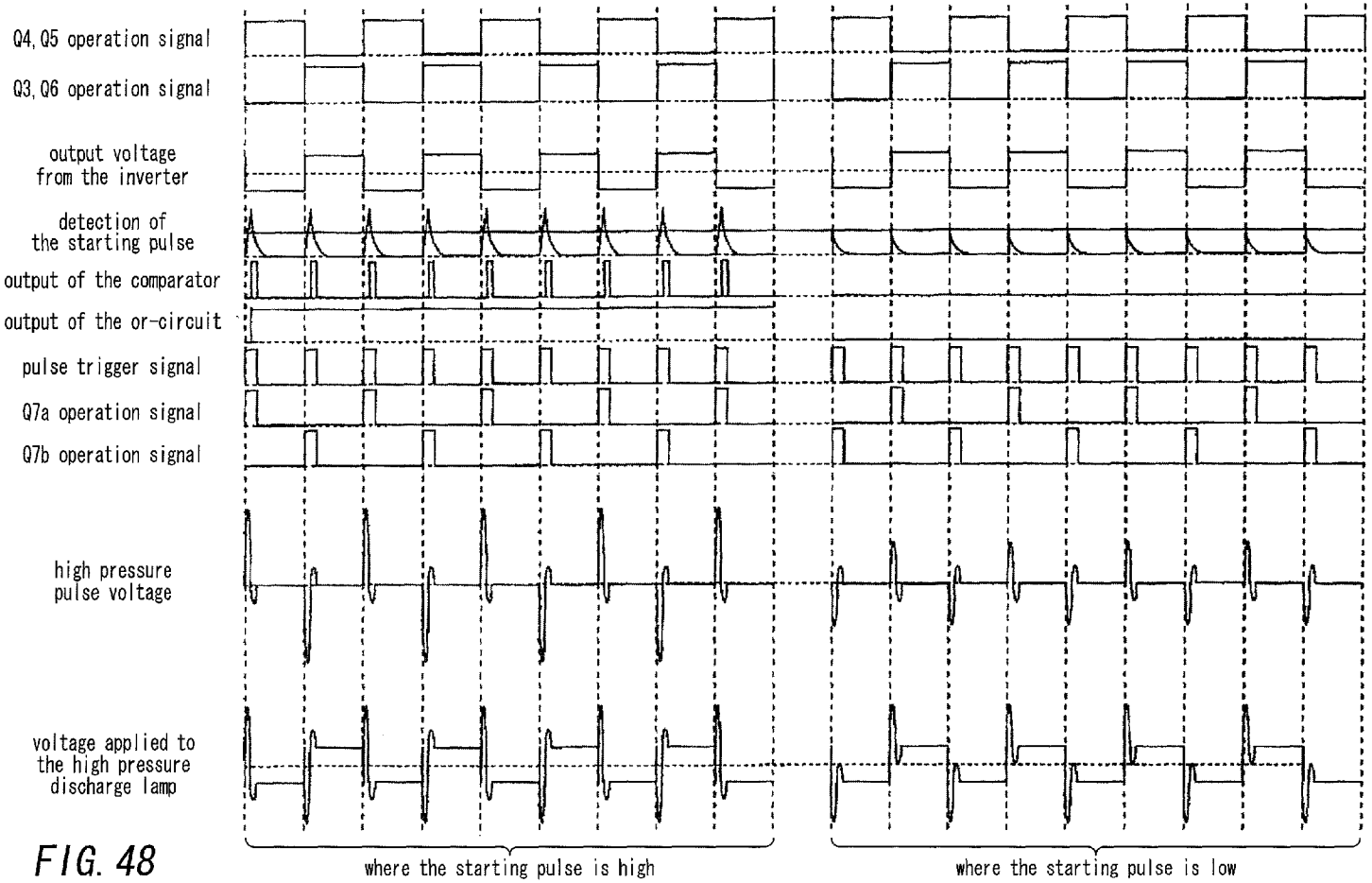
FIG. 48 shows an operation waveform of the first modification of the fourth embodiment.

FIG. 47 shows a detail of the pulse generation controller 90 of the control circuit S. The FIG. 48 shows operation timings.

The judging unit 5004 of the control circuit S judges whether the high pressure discharge lamp 8 has on state or off state. When the high pressure discharge lamp has off state, the control circuit S activates the pulse oscillation unit PG to oscillate, whereby the high pressure discharge lamp 8 is started.

The capacitor C1 of the igniter 7004 is charged by the direct current voltage Vc3 which is output from the power source which is realized by the step up chopper 3. The control circuit S turns on the switching element Q7*a*. As a result, the discharge current which is generated by the discharge of the capacitor C1 is applied to discharge circuit. The discharge circuit comprises the inductor L1, the primary winding N1*a* of the transformer T1, the switching element Q7*a*, and the capacitor C1. The discharge current which is applied to the first primary winding N1*a* induces the high pressure pulse voltage in the secondary winding N2. In addition, the discharge current which is applied to the first primary winding N1*a* induces the detection voltage in the third winding N3.

The detection voltage which is induced in the third winding N3 is compared with the reference value by the comparator CP12.

In this embodiment, in order to detect the pulse voltage having a positive polarity and also the pulse voltage having a negative polarity, the third winding N3 is provided at its center with a tap. The tap is grounded. In addition, a first terminal of the third winding N3 is connected to an anode of the diode D11. A second terminal of the third winding N3 is connected to an anode of the diode D12. The cathodes of the diodes D11 and D12 are connected to a series circuit which comprises a resistor R11 and a resistor R12 which is connected in series with the resistor R11 through a differentiation capacitor C12.

When the detected pulse voltage is higher than the reference value, the output of the OR-circuit OR holds the High level. Subsequently, a switching circuit Qsw is set such that "the first switching element Q7*a* is turned on when the operation signal for the switching elements Q4 and Q5 of the inverter 6004 has High level" and "the second switching element Q7*b* is turned on when the operation signal for the switching elements Q3 and Q6 of the inverter 6004 has High level".

Consequently, the pulse voltage induced in the igniter 7004 is superimposed on the rectangular wave output having a polarity which is opposite to the polarity of the pulse voltage. Therefore, if "the amplitude of the pulse voltage is equal to amplitude Vp" and "the peak value of the rectangular wave output is equal to the peak value Vr", the voltage which is equal to the difference between the amplitude Vp and the peak value Vr is applied to the high pressure discharge lamp 8.

When the detected pulse voltage is lower than the reference value, the output of the OR-circuit OR is held to have a Low level. Therefore, the switching circuit Qsw is set such that "the first switching element Q7*b* is turned on when the operation signal for the switching elements Q4 and Q5 of the inverter 6004 has High level" and "the second switching element Q7*a* is turned on when the operation signal for the switching elements Q3 and Q6 of the inverter 6004 has High level".

Consequently, the pulse voltage generated by the igniter 7004 is superimposed on the rectangular wave output having the polarity which is equal to the polarity of the pulse voltage.

Therefore, if "the amplitude of the pulse voltage is the amplitude Vp" and "the peak value of the rectangular wave output is the peak value Vr", the voltage which is equal to the sum of the amplitude Vp to the peak value Vr is applied to the high pressure discharge lamp 8.

In this manner, the polarity of the pulse voltage is varied according to the polarity of the rectangular wave output. Consequently, the voltage applied to the high pressure discharge lamp is equal to (the amplitude Vp+the peak value Vr) or (the amplitude Vp+the peak value Vr). Therefore, it is possible to cause the twice voltage difference between the peak values of the rectangular wave.

In this manner, on the basis of the detection voltage in the third winding N3, "the polarity of the rectangular wave at which the switching element Q7*a* and the switching element Q7*b* are turned on" is varied. Consequently, it is possible to offset the shortfall of the pulse voltage due to the wiring length. Therefore, it is possible to apply the starting voltage which is required for turning on the high pressure discharge lamp.

It should be noted that there is no need to detect the voltage by the third winding N3 accurately compared with the case where the pulse voltage is kept constant. Therefore, it is required to judge whether the voltage detected by the third winding N3 is higher than a predetermined value or is lower than a predetermined value. Therefore, as seen in FIG. 47, it is possible to judge the above matter by simply configurations.

There is a situation where the wiring length is shortest. Under this situation, it is preferred that the voltage (Vp−Vr) is set to have a voltage value approximately equal to the maximum value of the starting pulse voltage which is defined by the high pressure discharge lamp lighting device. In addition, it is preferred that the reversion of the polarity is performed by the voltage (Vp−Vr) which is equivalent to the detection voltage corresponding to the voltage Vp which is equal to a minimum value of the starting pulse voltage defined by the high pressure discharge lamp lighting device when the wiring length is maximum.

In addition, the step down chopper 4 may employ the switching elements of the half bridge circuit or the full bridge circuit which constructs the inverter 6004. For example, in the circuit diagram of FIG. 43 and FIG. 46, the step down chopper 4 is omitted. A chopper choke is placed at a portion between "a connection point between the switching element Q3 and the switching element Q4" and "a connection point between the switching element Q5 and the switching element Q6". The chopper choke comprises an inductor L3 and the capacitor C2 which is connected in series with the inductor L3. In addition, a series circuit being composed of the secondary winding N2 of the transformer T1 and the high pressure discharge lamp 8 in series with the secondary winding N2 is connected across the capacitor C2. The switching elements Q4, Q6 are turned on and turned off at a low frequency. The switching element Q5 is turned on and turned off at a high frequency under a situation where the switching element Q4 is turned on. The switching element Q3 is turned on and turned off at a high frequency under a situation where the switching element Q6 is turned on. Consequently, the inverter 6004 is integrally constructed with the step down chopper 4. In this case, as is known in the art, parasitic diodes of the switching elements Q3, Q5 are also employed for flowing the regenerative current of the step down chopper. (The parasitic diodes are realized by the MOSFETs which are oppositely arranged with respect to each other.)

In the above embodiment, the pulse voltage detection circuit is configured to detect the peak value of the pulse voltage on the basis of the detection voltage developed in the third winding N3. However, the method of detecting the pulse voltage by the pulse voltage detection circuit is not limited thereto. As a first example, it is possible to employ the pulse voltage detection circuit being configured to detect the pulse width of the pulse voltage on the basis of the detection voltage developed in the third winding N3. As a second example, it is possible to employ the pulse voltage detection circuit being configured to detect the gradient of the pulse voltage on the basis of the detection voltage induced in the third winding N3. As a third example, it is possible to employ the pulse voltage detection circuit which comprises a voltage level comparison circuit. The voltage level comparison circuit is configured to compare the detection voltage with a predetermined voltage level which is set previously. The voltage level detection circuit is configured to output a comparison result. In this manner, the pulse voltage detection circuit is configured to detect the pulse voltage.

(Fifth Embodiment)

FIG. 49 shows a lighting fixture which uses the high pressure discharge lamp of the first to fourth embodiment. FIG. 49(*a*) and FIG. 49(*b*) show spot lights each of which incorporates the HID lamps. FIG. 49(*c*) shows a down light which incorporates the HID lamp. Each FIG. 49(*a*) to FIG. 49(*c*) shows a high pressure discharge lamp 8, a housing 81, a wiring 82, and a ballast 83. The housing 81 is provided for holding the high pressure discharge lamp 8. The ballast 83 incorporates a lighting device. It is possible to combine a plurality of the lighting fixtures to construct the lighting system. In addition, it is possible to employ the high pressure discharge lamp lighting device of the first embodiment to the fourth embodiment as the above lighting device. Consequently, it is possible to regulate the peak value of the starting pulse voltage suitably. Therefore, it is possible to start the high pressure discharge lamp even if the wiring is long. In addition, it is also possible to lower the peak value of the starting pulse voltage in a case where the wiring is short.

The high pressure discharge lamp lighting device being configured to output the starting pulse voltage which is free from the attenuation even if the wiring length is increased is capable of wiring the wire 82 from, for example, 2 meters to 10 meters. Therefore, it is possible to enhance the construction possibility. In addition, it is also possible to dispose a plurality of the ballast 83 in the same location. Further, it is possible to reduce the distance of the wiring. As a result, the maintenance personnel is able to check the ballasts at once.

The invention claimed is:

1. A high pressure discharge lamp lighting device comprising:

a converter being configured to output a direct current voltage;

an inverter being configured to convert the direct current voltage into a lighting voltage which is alternate current, and is configured to apply the lighting voltage to a high pressure discharge lamp through an output terminal;

an igniter being configured to output a pulse voltage, said igniter being configured to superimpose the pulse voltage on the lighting voltage to apply a starting voltage to the high pressure discharge lamp, said igniter comprising a capacitor, a switching means, and a transformer, said capacitor being configured to be charged by a voltage source, said transformer comprising a primary winding and a secondary winding, said primary winding is connected across said capacitor, said primary winding being connected in series with said switching means, said secondary winding being connected across said inverter, said secondary winding being connected in series with the high pressure discharge lamp, a controller being configured to turn on and turn off the switching means, said controller being configured to turn on said switching means in order to discharge the capacitor, thereby flowing a discharge current to said primary winding in order to develop the pulse voltage in the secondary winding, said pulse voltage is caused by the discharge current which is applied to the primary winding, the pulse voltage is superimposed on the lighting voltage, a pulse voltage detection circuit being configured to detect the starting voltage which is applied to the high pressure discharge lamp, and outputs a detection signal indicative of a voltage level which corresponds to the starting voltage, wherein said high pressure discharge lamp lighting device further comprises a starting voltage regulation circuit being configured to regulate the voltage value of the starting voltage to a desired voltage value on the basis of the detection signal.

2. The high pressure discharge lamp lighting device as set forth in claim 1, wherein said transformer further comprises a third winding being configured to develop a detection voltage which corresponds to the pulse voltage when the pulse voltage is developed in said secondary winding, said pulse voltage detection circuit being configured to detect the starting voltage on the basis of the detection voltage which is developed in the third winding.

3. The high pressure discharge lamp lighting device as set forth in claim 1 or 2, wherein said starting voltage regulation circuit being configured to vary an amount of an electrical charge of said capacitor at a moment when the capacitor is discharged, the amount of the electrical charge is determined on the basis of the detection signal.

4. The high pressure discharge lamp lighting device as set forth in claim 3, wherein said high pressure discharge lamp lighting device further comprising an impedance which is placed between the voltage source and the capacitor, said impedance being cooperative with said capacitor to form a charging circuit, said starting voltage regulation circuit comprising a charge start detection circuit, a timer, and a capacitor voltage regulation circuit, said charge start detection circuit being configured to output a charge start signal when said charge start detection circuit detects a start of a charging of said capacitor by the voltage source, said timer being configured to output a charge completion signal after an elapse of a predetermined period of a charging time from when the timer receives the charge start signal, said capacitor voltage regulation circuit being configured to vary an amount of charge of said capacitor at a moment when said capacitor discharges, said controller being configured to turn on said switching means when said controller receives the charge completion signal, said capacitor voltage regulation circuit being configured to vary the impedance value of said impedance on the basis of the detection signal, whereby said capacitor voltage regulation circuit varies a charging speed of charging the capacitor to vary the amount of the electrical charge of said capacitor.

5. The high pressure discharge lamp lighting device as set forth in claim 3, wherein said starting voltage regulation circuit comprising a charge start detection circuit and a timer, said charge start detection circuit being configured to detect the start of charging of said capacitor in order to output the charge start signal, said timer being configured to output a charge completion signal when a predetermined charging period of time is passed from when the timer receives the charge start signal, said controller being configured to turn on said switching means when said controller receives the charge completion signal, said timer being configured to vary a charging time for charging said capacitor on the basis of the detection signal, whereby the timer varies the amount of the electrical charge of the capacitor when said timer outputs the charge completion signal.

6. The high pressure discharge lamp lighting device as set forth in claim 1 or 2, wherein said capacitor being cooperative with said switching means and said primary winding of said transformer to form a discharge circuit for flowing the discharge current from the capacitor, said starting voltage regulation circuit being configured to vary the impedance value of said discharge circuit on the basis of the detection signal.

7. The high pressure discharge lamp lighting device as set forth in claim 6, wherein said switching means having an internal impedance value which is varied according to an input voltage or an input current applied to the switching means, said starting voltage regulation circuit being configured to vary the input voltage or the input current on the basis of the detection signal.

8. The high pressure discharge lamp lighting device as set forth in claim 6, wherein said switching means comprising a first switching element and a second switching element, said first switching element is connected in parallel with said second switching element, said first switching element having a first internal impedance when said first switching element is turned on, said second switching element having a second internal impedance when said second switching element is turned on, the first internal impedance is different from the second internal impedance, said starting voltage regulation circuit being configured to output a selection signal for allowing said controller to selectively turn on said first switching element or said second switching element on the basis of the detection signal.

9. The high pressure discharge lamp lighting device as set forth in claim 6, wherein said primary winding comprising a tap, said switching means comprising a first switching element and a second switching element, said second switching element is connected in parallel with said first switching element through said tap, said starting voltage regulation circuit being configured to output a selection signal for allowing said controller to selectively turn on said first switching element or said second switching element.

10. The high pressure discharge lamp lighting device as set forth in claim 1 or 2, wherein said starting voltage regulation circuit being configured to vary said lighting voltage on the basis of said detection signal.

11. The high pressure discharge lamp lighting device as set forth in claim 10, wherein said starting voltage regulation circuit is configured to temporarily increase a voltage value of the lighting voltage which is output from said inverter, said starting voltage regulation circuit is configured to temporarily increase the voltage value of the lighting voltage in synchronization with a timing of turning on said switching means on the basis of said detection signal.

12. The high pressure discharge lamp lighting device as set forth in claim 10, wherein said starting voltage regulation circuit being configured to determines a timing when the starting voltage becomes a desired value on the basis of the detection signal, and said starting voltage regulation circuit allows the controller to turn on said switching element at the timing.

13. The high pressure discharge lamp lighting device as set forth in claim 12, wherein said starting voltage regulation circuit being configured to control said converter to vary a voltage value of the direct current voltage linearly within a half-cycle of the lighting voltage.

14. The high pressure discharge lamp lighting device as set forth in claim 12, wherein said starting voltage regulation circuit being configured to control said converter to vary a voltage value of the direct current voltage in a stepwise fashion within a half cycle of the lighting voltage.

15. The high pressure discharge lamp lighting device as set forth in claim 1 or 2, wherein said starting voltage regulation circuit being configured to select a timing whether the pulse voltage is developed in the positive voltage of the lighting voltage or in the negative voltage of the lighting voltage on the basis of the detection signal, and said starting voltage regulation circuit being configured to control said controller to turn on said switching element at the timing.

16. The high pressure discharge lamp lighting device as set forth in claim 15, wherein said starting voltage regulation circuit being configured to detect whether the voltage value of the pulse voltage has a first condition or a second condition on the basis of the detection signal, the voltage value of the pulse voltage in the first condition is higher than a reference value, the voltage value of the pulse voltage in the second condition is lower than the reference value, said starting voltage regulation circuit being configured to generate the pulse voltage when the lighting voltage has a polarity which is opposite to a polarity of the pulse voltage in a case where the voltage value of the pulse voltage has the first condition, said starting voltage regulation circuit being configured to generate the pulse voltage when the lighting voltage has a polarity which is same to a polarity of the pulse voltage in a case where the voltage value of the pulse voltage has the second condition.

17. The high pressure discharge lamp lighting device as set forth in claim 15, wherein said primary winding being composed of a first primary winding and a second primary winding, said switching means comprising a first switching element and a second switching element, said capacitor being cooperative with said first primary winding and said first switching element to form a first discharging path, said capacitor being cooperative with said second primary winding and said second switching element to form a second discharging path, said second discharging path is connected in parallel with said first discharging path, said first primary winding being configured to develop a first pulse voltage in said secondary winding, said second primary winding being configured to develop a second pulse voltage in said secondary winding, the first pulse voltage having a polarity which is opposite to a polarity of the second pulse voltage, said starting voltage regulation circuit being configured to detect whether a voltage value of the pulse voltage has a first condition or a second condition on the basis of the detection signal, the voltage value of the pulse voltage in the first condition is higher than a reference voltage value, the voltage value of the pulse voltage in the second condition is higher than a reference voltage value, the starting voltage regulation circuit being configured to send an on-signal to said controller to allow said controller to turn on said first switching element or said second switching element when said voltage value of the pulse voltage having the first condition and when said lighting voltage has a polarity which is opposite to a polarity of the pulse voltage, and the starting voltage regulation circuit being configured to send the on-signal to said controller to allow said controller to turn on said first switching element or said second switching element when said voltage value of the pulse voltage having the second condition and when said lighting voltage has a polarity which is same to a polarity of the pulse voltage.

18. A lighting fixture comprising the high pressure discharge lamp lighting device as set forth in claim 1.

* * * * *